US011830671B2

(12) United States Patent
Trevors et al.

(10) Patent No.: US 11,830,671 B2
(45) Date of Patent: Nov. 28, 2023

(54) METHODS FOR GENERATING DIRECTIONAL MAGNETIC FIELDS AND MAGNETIC APPARATUSES THEREOF

(71) Applicant: Lantha Tech Ltd., Calgary (CA)

(72) Inventors: Evan Trevors, Red Deer (CA); Nicholas Simin, Calgary (CA); Josh Javor, Allston, MA (US); Christian Ruiz, Brea, CA (US)

(73) Assignee: Lantha Tech Ltd., Calgary (CA)

( * ) Notice: Subject to any disclaimer, the term of this patent is extended or adjusted under 35 U.S.C. 154(b) by 0 days.

(21) Appl. No.: 17/762,251

(22) PCT Filed: Oct. 19, 2021

(86) PCT No.: PCT/CA2021/051465
§ 371 (c)(1),
(2) Date: Mar. 21, 2022

(87) PCT Pub. No.: WO2022/115939
PCT Pub. Date: Jun. 9, 2022

(65) Prior Publication Data

US 2023/0120544 A1 Apr. 20, 2023

Related U.S. Application Data

(60) Provisional application No. 63/151,419, filed on Feb. 19, 2021, provisional application No. 63/151,290, (Continued)

(51) Int. Cl.
*H01F 7/02* (2006.01)

(52) U.S. Cl.
CPC ..... *H01F 7/021* (2013.01)

(58) Field of Classification Search
CPC ..... H01F 7/021
See application file for complete search history.

(56) References Cited

U.S. PATENT DOCUMENTS 2,287,286 A 6/1942 Bing et al.
3,079,191 A 2/1963 Engelsted et al.
(Continued)

FOREIGN PATENT DOCUMENTS

CA 2856138 A1 6/2013
CA 2879321 A1 1/2014
(Continued)

OTHER PUBLICATIONS

ISA/CA—Canadian Intellectual Property Office—International Search Report, dated Feb. 8, 2022—PCT/CA2021/051465.
(Continued)

*Primary Examiner* — Mohamad A Musleh
(74) *Attorney, Agent, or Firm* — Gowling WLG (Canada) LLP

(57) ABSTRACT

A switchable magnetic apparatus has a front layer, a rear layer, and a manipulating mechanism for changing the relative arrangement of the magnets to change the apparatus between ON and OFF states. The front layer has one or more front-layer magnets and a plurality of interleaved ferromagnetic components. The rear layer has one or more rear-layer magnets. When the magnetic apparatus is OFF, some or all of the rear-layer magnets overlap some or all of the ferromagnetic components, wherein the ferromagnetic components experience opposite poles between the adjacent front-layer magnets compared to the adjacent rear-layer magnet. When the magnetic apparatus is ON, some or all the rear-layer magnets overlap some or all the ferromagnetic components, wherein the ferromagnetic components experience the same magnetic pole from the adjacent front-layer magnets and the adjacent rear-layer magnet.

22 Claims, 37 Drawing Sheets

Related U.S. Application Data filed on Feb. 19, 2021, provisional application No. 63/133,524, filed on Jan. 4, 2021, provisional application No. 63/121,069, filed on Dec. 3, 2020.

(56) References Cited

U.S. PATENT DOCUMENTS

| | | | | |
|---|---|---|---|---|
| 3,599,305 | A | 8/1971 | Aurich | |
| 3,775,717 | A | 11/1973 | Brailion | |
| 4,055,824 | A | 10/1977 | Baermann | |
| 4,251,791 | A | 2/1981 | Yanagisawa et al. | |
| 4,329,673 | A | 5/1982 | Uchikune et al. | |
| 4,419,644 | A | 12/1983 | Baermann | |
| 5,448,803 | A | 9/1995 | Morell | |
| 5,506,558 | A * | 4/1996 | Laube | F16C 32/0431 335/304 |
| 5,641,105 | A | 6/1997 | Goto | |
| 5,800,106 | A | 9/1998 | Miller | |
| 5,832,831 | A | 11/1998 | Boyle et al. | |
| 6,344,344 | B1 | 2/2002 | Kazarinova et al. | |
| 6,664,880 | B2 | 12/2003 | Post | |
| 6,707,360 | B2 | 3/2004 | Underwood et al. | |
| 6,758,146 | B2 | 7/2004 | Post | |
| 6,846,168 | B2 | 1/2005 | Davis et al. | |
| 6,876,284 | B2 | 4/2005 | Wright et al. | |
| 7,012,495 | B2 | 3/2006 | Underwood et al. | |
| 7,161,451 | B2 | 1/2007 | Shen | |
| 7,468,646 | B2 | 12/2008 | Osterberg | |
| 7,942,458 | B2 | 5/2011 | Patterson | |
| 8,009,001 | B1 | 8/2011 | Cleveland | |
| 8,167,263 | B1 | 5/2012 | Zampelli | |
| 8,256,098 | B2 | 9/2012 | Michael | |
| 8,350,663 | B1 | 1/2013 | Michael | |
| 8,405,479 | B1 * | 3/2013 | Cleveland | H01F 7/0273 335/302 |
| 8,917,154 | B2 | 12/2014 | Fullerton et al. | |
| 8,937,521 | B2 | 1/2015 | Fullerton et al. | |
| 9,024,487 | B1 | 5/2015 | Reif | |
| 9,093,207 | B2 | 7/2015 | Fullerton et al. | |
| 9,111,672 | B2 | 8/2015 | Fullerton et al. | |
| 9,245,677 | B2 | 1/2016 | Fullerton et al. | |
| 9,502,166 | B2 | 11/2016 | Jeong et al. | |
| 9,818,522 | B2 | 11/2017 | Kocijan | |
| 10,031,559 | B1 | 7/2018 | Hamel et al. | |
| 2004/0239460 | A1 | 12/2004 | Kocijan | |
| 2007/0029889 | A1 | 2/2007 | Dunn et al. | |
| 2010/0281933 | A1 | 11/2010 | Barrieau | |
| 2011/0248806 | A1 | 10/2011 | Michael | |
| 2014/0320248 | A1 | 10/2014 | Fullerton et al. | |
| 2016/0289046 | A1 | 10/2016 | Norton et al. | |
| 2018/0233856 | A1 | 8/2018 | Brandwijk | |
| 2019/0152544 | A1 | 5/2019 | Outa | |
| 2019/0293232 | A1 | 9/2019 | Franklin | |
| 2020/0036238 | A1 | 1/2020 | Copelamd, Jr. et al. | |
| 2020/0306969 | A1 | 10/2020 | Bryner et al. | |
| 2020/0321393 | A1 | 10/2020 | Manipatruni et al. | |
| 2021/0023681 | A1 | 1/2021 | Robinson, Jr. et al. | |
| 2021/0031335 | A1 | 2/2021 | Morton et al. | |

FOREIGN PATENT DOCUMENTS

| | | | | |
|---|---|---|---|---|
| EP | 3067258 | B1 | 1/2019 | |
| GB | 1274533 | A | 5/1972 | |
| GB | 2130797 | A | 6/1984 | |
| IN | 201917053528 | A | 2/2020 | |
| WO | 1999038726 | A1 | 8/1999 | |
| WO | 2002058092 | A1 | 7/2002 | |
| WO | 2012053806 | A2 | 4/2012 | |
| WO | WO-2015018335 | A1 * | 2/2015 | H01F 7/021 |
| WO | 2019005034 | A1 | 1/2019 | |
| WO | 2019148159 | A1 | 8/2019 | |
| WO | 2019165228 | A1 | 8/2019 | |
| WO | 2020086791 | A1 | 4/2020 | |
| WO | 2020150719 | A1 | 7/2020 | |
| WO | 2021239235 | A1 | 12/2021 | |

OTHER PUBLICATIONS

ISA/CA—Canadian Intellectual Property Office—Written Opinion of the International Searching Authority, dated Feb. 8, 2022—PCT/CA2021/051465.

"One-Sided Fluxes—A Magnetic Curiosity" by J. C Mallinson, published in IEEE Transactions On Magnetics, vol. Mag-9, No. 4, Dec. 1973.

"Design of Permanent Multipole Magnets with Oriented Rare Earth Cobalt Material" by K. Halbach, published in Nuclear Instruments and Methods, vol. 169.1, p. 1-10, Feb. 1980.

J. Javor, S. Sundaram, C. S. Chen and D. J. Bishop, "A Microtissue Platform to Simultaneously Actuate and Detect Mechanical Forces via Non-Contact Magnetic Approach," in Journal of Microelectromechanical Systems, vol. 30, No. 1, pp. 96-104, Feb. 2021.

* cited by examiner

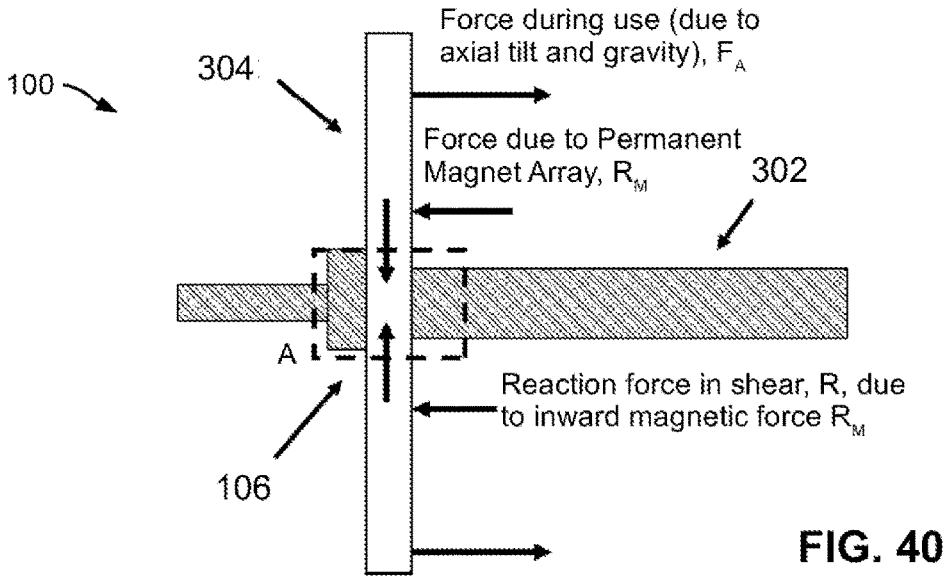
FIG. 40
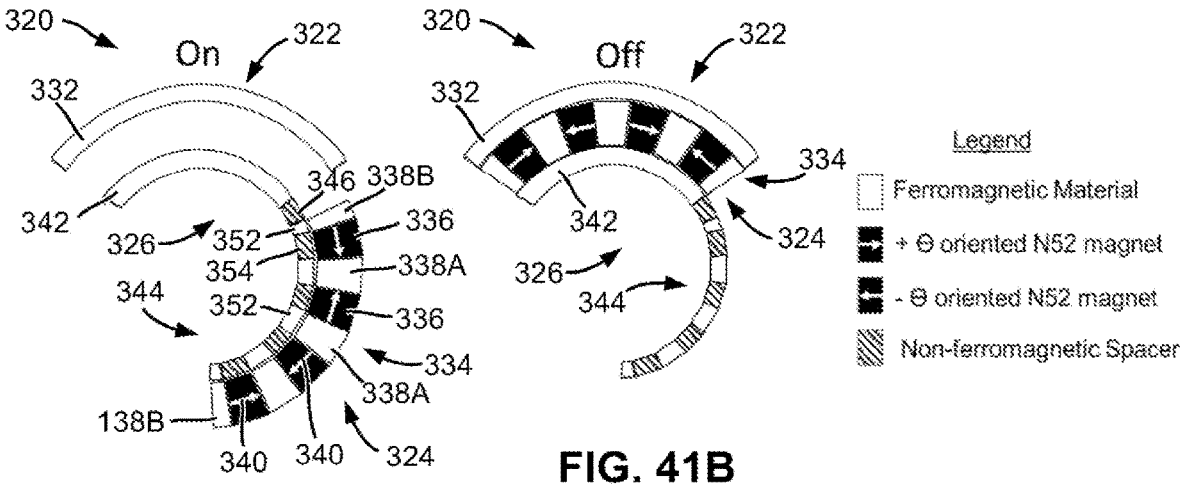
FIG. 41A
FIG. 41B

METHODS FOR GENERATING DIRECTIONAL MAGNETIC FIELDS AND MAGNETIC APPARATUSES THEREOF

CROSS-REFERENCE TO RELATED APPLICATIONS

This application claims the benefit of U.S. Provisional Patent Application Serial Nos. 63/121,069, filed Dec. 3, 2020, 63/133,524, filed Jan. 4, 2021, 63/151,290, filed Feb. 19, 2021, and 63/151,419, filed Feb. 19, 2021, the content of each of which is incorporated herein by reference in its entirety.

FIELD OF THE DISCLOSURE

The present disclosure relates generally to magnetic apparatuses and methods, and in particular to methods for generating directional magnetic fields and magnetic apparatuses thereof.

BACKGROUND

Overview

Magnetic devices with one-sided magnetic flux (or simply "flux") or magnetic fields have evolved from a curiosity in work by John C. Mallinson in 1973 and Klaus Halbach in 1980 to scientific and practical technologies in the mid 1980's. One-sided flux is achieved by an arrangement of magnets such that the magnetic flux on one side thereof is enhanced and on the opposite side is nearly canceled. In a series of magnets extending along an axis, the magnetization vector rotates 90° (in the same plane) with each successive magnet. The interaction of the magnet array produces the one-sided flux.

Klaus Halbach applied this technology and invented the so-called "Halbach array" to enhance the intensity of synchrotron light, enabling revolutionary research into the structure of materials. Halbach arrays have been widely used in related technologies to improve performances and efficiencies thereof. For example, magnetic levitation trains use Halbach arrays to drastically reduce friction and increase speed. Brushless alternating-current motors leverage a ring-shaped Halbach array to increase torque and efficiency. Magnetic holding devices use one-sided flux technologies to increase holding force between the magnet array and a ferromagnetic target.

The Halbach array and similar variations may be realized by the arrangement of electromagnets (EMs) or permanent magnets (PMs) of many shapes and sizes. While EMs offer complete switchability (that is, the capability to switch the flux on and off), they are difficult or even impractical to provide high flux strengths due to Joule heating from high currents. On the other hand, while PMs may be difficult to provide satisfactory switchability, they usually offer much higher flux strengths compared to EMs. Moreover, the flux strength of PMs have been greatly enhanced over the last century, for example, by using technologies where powdered rare-earth materials are sintered and magnetized by a large magnetic field.

A typical drawback to PM technology is the stray magnetic fields that are left to interact with other objects. In consumer appliances, this may create unwanted events such as demagnetization of credit cards or malfunction of computer electronics. In larger PM devices, such as nondestructive testing "yokes" for finding defects in ferromagnetic materials, magnetic latches, switches, bases and apparatuses, strong magnetic fields may be dangerous in their forceful attraction of nearby objects with ferromagnetic materials. The ability to turn on/off or control these magnetic fields is therefore critical for the commercialization of many PM products.

Moreover, the ability to dynamically switch the magnetic field of a one-sided flux device is also desirable. For example, magnetic resonance imaging (MRI) depends on the fast switching of a strong magnetic field, which is used to "kick" and detect the fluctuations of tiny dipoles in the human body for the purposes of biomedical imaging. In prior art, such fast switching of strong magnetic field is implemented using electromagnets, which requires large, power-intensive coils often seen in the basements of hospitals. Clearly, a strong, switchable PM array would be poised to increase the efficiency, portability, safety, and usability of MRI technology.

Turning off PM arrays with one-sided flux has been accomplished using a basic "shunting" method, where a ferromagnetic material is placed on the side of the device with a PM array emanating flux to capture the magnetic fields formed by the PM array thereby reducing the magnetic activity of the device. While effective at deactivating the device, a very large force is usually required to remove the shunting material. Therefore, safety is only improved in the deactivated state, and one is required to design elaborate mechanics to handle the high forces between the device and the shunting material.

Another approach to turn off a PM array is to place a thick piece of non-ferromagnetic material, such as aluminum, on the side of the device emanating flux. This is used effectively as a spacer to prevent the magnetic flux from reaching any ferromagnetic materials, as field strengths decay with distance and a spacer limits proximity of ferromagnetic objects. However, for many applications, the spacer must be several times larger than the PM devices, resulting in a bulky, cumbersome apparatus that is not suited for many applications.

PM arrays may also be switched via the clever arrangement of PMs, such that the movement or rotation of certain elements turns the magnetic field off. Such devices have demonstrated great utility for magnetic holding devices with the ability to hold a target and then to release the target upon the flip of a switch. However, such devices require a compromise in strength and are often much less efficient than the Halbach array or one-sided flux devices.

Given the wide range of applications of magnetic devices (for example, from automotive to biomedical devices), there is a desire for a novel technology to form directional magnetic fields and/or a novel technology for fast switching the directional magnetic fields on and off.

General Concepts and Prior-Art References

The general understanding of several magnetic concepts is pertinent to this disclosure. Electricity and magnetism are inherently intertwined, and the field of electromagnetism is largely unified by Maxwell's Equations, originally published in 1861. Generally, electricity can produce a magnetic field and vice versa. Magnetism itself may be simplified into three states: north, south, or null, where null represents a field strength that is too weak to be noticed in a given application (typically less than Earth's field, or 100 microTesla). North (N) and south (S) are often referred to as poles, much like that of the Earth's. All magnets are dipoles comprising a N and S pole, where magnetic fields flow from N to S. Hereinafter, the polarity of a magnet may be defined as the direction from a first pole to a second pole thereof (for example, from S to N). Opposite poles of a plurality of magnets (that is, N to S and S to N) attract each other, and like poles (that is, N to N and S to S) repel each other.

While electricity and magnetism are intertwined, there are also key distinctions in each area. Magnetism generated by electricity is typically a temporary magnetism. For example, driving a current through a wire generates a magnetic field, but negligible current in the wire results in a null field. Another variety of magnetism, called permanent magnetism, involves the combination and treatment of specific materials to generate magnetic fields. Here, the magnetic fields are relatively permanent and do not require constant energy input to generate a magnetic field, such as with electromagnets. The particularly strong and commercially available permanent magnets include elements from the Lanthanide series of the periodic table of elements. Powdered magnetic material is combined, sintered, and subjected to a large magnetic field (typically above one (1) Tesla), which aligns microscopic regions of the material such that the entire volume is dominantly polarized in the same direction, thereby forming a N pole and a S pole.

As discussed earlier and for many devices, there is often great utility in the ability to switch a magnetic field on or off. This may be for the purposes of safety in the case of large magnetic fields, the purpose of convenience in many consumer devices, or for the purpose of device function such as with fast switching radio frequency coils. Switchable magnetic devices may be generally categorized into three main categories: electromagnetic devices, permanent magnetic devices, and combinations thereof.

An electromagnetic switch usually comprises an electromagnet formed by a conductive coil and a ferromagnetic component. The electromagnetic switch is activated or "turned on" by driving an electrical current through the conductive coil to generate a magnetic field. This interaction is essentially described by Faraday's Law of induction, dating back to 1831 (and included in Maxwell's Laws mentioned earlier). The electromagnet may be easily deactivated or "turned off" by the removal of the electric current. Furthermore, the polarity of the magnetic field may be reversed by driving an electric current in the opposite (negative) direction. An example of an electromagnetic switch is given by a securing door latch, as described in U.S. Pat. Publ. No. 2010/0281933 to Barrieau.

A PM switch typically comprises a plurality of individual magnets or repeating core elements. Given that individual elements of a PM material may be readily fabricated at a wide range of dimensional scale, there are many applications leveraging the arrangement and assembly of magnets to perform specific functions. For example, a magnetic latch or locking system might simply leverage the attraction of a N and S pole of a plurality of magnets, such as taught by U.S. Pat. No. 7,942,458 to Patterson. A switchable magnetic holding device may be designed such that magnets in one configuration interact to produce a field, and, in another configuration, interact to reduce a field. Many examples, dating back to 1939, are given in the patent literature, for example, U.S. Publ. No. 2016/0289046 to Norton et al, U.S. Pat. No. 8,350,663 to Michael, U.S. Pat. No. 9,111,672 to Fullerton et al, U.S. Pat. No. 2,287,286 to Bing et al, and U.S. Pat. No. 7,161,451 to Shen. A magnetic switch may also comprise a combination of electromagnetic and PM technologies such as taught by U.S. Pat. No. 10,031,559.

As described above, one-sided flux arrays are an effective method for enhancing the flux of one side of a permanent array, while greatly reducing the flux on the opposite side of the array. For example, FIG. 1 shows a Halbach array 10 (also see academic paper "One-Sided Fluxes—A Magnetic Curiosity" by J. C. Mallinson, published in IEEE Transactions On Magnetics, vol. Mag-9, No. 4, December 1973) which produces an interaction between individual magnetic elements and achieves one-sided flux. The magnetic vector is rotated in a plane and a linear array of magnetic elements is extruded along an axis of that plane (from M1 to M5).

In an intuitive sense, the magnetic elements M3 and M5 with vectors aligned on the axis of extrusion act to "squeeze" the magnetic flux out of the magnetic elements that are perpendicular to the axis of extrusion M4. Conversely, an opposite "flux pulling" interaction takes place to cancel the magnetic field on the other side of the array. Magnetic elements M1 and M3 "pull" the flux away from M2, despite its otherwise natural projection of flux away from the magnet array. This dual action of "squeezing" and "flux pulling" in a repeating extrusion of the array has created immense utility for many applications of magnetic fields and forces. Some examples are the integration into fast-accelerating "maglev" train tracks in U.S. Pat. No. 6,758,146 to Post, electromagnetic motor/generators in U.S. Pub. 2007/0029889 to Dunn et al., passive magnetic bearings in U.S. Pat. No. 6,344,344 to Post, and hydraulic pumps in U.S. Pat. No. 6,846,168 to Davis et al.

The original one-sided flux device, or Halbach array, has been instrumental in many other discoveries and designs as well. A dual Halbach array can be assembled to form a synchrotron insertion device, called a "wiggler," which oscillates an electron beam passing through it (described in academic paper "Design of Permanent Multipole Magnets with Oriented Rare Earth Cobalt Material" by K. Halbach, published in Nuclear Instruments and Methods, vol. 169.1, p. 1-10, February 1980, and described in U.S. Pat. No. 9,502,166 to Y. U. Jeong, et al). While the common Halbach array is one of the strongest and most volume-efficient designs for production of magnetic flux, other enhanced designs have been explored. Higher order Halbach arrays such as the "hyper Halbach array" is described in U.S. Pat. No. 8,009,001 to M. Cleveland. The hyper Halbach array produces a roughly 25% enhancement in magnetic flux as compared to the common Halbach array, and over 50% enhancement as compared to a single magnet.

SUMMARY

According to one aspect of this disclosure, there is provided a magnetic apparatus. The magnetic apparatus comprises: a front layer comprising one or more front-layer magnets in an alternating polarity arrangement, such that the polarities of the front-layer magnets are along a direction of the front-layer plane, where each of the one or more magnets is sandwiched by two of a plurality of ferromagnetic components; a rear layer comprising one or more rear-layer magnets arranged in an alternating polarity arrangement, such that the polarities of the magnets are perpendicular to the rear-layer plane, where each of the rear-layer magnets is sandwiched by a non-ferromagnetic component such as air gap; and a manipulating means for changing any arrangement of the magnet polarities to switch the magnetic apparatus between an ON state and an OFF state. In both the ON and the OFF state, some or all of the magnets in the rear layer overlaps with some or all of the ferromagnetic components in the front layer. In the ON state, the poles of all magnets at the interface of a ferromagnetic component are the same, and therefore are in opposition since similar poles repel. In this configuration, magnetic flux leaving the magnets in the front layer is pushed away therefrom by the magnets in the rear layer and towards the work-piece. In the OFF state, the poles of the magnets in the rear layer are opposite to poles of the magnets in the front layer at an interface of a ferromagnetic component. In this configuration, magnetic flux leaving the magnets in the front layer is pulled into the magnet in the rear layer, and away from a work-piece. The manipulating means to switch the device between ON and OFF may be an actuator system that positions the magnets, a stationary rotation of magnets, or a change in direction of current in embodiments where the magnets are electromagnets.

In some embodiments, the plurality of magnets and the plurality of ferromagnetic components of the front layer are arranged into a circle; and the one or more magnets of the rear layer are arranged into a concentric circle.

In some embodiments, the one or more magnets and the plurality of ferromagnetic components of the front layer are arranged into an arm; and the one or more magnets of the rear layer are arranged into an arm.

In some embodiments, the one or more magnets and the plurality of ferromagnetic components of the front layer are arranged into an array; and the one or more magnets of the rear layer are arranged into an array.

In some embodiments, the one or more front-layer magnets and the plurality of ferromagnetic components of the front layer is an inner ring that is in the same plane as the rear layer which is an outer ring. In this embodiment, the magnetic flux from the front-layer magnets is pushed towards the shared rings' center when ON and pulled radially outward when OFF.

In some embodiments, the one or more magnets and the plurality of ferromagnetic components of the front layer is an outer ring that is in the same plane as the rear layer which is an inner ring. In this embodiment, the magnetic flux from the front-layer magnets is pulled towards the shared rings' center when OFF and pushed radially outward when ON.

In some embodiments, there may be two or more pairs of front and rear layers. There may be different numbers of front layers and rear layers. This may be applied to each embodiment layout (circular, arms, linear arrays, and concentric layouts).

In some embodiments, a ferromagnetic layer such as a steel plate may be coupled to the rearmost layer.

In some embodiments, the ferromagnetic layer may comprise extrusions that extend towards the front layer to connect a magnetic circuit between a ferromagnetic component and the rear layer for embodiments where the layout is an arm or linear array that has a ferromagnetic component that is not overlapped by a rear-layer magnet when in the ON and/or OFF position.

In some embodiments, the magnets may be a variety of shapes and sizes with the ferromagnetic components being of suitable shapes to fit the magnets. The rear-layer magnets may be larger compared to the front-layer magnets to have partial overlap between the rear-layer magnets and front-layer magnets when in the ON and OFF positions. The functionality of the device using rear-layer magnets to push flux from the front-layer magnets towards the work-piece when ON or to pull the flux from the front-layer magnets away from the work-piece when OFF is a constant.

In some embodiments of the front and rear plane design, the alternating polarity magnets may follow a path within the plane such as a line, a circle, a curve, or the like. Such a pattern may be used to fit a contour of a work-piece for or avoid a feature on a work-piece, both for increased performance.

According to one aspect of this disclosure, there is provided a magnetic apparatus for generating a directional magnetic field towards a target direction on a first side thereof, the magnetic apparatus comprising: a first layer along a first surface perpendicular to the target direction, the first layer defines thereon a plurality of alternating South and North first-layer poles in a pattern; and a second layer on a second side of the first layer, the second side opposite to the first side, the second layer comprising one or more second-layer magnets interleaved with one or more spacers; the polarity of each of the one or more second-layer magnets are parallel to the target direction, each of the one or more second-layer magnets overlaps one of the plurality of first-layer poles along the target direction; and, in a first state, a pole of each of the one or more second-layer magnets adjacent the corresponding first-layer pole is same as the corresponding first-layer pole.

In some embodiments, the first layer comprises one or more first-layer magnets forming the plurality of first-layer poles; each adjacent pair of the one or more first-layer magnets are adjacent a respective one of the one or more second-layer magnets; an angle $\alpha$ between each first-layer magnet and the adjacent second-layer magnet is within a range of $0°<\alpha<180°$, $30°<\alpha<180°$, $60°<\alpha<180°$, $0°<\alpha<90°$, $30°<\alpha<90°$, $60°<\alpha<90°$, $30°<\alpha<150°$, or $60°<\alpha<120°$; and neighboring poles of each adjacent pair of the one or more first-layer magnets are same poles.

In some embodiments, the first layer comprises one or more first-layer magnets forming the plurality of first-layer poles; and the one or more first-layer magnets are in an end-to-end arrangement with alternating polarities such that for each adjacent pair of the first-layer magnets, a pair of the ends thereof have same poles and are at a distance smaller than that of the other pair of the ends thereof.

In some embodiments, the first layer further comprises one or more ferromagnetic blocks interleaved with the one or more first-layer magnets.

In some embodiments, the spacers are non-ferromagnetic blocks or gaps.

In some embodiments, the spacers are magnetic blocks such that the second-layer magnets and the spacers form a Halbach array.

In some embodiments, the spacers are magnet blocks with polarities aligned with those of the first-layer magnets overlapped therewith.

In some embodiments, in a second state, the pole of each of the one or more second-layer magnets adjacent the corresponding first-layer pole is opposite to the corresponding first-layer pole.

In some embodiments, the first and second layers are movable with respect to each other for switching between the first and second states.

In some embodiments, the second layer or each of the one or more second-layer magnets thereof is rotatable about an axis parallel to the first layer for switching between the first and second states.

In some embodiments, each of the one or more first-layer magnets is rotatable about an axis parallel to the target direction for switching between the first and second states.

In some embodiments, the first surface is a plane or a curved surface.

In some embodiments, the first and second layers are discs.

In some embodiments, the first surface is a plane; and wherein the first-layer poles are arranged in a linear array or a matrix form.

In some embodiments, the first surface is a plane; and wherein the first-layer poles are arranged in a circular pattern.

In some embodiments, the first surface is at least a portion of a ring surface, a cylindrical surface, and/or a spherical surface.

In some embodiments, the target direction is a radially inward direction or a radially outward direction.

In some embodiments, the first and second sides are respectively an outer side and an inner side of the first layer, or the first and second sides are respectively the inner side and the outer side of the first layer.

In some embodiments, the magnetic apparatus comprises a plurality of the first layers and the second layers interleaved with each other.

In some embodiments, the magnetic apparatus further comprises: a ferromagnetic layer coupled to the second side of a layer furthest to the first layer.

In some embodiments, the magnetic apparatus further comprises: a ferromagnetic layer coupled to at least one of the first side of the first layer and the second side of the second layer.

In some embodiments, the ferromagnetic layer is integrated with the first-layer ferromagnetic blocks.

In some embodiments, the magnetic apparatus further comprises: a third layer on the second side of the second layer for generating another directional magnetic field on the second side thereof, the third layer defines thereon a plurality of alternating South and North third-layer poles in a pattern, the third-layer poles in a same or reversed manner of the first-layer poles.

In some embodiments, the first and third layers are at an obtuse angle with respect to the second layer.

In some embodiments, the angle of the first and third layers is adjustable.

In some embodiments, the first-layer magnets are partially buried in the second layer.

According to one aspect of this disclosure, there is provided a magnetic apparatus for generating a directional magnetic field towards a target direction on a first side thereof, the magnetic apparatus comprising: a first layer along a first surface perpendicular to the target direction, the first layer comprising one or more first-layer magnets interleaved with one or more first-layer ferromagnetic blocks; and a second layer on a second side opposite to the first side, the second layer comprising one or more second-layer magnets interleaved with one or more spacers; a total number of the one or more first-layer magnets and the one or more second-layer magnets is greater than or equal to three, and a total number of the one or more first-layer magnets and the one or more first-layer ferromagnetic blocks is greater than or equal to three; the one or more first-layer magnets are in an end-to-end arrangement on the first plane with alternating polarities along the first plane such that for each adjacent pair of the first-layer magnets, a pair of the ends thereof have a same pole and are at a distance smaller than that of the other pair of the ends thereof; the one or more second-layer magnets are in a side-by-side arrangement with the polarities thereof parallel to the target direction, each of the one or more second-layer magnets overlaps one of a set of first ferromagnetic blocks of the one or more first-layer ferromagnetic blocks along the target direction, and each of the one or more spacers overlaps one of the one or more first-layer magnets; and, in a first state, for each of the set of first ferromagnetic blocks, a pole of the adjacent second-layer magnet adjacent thereto is same as pole or poles of the adjacent first-layer magnet(s) adjacent thereto.

In some embodiments, the spacers are non-ferromagnetic blocks or gaps.

In some embodiments, the spacers are magnetic blocks such that the second-layer magnets and the spacers form a Halbach array.

In some embodiments, the spacers are magnet blocks with polarities aligned with those of the first-layer magnets overlapped therewith.

In some embodiments, in a second state, for each of the set of first ferromagnetic blocks, the pole of the adjacent second-layer magnet adjacent thereto is opposite to the pole or poles of the adjacent first-layer magnet(s) adjacent thereto.

In some embodiments, the first and second layers are movable with respect to each other for switching between the first and second states.

In some embodiments, the second layer or each of the one or more second-layer magnets thereof is rotatable about an axis parallel to the first layer for switching between the first and second states.

In some embodiments, each of the one or more first-layer magnets is rotatable about an axis parallel to the target direction for switching between the first and second states.

In some embodiments, the first surface is a plane or a curved surface.

In some embodiments, the first surface is a plane; and wherein the first-layer magnets and the first-layer ferromagnetic blocks are arranged in a linear array or a matrix form.

In some embodiments, the first surface is a plane; and wherein the first-layer magnets and the first-layer ferromagnetic blocks are arranged in a circular pattern.

In some embodiments, the first surface is at least a portion of a cylindrical surface or at least a portion of a spherical surface.

In some embodiments, the first and second sides are respectively an outer side and an inner side of the first layer, or the first and second sides are respectively the inner side and the outer side of the first layer.

In some embodiments, the magnetic apparatus comprises a plurality of the first layers and the second layers interleaved with each other.

In some embodiments, the magnetic apparatus further comprises: a ferromagnetic layer coupled to the second side of a layer furthest to the first layer.

In some embodiments, the magnetic apparatus further comprises: a ferromagnetic layer coupled to the first side of the first layer.

In some embodiments, the ferromagnetic layer is integrated with the first-layer ferromagnetic blocks.

In some embodiments, the magnetic apparatus further comprises: a third layer on the second side of the second layer for generating another directional magnetic field on the second side thereof, the third layer comprising one or more third-layer magnets interleaved with one or more third-layer ferromagnetic blocks, the polarities of the third-layer magnets in a same or reversed manner of those of the first-layer magnets.

In some embodiments, the first and third layers are at an obtuse angle with respect to the second layer.

In some embodiments, the angle of the first and third layers is adjustable.

In some embodiments, the first-layer magnets are partially buried in the second layer.

According to one aspect of this disclosure, there is provided a switchable magnetic apparatus comprising: a front layer comprising a plurality of front-layer magnets arranged in alternating polarities in a linear array, the alternating polarities along a direction of a plane of the front layer, each adjacent pair of magnets along the direction; a plurality of non-ferromagnetic zones, each non-ferromagnetic zone adjacent four front-layer magnets; a rear layer comprising a plurality of rear-layer magnets arranged in alternating polarities, the alternating polarities along a direction perpendicular to the plane; and an actuator for moving one or both of the front layer and the rear layer; each of the plurality of ferromagnetic components faces a subset of the front-layer magnets and a subset of rear-layer magnets; when the switchable magnetic apparatus is in an ON state, each of the plurality of ferromagnetic components faces same poles of a first subset of the front-layer magnets and a first subset of the rear-layer magnets; and when the switchable magnetic apparatus is in an OFF state, each of the plurality of ferromagnetic components faces a first type of poles of a second subset of the front-layer magnets and a second type of poles of a second subset of the rear-layer magnets, the first type of poles being opposite to the second type of poles.

According to one aspect of this disclosure, there is provided a fitness apparatus comprising: a base structure; and one or more weights; the base structure comprises a ferromagnetic component and each of the one or more weights comprises a magnetic component for engaging the ferromagnetic component to releasably coupling the weight to the base structure; or the base structure comprises a magnetic component and each of the one or more weights comprises a ferromagnetic component for engaging the magnetic component to releasably coupling the weight to the base structure.

In some embodiments, the magnetic component is the magnetic apparatus described above.

In some embodiments, the magnetic component comprises: a first ring layer; a second ring layer; a third ring layer; and an actuator for causing relative movement between the second ring layer and the first and third rings layers for switching the magnetic apparatus between an ON state and an OFF state; the first, second, and third ring layers are coaxially arranged with the second ring layer sandwiched between the first and the third ring layers; the first ring layer comprises one or more first ferromagnetic switch-off areas and one or more switch-on areas, each of the one or more switch-on areas comprising a plurality of ferromagnetic zones separated by one or more non-ferromagnetic zones; the second ring layer comprises a plurality of magnets arranged in alternating polarities along a direction on a plane of the middle layer, each adjacent pair of the plurality of magnets along the direction sandwiching one of one or more ferromagnetic blocks; the third ring layer comprises one or more second ferromagnetic switch-off areas; when the magnetic apparatus is at the OFF state, each of the first and second ferromagnetic switch-off areas of the first and third ring layers overlaps two or more of the plurality of magnets; and when the magnetic apparatus is at the ON state, each of the plurality of non-ferromagnetic zones of the one or more switch-on areas overlaps one of the plurality of magnets and each of the one or more of ferromagnetic zones of the one or more switch-on areas overlaps According to one aspect of this disclosure, there is provided a rollable apparatus for controllably engaging a ferromagnetic work-piece and rolling thereon, the switchable magnetic apparatus comprising: at least one magnetic component for applying a magnetic force to the ferromagnetic work-piece; and a roller assembly for linear translation of the magnetic apparatus with respect to the work-piece.

In some embodiments, the rollable apparatus further comprises: a magnet-actuation structure for switching the magnetic apparatus between an ON state for applying the magnetic force to the work-piece and an OFF state for removing the magnetic force from the work-piece.

In some embodiments, the rollable apparatus further comprises: an adjustment structure for adjusting the magnetic force applicable to the work-piece.

In some embodiments, the roller assembly comprises a plurality of rollers, each roller comprising one of the at least one magnetic component; and the adjustment structure comprises a plurality of roller holders for selectively and releasably coupling one or more of the plurality of rollers for adjusting the magnetic force applicable to the work-piece and/or the distribution of the magnetic force applicable to the work-piece.

In some embodiments, the adjustment structure comprises a structure for adjusting the distance between the at least one magnetic component and the work-piece for adjusting the magnetic force applied to the work-piece.

In some embodiments, the roller assembly comprises a plurality of rollers of a plurality of sizes; and the adjustment structure comprises a plurality of roller holders for releasably coupling one or more of the plurality of rollers of selected sizes for adjusting the distance between the at least one magnetic component and the work-piece for adjusting the magnetic force applied to the work-piece.

In some embodiments, the magnetic device is the magnetic apparatus described above.

In some embodiments, the adjustment structure comprises one or more ferromagnetic adjustment layers for coupling to a front side of the at least one magnetic component between the at least one magnetic component and the work-piece for adjusting the magnetic force applied to the work-piece.

In some embodiments, the one or more ferromagnetic adjustment layers comprise a plurality of ferromagnetic layers of different thicknesses.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

FIG. 40 is a cross-sectional view of a portion of the bar-weight assembly shown in FIG. 38A about a point of securement thereof;

FIG. 41A is a schematic cross-sectional view of the switchable magnetic device shown in FIG. 39, wherein the switchable magnetic device is in an ON state;

FIG. 41B is a schematic cross-sectional view of the switchable magnetic device shown in FIG. 39, wherein the switchable magnetic device is in an OFF state;

DETAILED DESCRIPTION

Embodiments of the present disclosure will now be described with reference to FIG. 2A through FIG. 57, which show non-limiting embodiments of a switchable magnetic apparatus of the present disclosure. Those skilled in the art will appreciate that different features of various embodiments described in this disclosure may be combined. Herein, a magnet or a magnetic component refers to a component that generates a magnetic field. A ferromagnetic component refers to a component that itself does not generate a magnetic field and may be temporarily magnetized by a magnet. A non-ferromagnetic component refers to a component that cannot be magnetized.

Figure 1:
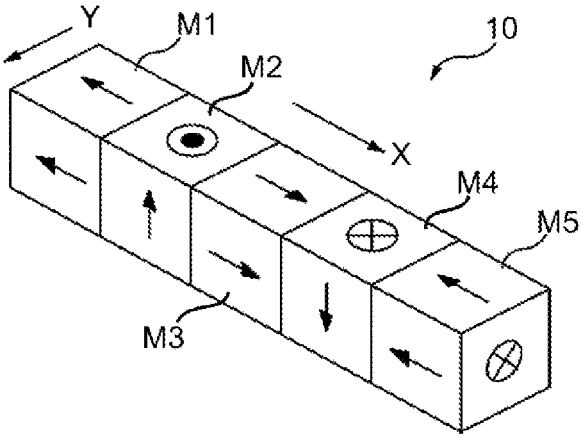
FIG. 1 (Prior Art)
FIG. 1 shows a prior-art magnetic apparatus.
Figure 2A:
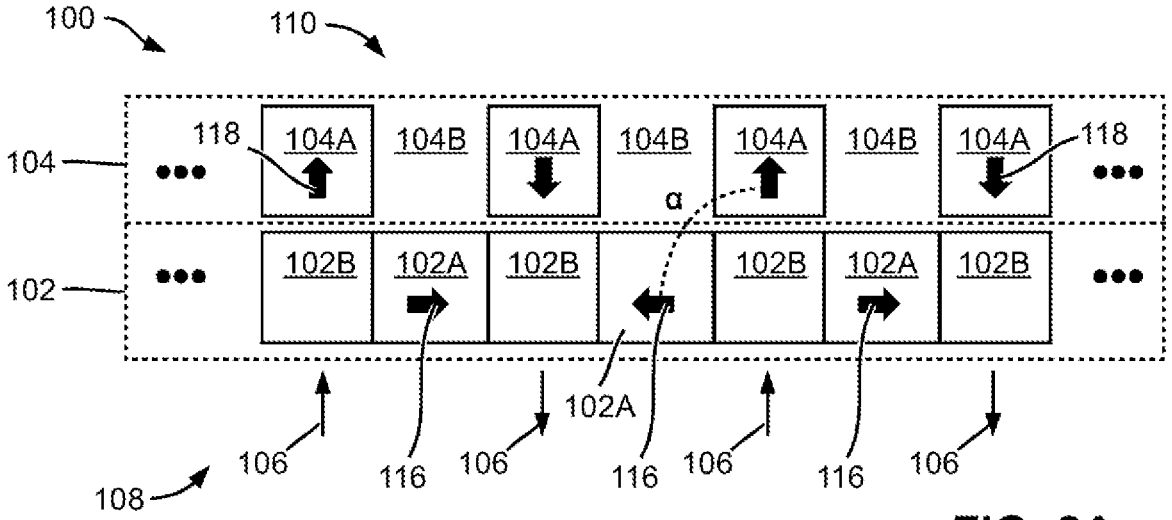
FIGS. 2A and 2B are schematic side views of a portion of an exemplary switchable magnetic apparatus according to some embodiments of the present disclosure, wherein the switchable magnetic apparatus comprises a front layer and a rear layer, and wherein the switchable magnetic apparatus is in an ON state in FIG. 2A and is in an OFF state in FIG. 2B.
Figure 2B:
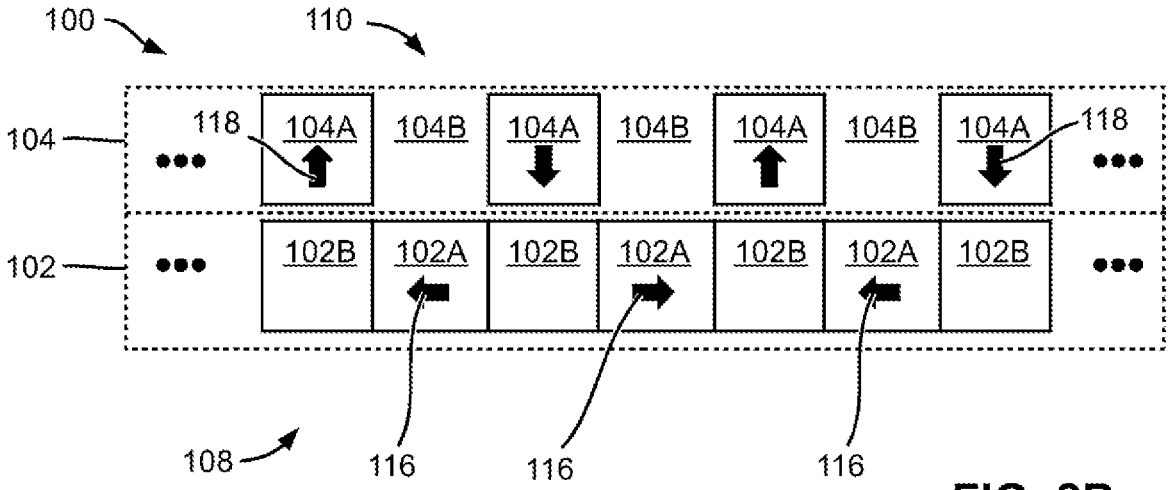

FIGS. 2A and 2B are side views of a switchable magnetic apparatus 100 according to some embodiments of the present disclosure. The switchable magnetic apparatus 100 may be configured to an ON state (FIG. 2A) in which the switchable magnetic apparatus 100 generates or activates a directional magnetic field along a target direction 106 on a target side 108 thereof (which in these embodiments is the front side of the switchable magnetic apparatus 100), and an OFF state (FIG. 2B) in which the switchable magnetic apparatus 100 removes or deactivates the directional magnetic field at least at the target side 108 thereof.

Figure 3:
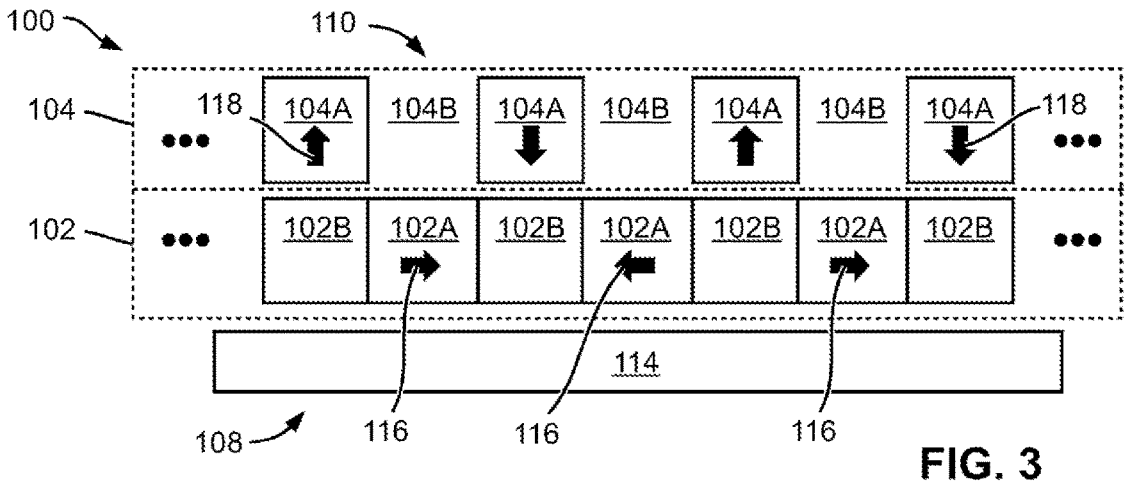
FIG. 3 is a schematic side view of the portion of the switchable magnetic apparatus shown in FIGS. 2A and 2B, wherein the switchable magnetic apparatus is used for attracting a work-piece.

For example, as shown in FIG. 3, the switchable magnetic apparatus 100 may be switched to the ON state to generate a directional magnetic field for applying an attractive magnetic force to a ferromagnetic or magnetic object or work-piece 114 at the target side 108 thereof, for example, for picking and moving the work-piece 114, and may be switched to the OFF state (not shown) to remove the directional magnetic field for releasing the work-piece 114. Herein, the ferromagnetic or magnetic object or work-piece 114 refers to an object or work-piece that comprises one or more suitable ferromagnetic or magnetic materials and may optionally comprise one or more non-ferromagnetic materials.

Referring again to FIGS. 2A and 2B, the switchable magnetic apparatus 100 comprises a front layer 102 and a rear layer 104 on the rear side 110 of the front layer 102 and in contact or in close proximity therewith. As will be described in more detail below, the front and rear layers 102 and 104 comprise a plurality of magnets and may further comprise one or more ferromagnetic flux guides. As those skilled in the art will appreciate, the magnets disclosed herein may be made of any suitable magnetic materials. For example, in some embodiments, the magnets disclosed herein may be N52-grade magnets with rectangular cross-sections. In some other embodiments, the magnets disclosed herein may comprise other permanent magnet materials such as NdFeB, NiCo, and/or the like. In some other embodiments, the magnets disclosed herein may be electromagnets.

The one or more ferromagnetic flux guides may be made of any suitable ferromagnetic material such as steel.

Those skilled in the art will also appreciate that, in the switchable magnetic apparatus 100, the neighboring magnets and the neighboring magnets and ferromagnetic flux guides are preferably in contact with each other or in close proximity with each other for preventing significant loss of magnetic flux.

The front layer 102 is perpendicular to the target direction 106 and comprises one or more front-layer magnets 102A in an end-to-end arrangement and spaced by or interleaved with a plurality of ferromagnetic flux guides 102B (also denoted "ferromagnetic blocks" without referring specific shapes thereof). Herein, the end-to-end arrangement means that for each adjacent pair of the front-layer magnets 102A, a pair of the ends or poles thereof are adjacent to each other and are at a distance smaller than that of the other pair of the ends or poles thereof.

In these embodiments, the polarities of the front-layer magnets 102A are alternating as indicated by the arrows 116. In other words, the adjacent poles of neighboring front-layer magnets 102A (which sandwich a ferromagnetic block 102B therebetween) are the same pole in both the ON state and the OFF state.

The rear layer 104 comprises a plurality of rear-layer magnets 104A in a side-by-side arrangement (that is, a substantially parallel arrangement) and spaced by or interleaved with one or more non-ferromagnetic blocks or spacers 104B made of any suitable non-ferromagnetic materials such as aluminum, or simply gaps (for example, air gaps or vacuum). The polarities of the rear-layer magnets 104A are substantially parallel to or aligned with the target direction 106 (or perpendicular to the plane of the rear layer 104) and alternating. In other words, adjacent rear-layer magnets 104A (which sandwich a non-ferromagnetic block 104B therebetween) have opposite polarities, as indicated by the arrows 118. Moreover, the angle $\alpha$ between the polarities of each front-layer magnetic structure 102A and the neighboring rear-layer magnet 104A is a suitable angle not equal to 0° or 180°. For example, in the example shown in FIGS. 2A and 2B, the angle $\alpha$ is substantially 90°. In various embodiments, the angle $\alpha$ may be within a range of $0°<\alpha<180°$, $30°<\alpha<180°$, $60°<\alpha<180°$, $0°<\alpha<90°$, $30°<\alpha<90°$, $60°<\alpha<90°$, $30° <\alpha<150°$, or $60°<\alpha<120°$.

In this embodiment, the front-layer magnets 102A, ferromagnetic blocks 102B, rear-layer magnets 104A, and spacers 104B are shown as in cubical shapes. In other embodiments, these components may have other suitable shapes such as spheres, arc segments, cylinders, disks, and/or the like. Moreover, the shapes of these components may be the same or different.

In any of the ON and OFF states, each rear-layer magnet 104A overlaps a ferromagnetic block 102B along the target direction 106, and each non-ferromagnetic block 104B overlaps a front-layer magnet 102A along the target direction 106.

The polarities of each front-layer magnet 102A and the rear-layer magnets 104A adjacent thereof determine the state of the switchable magnetic apparatus 100. As those skilled in the art will appreciate, the magnetic force at the front side of the switchable magnetic apparatus 100 in the OFF state is substantively zero, or non-zero but much smaller than that in the ON state.

As shown in FIG. 2A, the switchable magnetic apparatus 100 is in the ON state when the polarities of each front-layer magnet 102A and the rear-layer magnets 104A adjacent thereof are "opposite" to each other. In other words, the adjacent poles of neighboring front-layer and rear-layer magnets 102A and 104A are the same pole. More specifically, when the switchable magnetic apparatus 100 is in the ON state, each ferromagnetic block 102B is adjacent the same poles (being the S poles or N poles) of the front-layer and rear-layer magnets 102A and 104A. In this arrangement, the rear-layer magnet 104A repels the front-layer magnets 102A thereby forcing the magnetic flux to extend out of the switchable magnetic apparatus 100 along the target direction 106 away from the front layer 102 and towards the target side 108.

As shown in FIG. 2B, the switchable magnetic apparatus 100 is in the OFF state when the polarities of each front-layer magnet 102A and the rear-layer magnets 104A adjacent thereof are "aligned" with each other. In other words, the pole of each rear-layer magnet 104A adjacent the neighboring front-layer magnets 102A is different to the adjacent poles of the neighboring front-layer magnets 102A. More specifically, when the switchable magnetic apparatus 100 is in the OFF state, each ferromagnetic block 102B is adjacent different poles of the neighboring front-layer magnets 102A and the rear-layer magnet 104A (that is, the S poles of the front-layer magnets 102A and the N pole of the rear-layer magnet 104A, or the N poles of the front-layer magnets 102A and the S pole of the rear-layer magnet 104A). In this arrangement, the rear-layer magnet 104A attract the adjacent front-layer magnets 102A, thereby effectively containing the magnetic flux in the switchable magnetic apparatus 100 and with a substantively reduced amount of flux extending out thereof towards the target side 108. In the embodiments where the switchable magnetic apparatus 100 in the ON state is used for attracting a ferromagnetic work-piece 114, when the switchable magnetic apparatus 100 is switched to the OFF state, a substantively reduced magnetic force (or effectively zero magnetic force) is applied to the work-piece 114 such that the work-piece 114 may be released from the switchable magnetic apparatus 100.

As can be seen in FIGS. 2A and 2B, the switchable magnetic apparatus 100, or more specifically the front and rear layers 102 and 104 thereof, may comprise a plurality of interleaved ON positions and OFF positions to configure the switchable magnetic apparatus 100 to the ON and OFF states, respectively.

Although not shown, the switchable magnetic apparatus 100 also comprises a manipulation structure for switching the switchable magnetic apparatus 100 to between the ON and OFF states. For example, in some embodiments, the magnets 102A and/or 104A are electromagnets and the manipulation structure comprises one or more electromagnet controllers for changing the polarities of the magnets 102A and/or 104A by changing the direction of the current thereof.

In some other embodiments, the manipulation structure comprises actuators for moving and/or rotating the magnets 102A and/or 104A to change polarities thereof. The actuation may be conducted on the rear layer 104, the front layer 102, or a combination thereof. The actuation mechanism may include a housing to constrain the stationary magnets 102A/104A while linearly positioning, rotationally positioning, or rotating in position the actuated magnets. The actuation may be powered manually using a mechanical component such as a lever, electrically controlled using a device such as an electric motor, pneumatically controlled, or controlled by a combustion engine.

Figure 4A:
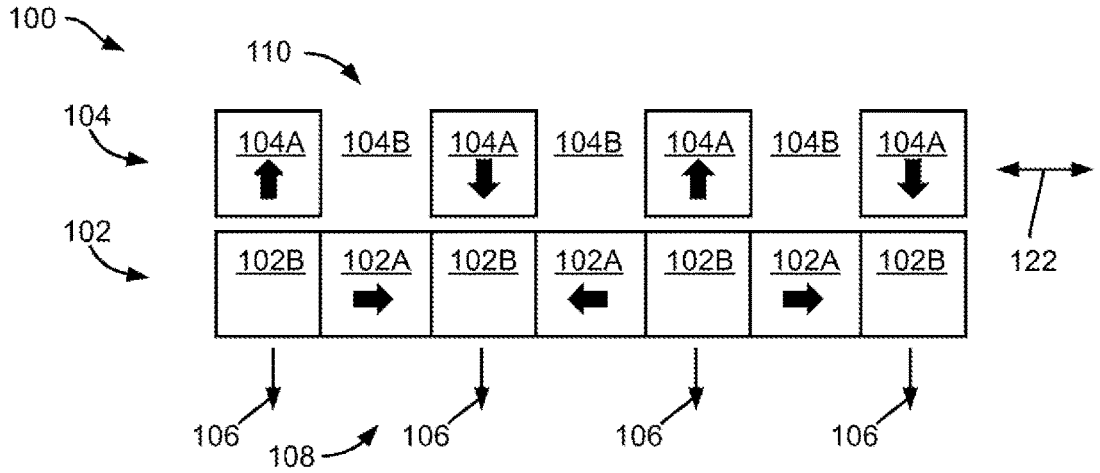
FIGS. 4A and 4B are schematic side views of a switchable magnetic apparatus in an arm layout, according to yet some embodiments of the present disclosure, wherein the switchable magnetic apparatus comprises a front layer and a rear layer, and wherein the switchable magnetic apparatus is in an ON state in FIG. 4A and is switchable to an OFF state in FIG. 4B by moving the rear layer thereof.
Figure 4B:
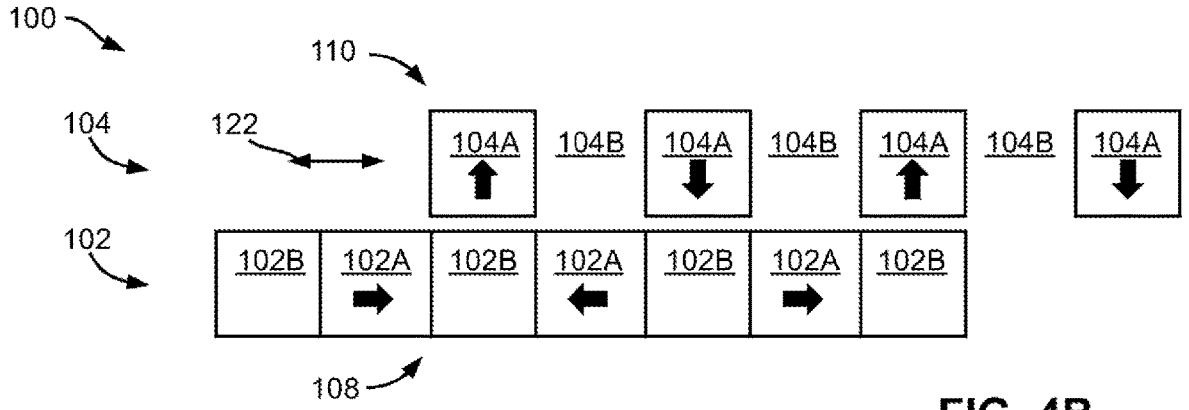

For example, FIG. 4A shows a switchable magnetic apparatus 100 in ON state according to some embodiments of this disclosure, wherein the front layer 102 and rear layer 104 are arranged in the form of arms. As shown in FIG. 4B, the rear layer 104 may be linearly moved as indicated by the arrow 122 to move each rear-layer magnet 104A from its ON position to an adjacent OFF position to configure the switchable magnetic apparatus 100 to the ON state (FIG. 4A) or the OFF state (FIG. 4B).

In the embodiments shown in FIGS. 4A and 4B, there may not be the same number of ferromagnetic blocks 102B as the number of rear-layer magnets 104A to have a rear-layer magnet 104A overlapping every ferromagnetic block 102B or to have a ferromagnetic block 102B overlapping every rear-layer magnet 104A in both the ON and OFF positions.

Figure 5A:
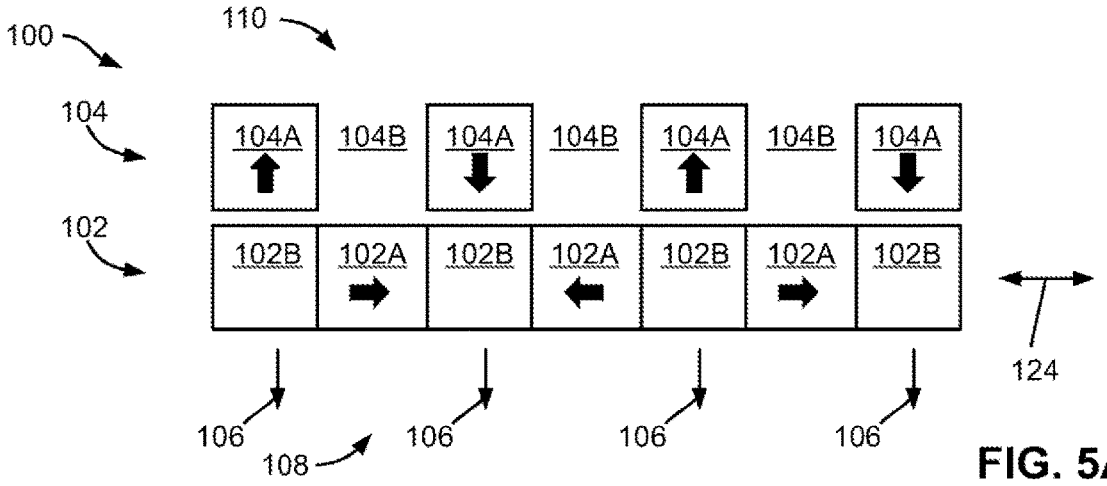
FIGS. 5A and 5B are schematic side views of a switchable magnetic apparatus in an arm layout, according to still some embodiments of the present disclosure, wherein the switchable magnetic apparatus comprises a front layer and a rear layer, and wherein the switchable magnetic apparatus is in an ON state in FIG. 5A and is switchable to an OFF state in FIG. 5B by moving the front layer thereof.
Figure 5B:
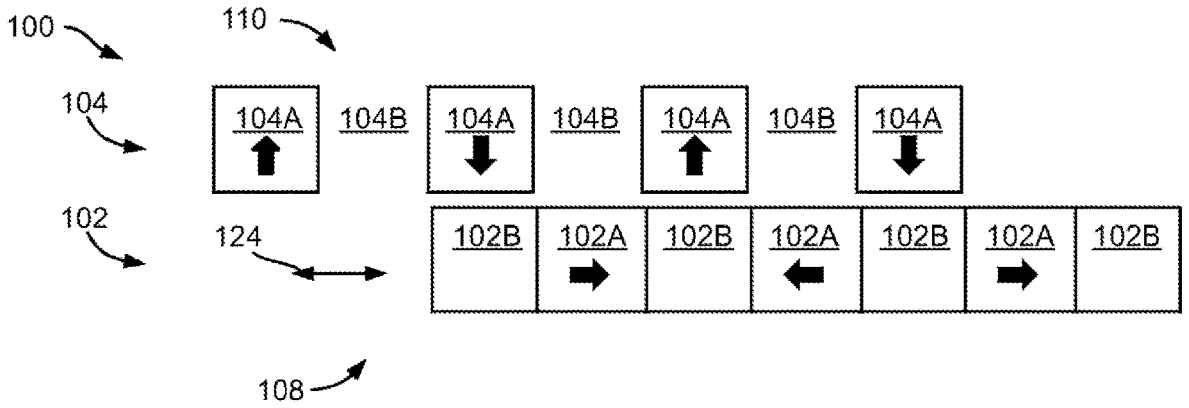

FIGS. 5A and 5B show a switchable magnetic apparatus 100 in some embodiments, wherein the front layer 102 may be linearly moved as indicated by the arrow 124 to configure the switchable magnetic apparatus 100 to the ON state (FIG. 5A) or the OFF state (FIG. 5B).

Figure 6A:
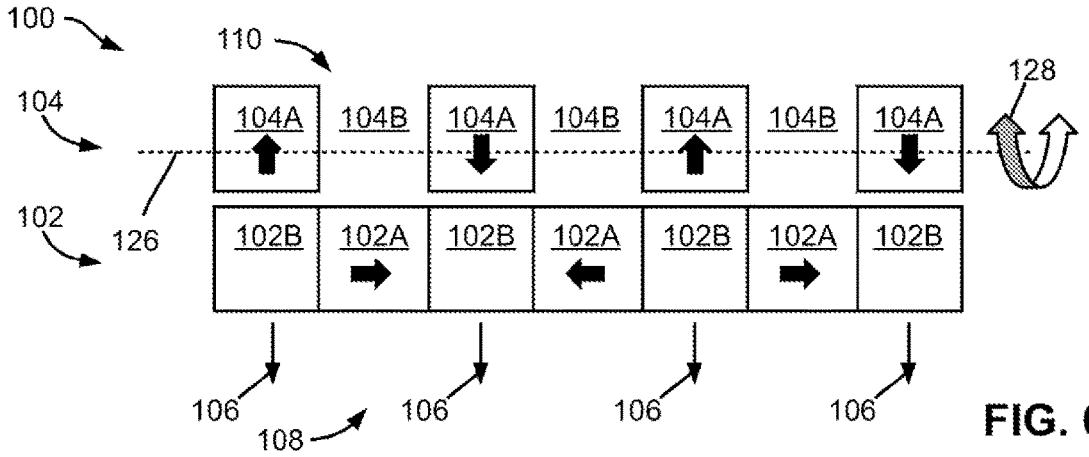
FIGS. 6A and 6B are schematic side views of a switchable magnetic apparatus in an arm layout, according to some embodiments of the present disclosure, wherein the switchable magnetic apparatus comprises a front layer and a rear layer, and wherein the switchable magnetic apparatus is in an ON state in FIG. 6A and is switchable to an OFF state in FIG. 6B by rotating the rear layer thereof.
Figure 6B:
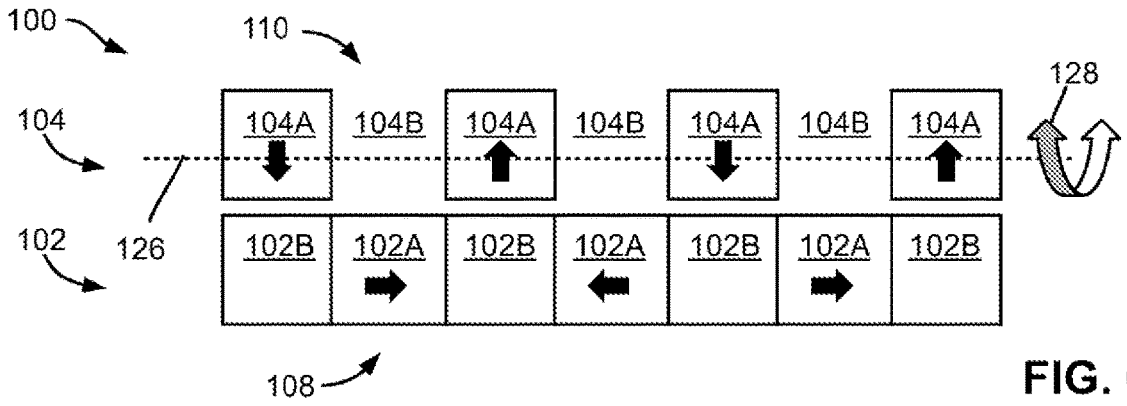

FIGS. 6A and 6B show a switchable magnetic apparatus 100 in some embodiments, wherein the rear layer 104 or each of the rear-layer magnets 104A may be rotated about an axis 126 parallel to the front layer 102 as indicated by the arrow 128 to configure the switchable magnetic apparatus 100 to the ON state (FIG. 6A) or the OFF state (FIG. 6B).

Figure 7A:
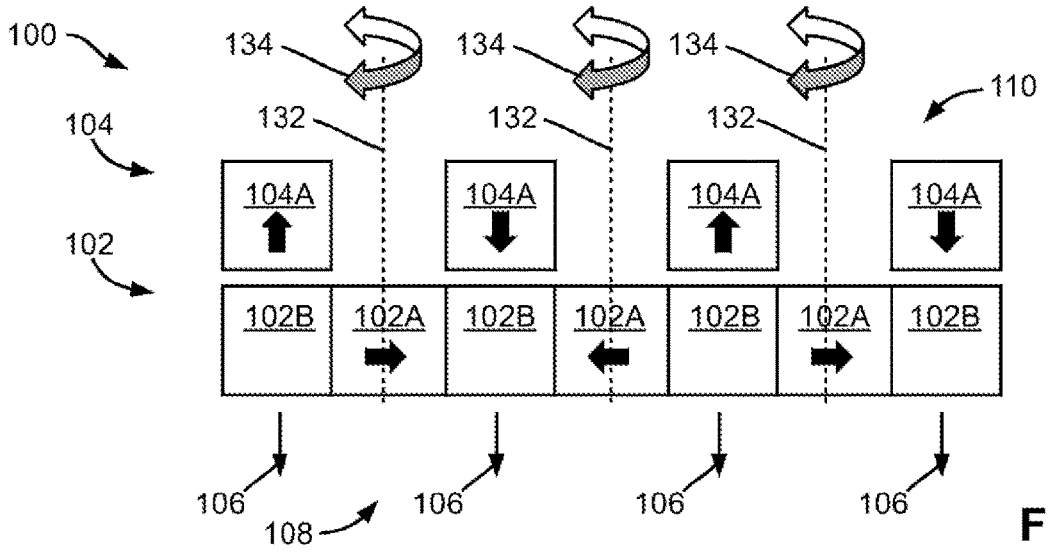
FIGS. 7A and 7B are schematic side views of a switchable magnetic apparatus in an arm layout, according to yet some embodiments of the present disclosure, wherein the switchable magnetic apparatus comprises a front layer and a rear layer, the front layer comprising one or more front-layer magnets interleaved with a plurality of ferromagnetic components, and wherein the switchable magnetic apparatus is in an ON state in FIG. 7A and is switchable to an OFF state in FIG. 7B by rotating the front-layer magnets.
Figure 7B:
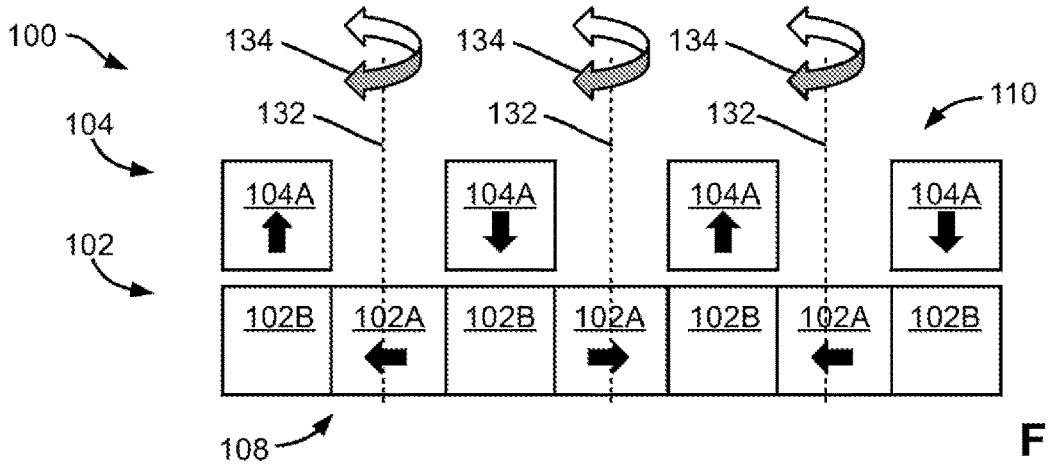

FIGS. 7A and 7B show a switchable magnetic apparatus 100 in some embodiments, wherein the front-layer magnets 102A may be synchronously rotated about respective axes 132 perpendicular to the front layer 102 as indicated by the arrow 134 to configure the switchable magnetic apparatus 100 to the ON state (FIG. 7A) or the OFF state (FIG. 7B).

Figure 8:
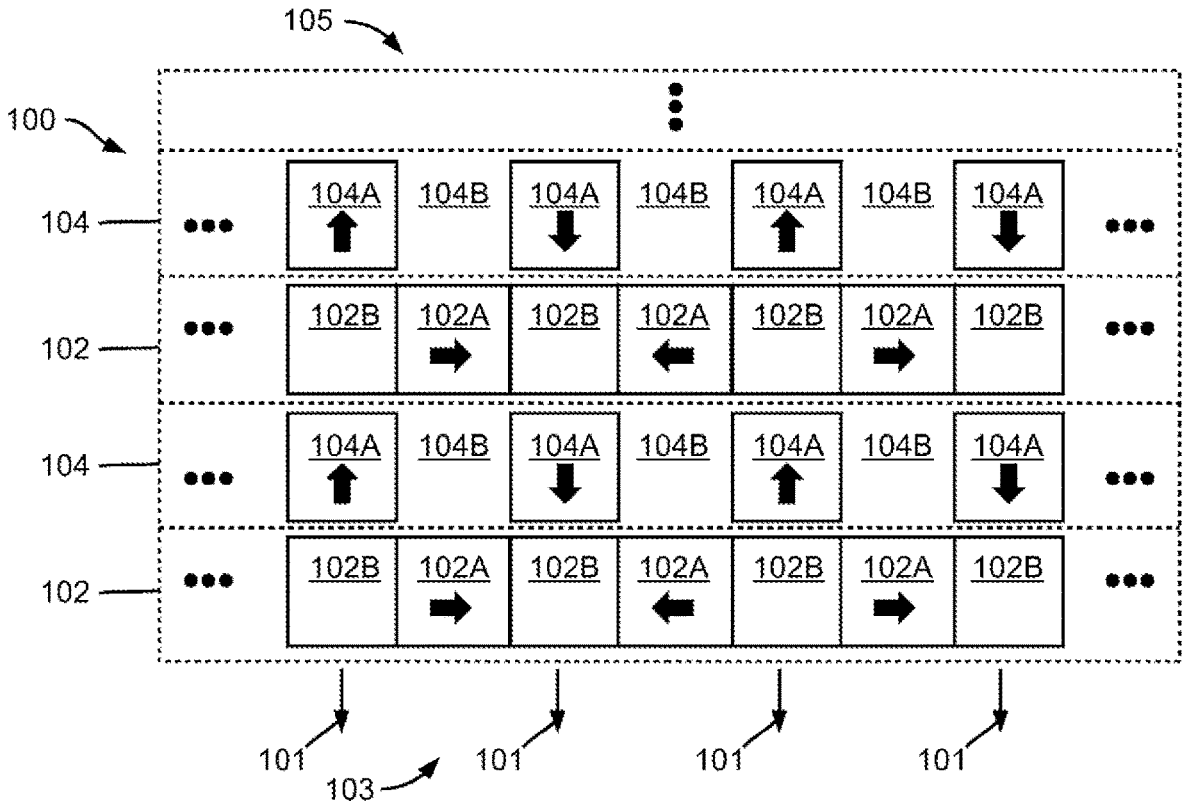
FIG. 8 is a schematic side view of a switchable magnetic apparatus in an arm layout, according to still some embodiments of the present disclosure, wherein the switchable magnetic apparatus comprises a plurality pairs of front and rear layers.

FIG. 8 shows a side view of a switchable magnetic apparatus 100 in some embodiments, wherein the switchable magnetic apparatus 100 comprises a plurality of stacked pairs of layers 102 and 104.

In some embodiments, the front layer 102 may comprise a plurality of front-layer arrays of front-layer magnets 102A and ferromagnetic components 102B in various patterns. Accordingly, the rear layer 104 may comprise a plurality of rear-layer arrays of rear-layer magnets 104A and non-ferromagnetic blocks 104B in corresponding patterns. In these embodiments, the front-layer arrays may or may not comprise the same number of front-layer magnets 102A and ferromagnetic components 102B and the rear-layer arrays may or may not comprise the same number of rear-layer magnets 104A and non-ferromagnetic blocks 104B, as will be further described below.

Figure 9A:
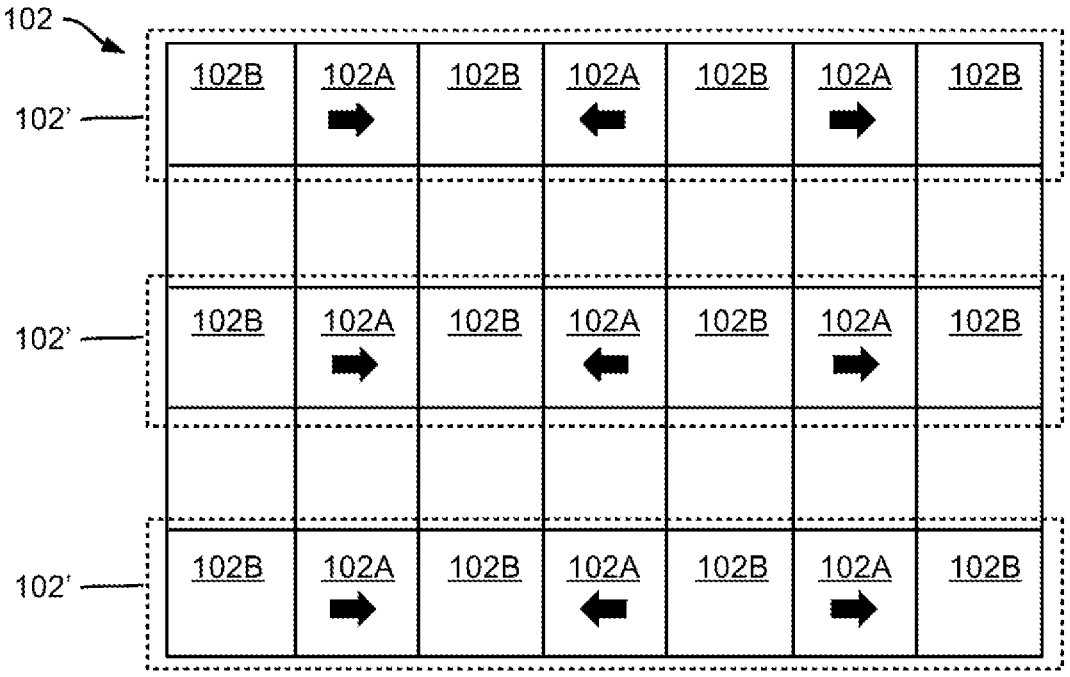
FIGS. 9A and 9B are schematic plan views of a front layer (FIG. 9A) and a rear layer (FIG. 9B) of a switchable magnetic apparatus in the ON state, according to some embodiments of the present disclosure.
Figure 9B:
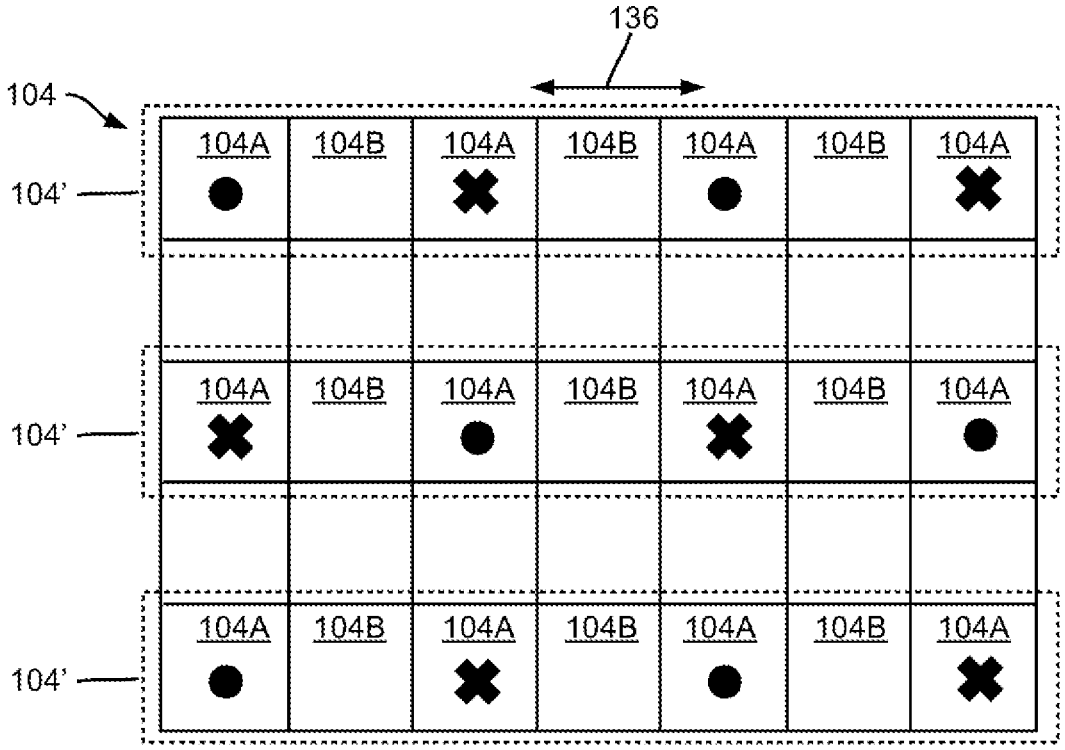

For example, FIGS. 9A and 9B show top views of the front and rear layers 102 and 104, respectively, of a switchable magnetic apparatus 100 in some embodiments. As shown in FIG. 9A, the front layer 102 comprises a plurality of front-layer arrays 102' laterally distributed in parallel. Each front-layer array 102' comprises one or more front-layer magnets 102A spaced by or interleaved with a plurality of ferromagnetic components 102B in a manner similar that shown in FIGS. 2A and 2B. Thus, the front-layer magnets 102A and the ferromagnetic components 102B are in a matrix form.

Accordingly and as shown in FIG. 9B, the rear layer 104 comprises a plurality of rear-layer arrays 104' laterally distributed in parallel at positions corresponding to those of the rear-layer arrays 102'. Each rear-layer array 104' comprises one or more rear-layer magnets 104A spaced by or interleaved with one or more non-ferromagnetic blocks or spacers 104B in a manner similar that shown in FIGS. 2A and 2B. The switchable magnetic apparatus 100 may be switched ON and OFF by longitudinally moving the rear layer 104 as indicated by the arrow 136. Of course, those skilled in the art will appreciate that the switchable magnetic apparatus 100 may alternatively be switched ON and OFF by longitudinally moving the front layer 102.

Figure 10A:
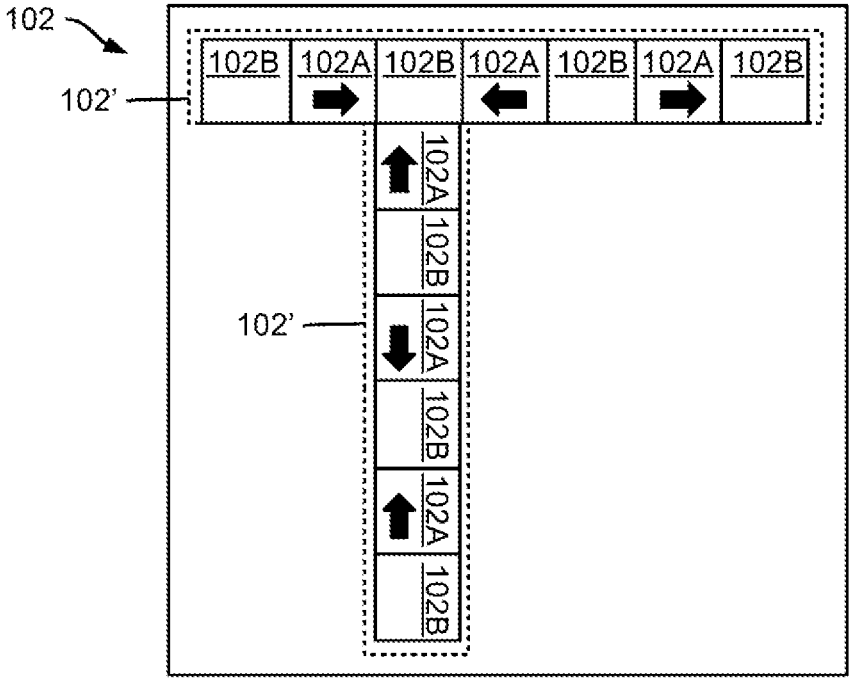
FIGS. 10A and 10B are schematic plan views of a front layer (FIG. 10A) and a rear layer (FIG. 10B) of a switchable magnetic apparatus in the ON state, according to yet some embodiments of the present disclosure.
Figure 10B:
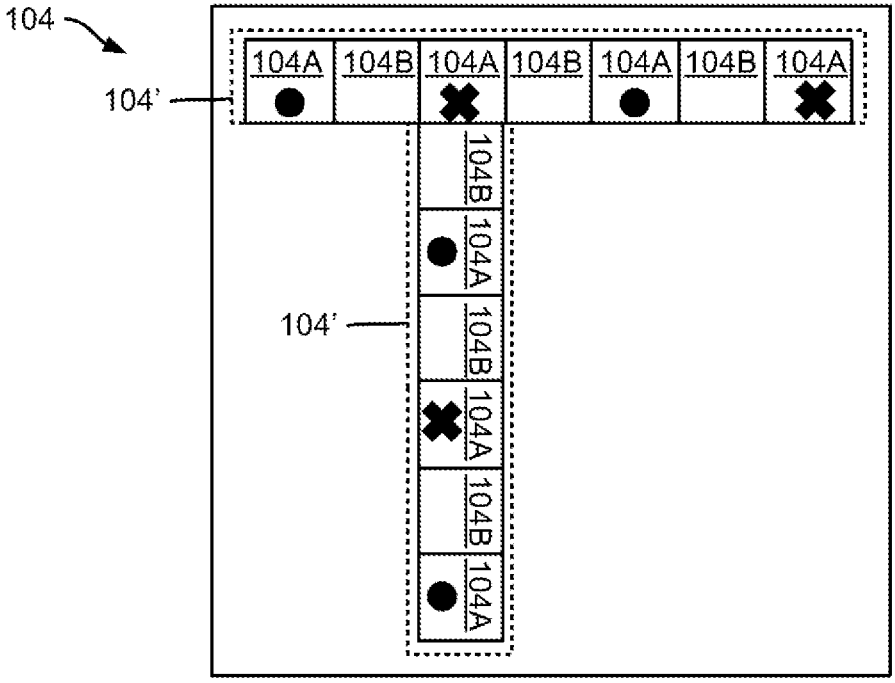

In some embodiments, the front and rear layers 102 and 104 may each comprise a plurality of front-layer and rear-layer arrays 102' and 104', respectively, arranged in other patterns such as an L-shape, T-shape, X-shape, and the like. An example of the front and rear layers 102 and 104 with front-layer and rear-layer arrays 102' and 104' arranged in the T-shape is shown in FIGS. 10A and 10B.

Figure 11A:
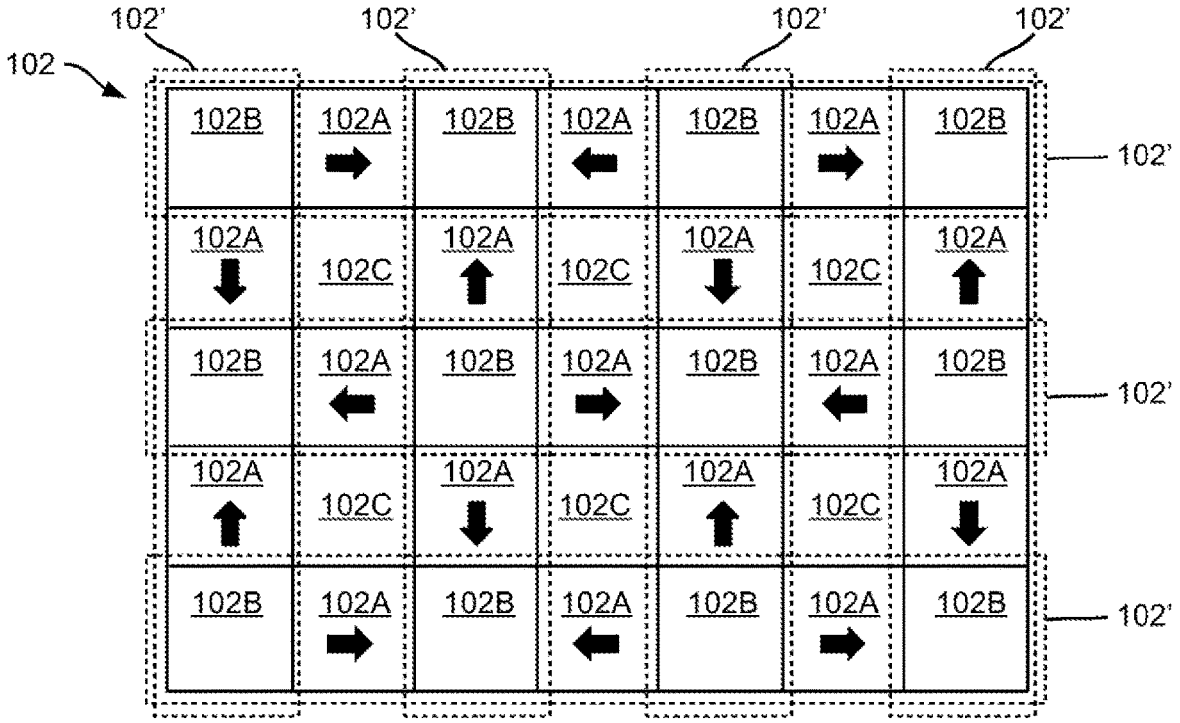
FIGS. 11A and 11B are schematic plan views of a front layer (FIG. 11A) and a rear layer (FIG. 11B) of a switchable magnetic apparatus in the ON state, according to still some embodiments of the present disclosure.
Figure 11B:
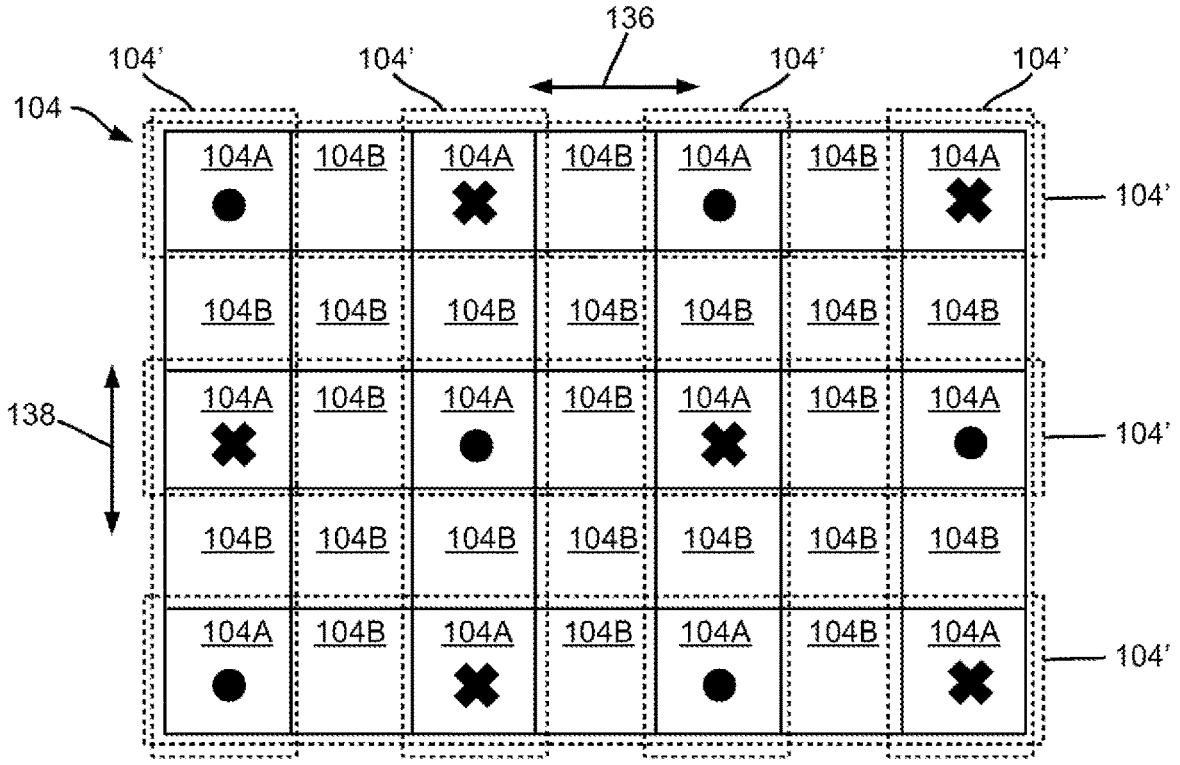

FIGS. 11A and 11B show top views of the front and rear layers 102 and 104, respectively, of a switchable magnetic apparatus 100 in some embodiments, where in each layer 102/104, the blocks thereof form a linear array. FIG. 11A shows the front layer 102 having non-ferromagnetic zones 102C adjacent four front-layer magnets 102A. Such non-ferromagnetic zones 102C may be air spaces or may be non-ferromagnetic material that may or may not be part of the housing or actuator. Each ferromagnetic block 102B may face two, three, or four of the same poles from adjacent front-layer magnets 102A. The front-layer magnets 102A and ferromagnetic blocks 102B thus form a plurality of front-layer arrays 102' in rows and columns.

FIG. 11B shows the rear-layer magnets 104A overlapping ferromagnetic blocks 102B with alternating polarities in relation to the next nearest two, three, or four rear-layer magnets 104A. The rear-layer magnets 104A and non-ferromagnetic blocks 104B thus form a plurality of rear-layer arrays 104' in rows and columns.

The switchable magnetic apparatus 100 may comprise an actuator mechanism for moving the front and rear layers 102 and 104 relative to each other longitudinally or laterally as indicated by the arrows 136 and 138. There may not be the same number of ferromagnetic blocks 102B as the number of rear-layer magnets 104A so as to have a rear-layer magnet 104A overlapping every ferromagnetic block 102B or to have a ferromagnetic block 102B overlapping every rear-layer magnet 104A in both the ON and OFF states. The arrays of one or both of the front and rear layers 102 and 104 may be a variety of shapes including but not limited to rectangular, square, L-shaped, U-shaped, and/or the like.

Figure 12A:
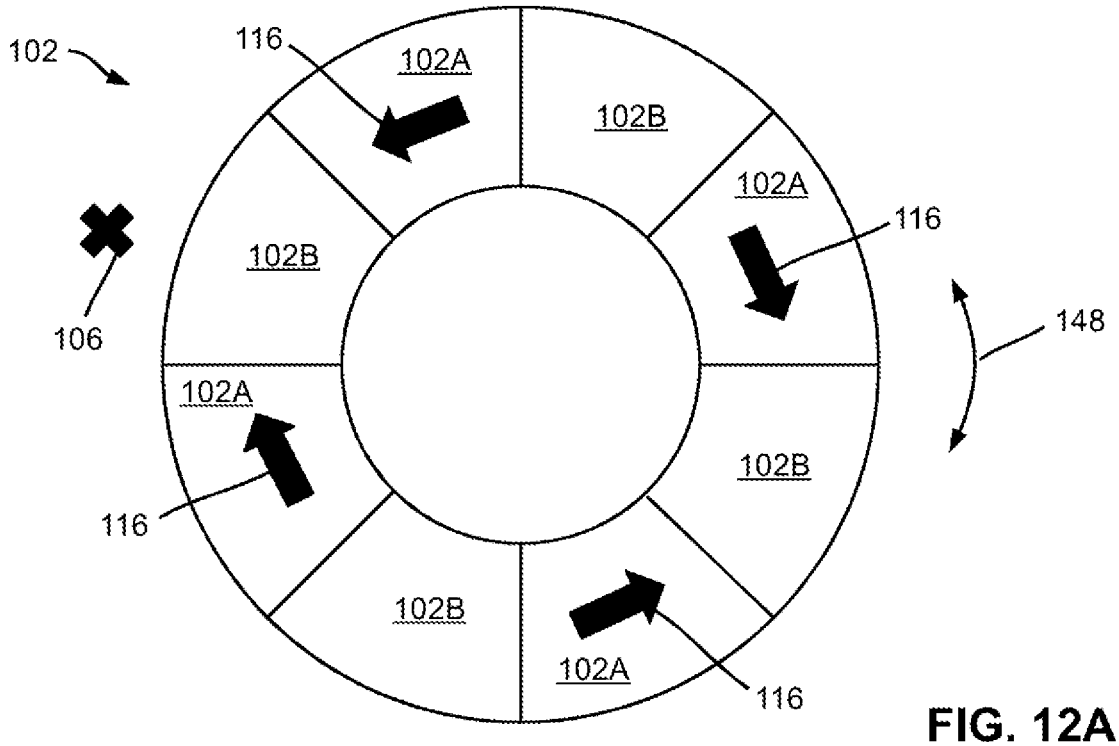
FIGS. 12A and 12B are schematic plan views of a front layer (FIG. 12A) and a rear layer (FIG. 12B) of a switchable magnetic apparatus in the ON state, according to some embodiments of the present disclosure, wherein the front and rear layers are in a disk form with a circular layout.
Figure 12B:
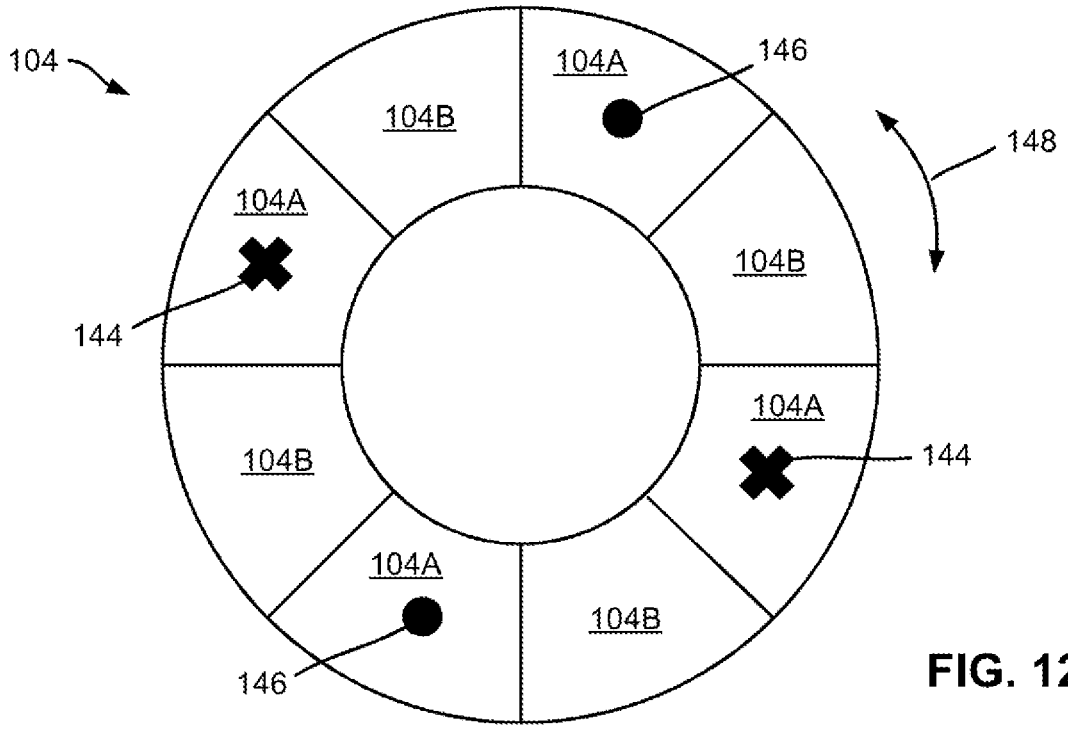

FIGS. 12A and 12B show top views of the front and rear layers 102 and 104, respectively, of a switchable magnetic apparatus 100 in some embodiments of the present disclosure. In these embodiments, the front and rear layers 102 and 104 are in the disk form. The front-layer magnets 102A and ferromagnetic blocks 102B of the front layer 102 are interleaved and arranged in a circular manner. The polarities of the front-layer magnets 102A are in the same plane of the front layer 102 and circumferentially alternating. In other words, the circumferentially adjacent front-layer magnets 102A (which sandwich a ferromagnetic block 102B therebetween) have opposite polarities, as indicated by the arrows 116.

Similarly, in these embodiments, the rear-layer magnets 104A and non-ferromagnetic blocks 104B of the rear layer 104 are interleaved and arranged in a circular manner. The polarities of the rear-layer magnets 104A are perpendicular to the plane of the rear layer 104 and alternating. In other words, the polarities of the rear-layer magnets 104A are perpendicular to the polarities of the front-layer magnets 102A, and the circumferentially adjacent rear-layer magnets 104A (which sandwich a non-ferromagnetic block 104B therebetween) have opposite polarities, as indicated by the crosses 144 (representing a direction going into the paper) and the dots 146 (representing a direction going out of the paper).

In any of the ON and OFF states, each rear-layer magnet 104A overlaps a ferromagnetic block 102B along the target direction 106 (shown in FIG. 12A as a cross, representing a direction going into the paper), and each non-ferromagnetic block 104B overlaps a front-layer magnet 102A.

Figure 13A:
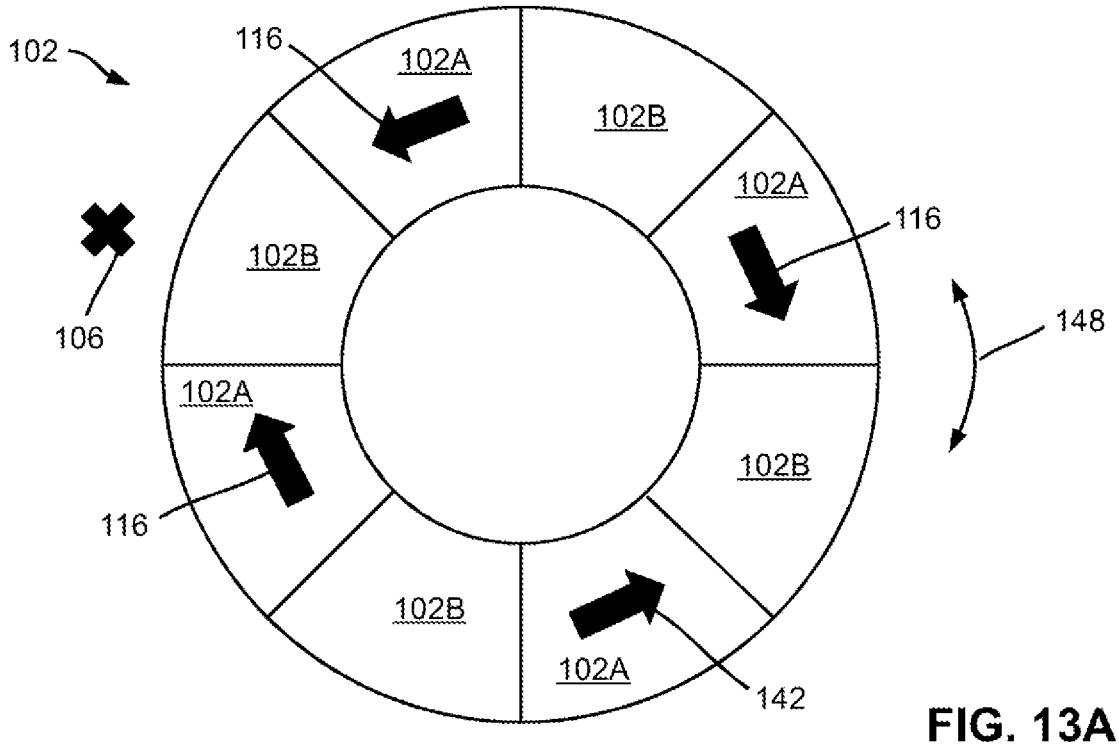
FIGS. 13A and 13B are schematic plan views of the front and rear layers, respectively of the switchable magnetic apparatus shown in FIGS. 12A and 12B in the OFF state.
Figure 13B:
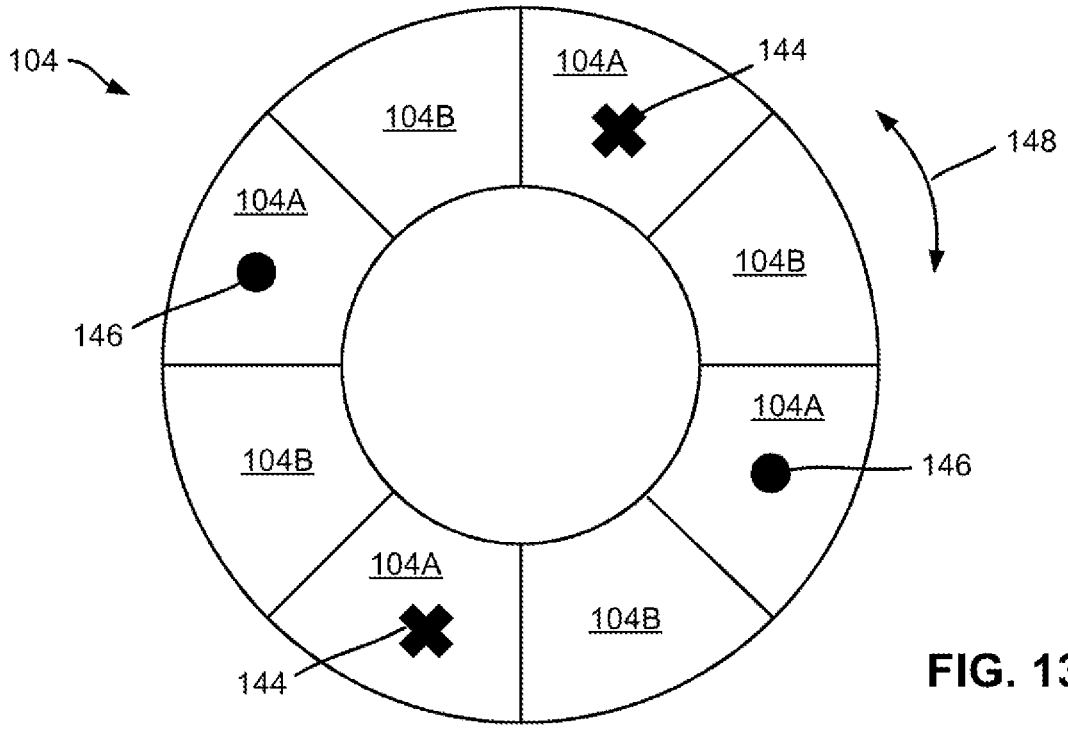

The switchable magnetic apparatus 100 in these embodiments may be switched ON and OFF by rotating the front and/or rear layers 102 and 104 as indicated by the arrow 148. FIGS. 12A and 12B show the switchable magnetic apparatus 100 in the ON state when the polarities of each front-layer magnet 102A and the rear-layer magnets 104A adjacent thereof are "opposite" to each other. FIGS. 13A and 13B show the switchable magnetic apparatus 100 in OFF state after, for example, rotating the rear layer 104 by 90° while maintaining the front layer 102 in position, such that the polarities of each front-layer magnet 102A and the rear-layer magnets 104A adjacent thereof are "aligned" with each other.

In these embodiments, the number of front-layer ferromagnetic blocks 102B is the same as that of the front-layer magnets 102A, and there are an even number of the ferromagnetic blocks 102B and front-layer magnets 102A to have the polarity of front-layer magnets 102A alternate continuously around the circle. The number of ferromagnetic blocks 102B determines the required rotation to switch between the ON and OFF state. Specifically, the required rotation angle is: 360° divided by the number of ferromagnetic blocks 102B. For example, in the embodiments shown in FIGS. 8A to 9B, the front layer 104 comprises four (4) ferromagnetic blocks 102A and thus the required rotation angle is 90°.

Figure 14A:
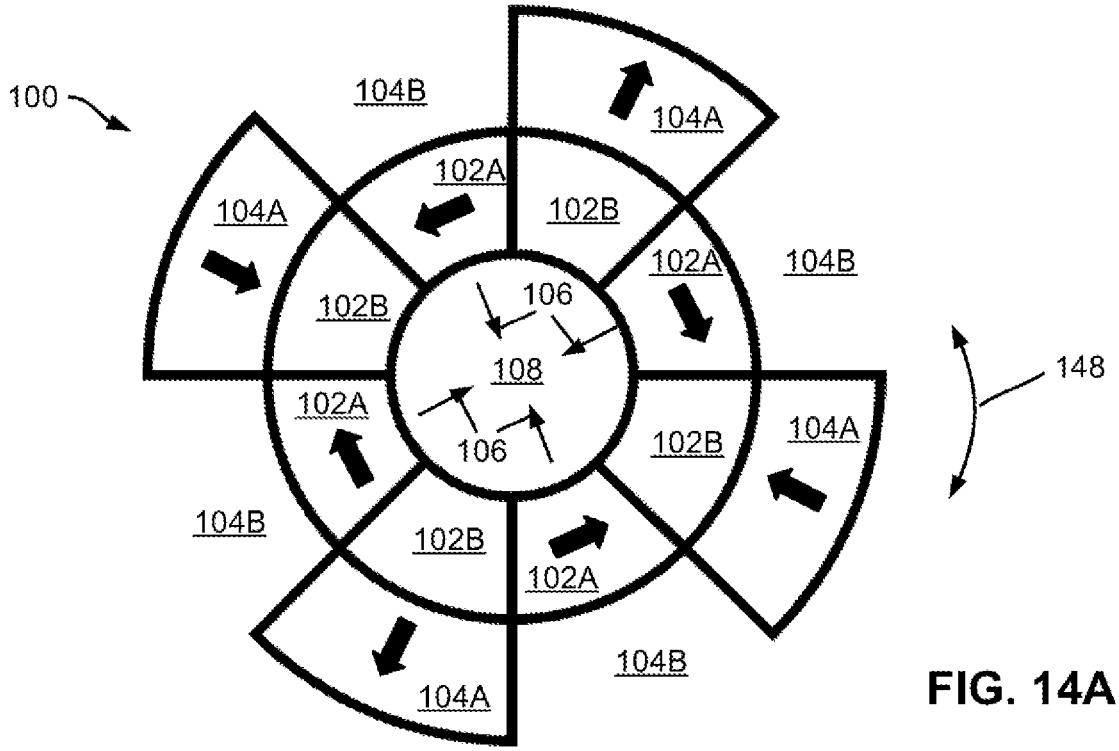
FIGS. 14A and 14B are schematic side views of a switchable magnetic apparatus in the ON and OFF state, respectively, according to some embodiments of the present disclosure, wherein, when in the ON states (FIG. 14A), the switchable magnetic apparatus generates a magnetic field along a radially inward direction.
Figure 14B:
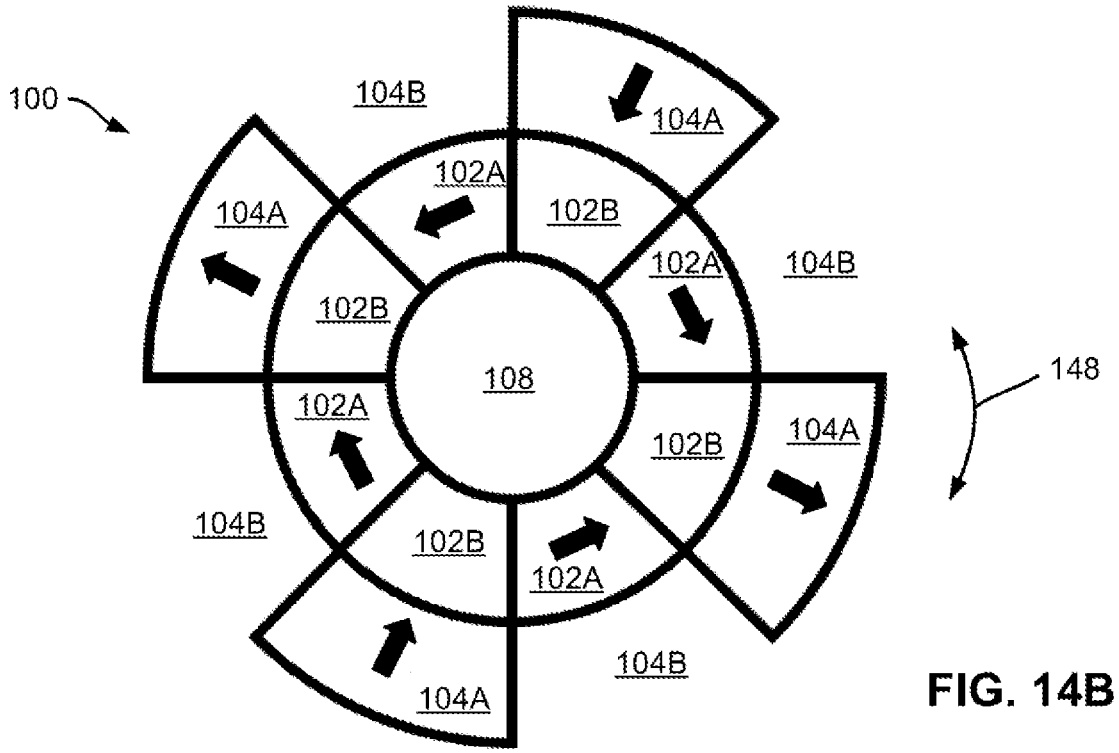

FIGS. 14A and 14B show a switchable magnetic apparatus 100 in some embodiments wherein the front and rear layers are in the form of concentric cylinders with the front layer 102 inside the rear layer 104 for generating a directional magnetic field along the radially inward target direction 106 on the target side 108 of the front layer 102 (which in these embodiments is the inner side of the front layer 102). Rear-layer magnets 104A are overlapping the ferromagnetic blocks 102B along a direction radially outwards from the center of the circle. The front layer 102 or rear layer 104 may be rotated with respect to each other as indicated by the arrow 148 between the ON positions and OFF positions to turn the switchable magnetic apparatus ON (FIG. 14A) and OFF (FIG. 14B).

FIG. 14A shows the switchable magnetic apparatus 100 in the ON position where each ferromagnetic block 102B faces the same magnetic pole from the adjacent front-layer magnets 102A and the adjacent rear-layer magnet 104A. The magnetic flux is then directed radially inwardly towards the target side 108 of the front layer 102.

When using a manipulating mechanism that translates the layers rotationally, the front layer 102 or rear layer 104 may be rotated with respect to each other 90 degrees around the center of the circle to turn the switchable magnetic apparatus 100 OFF. As shown in FIG. 14B, when the switchable magnetic apparatus 100 is in the OFF position, each ferromagnetic block 102B faces opposite poles between the front-layer magnets 102A and rear-layer magnets 104A, causing the magnetic flux to be pulled radially outwards away from the inner side of the front layer 102.

Figure 15A:
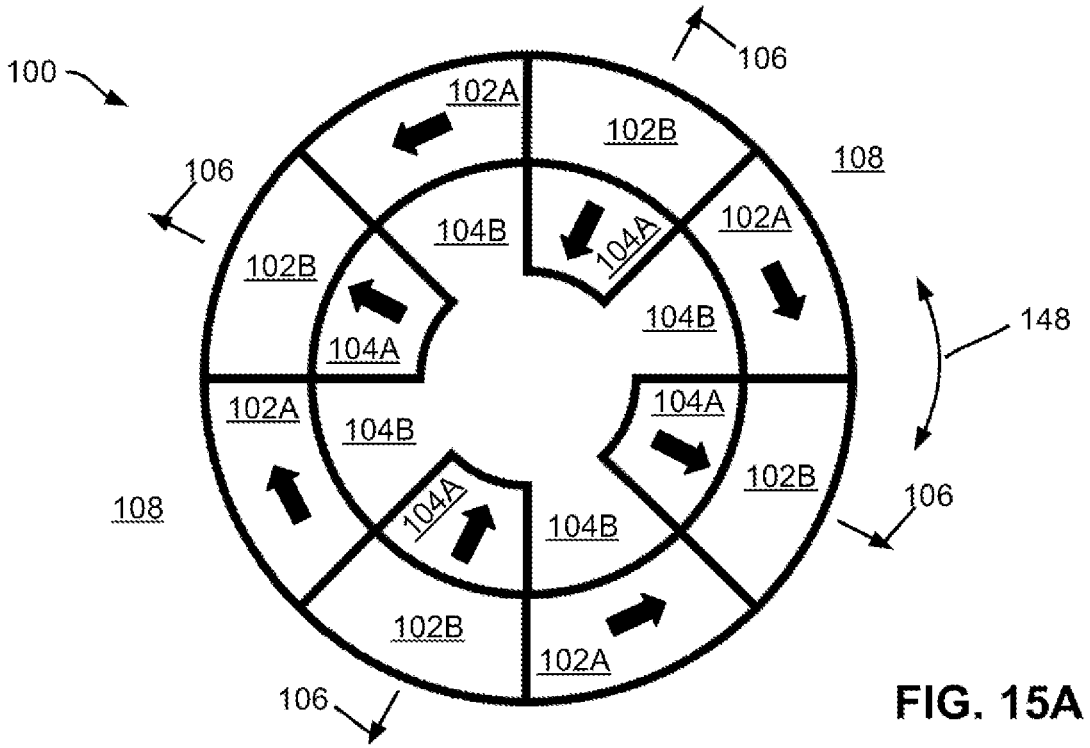
FIGS. 15A and 15B are schematic side views of a switchable magnetic apparatus in the ON and OFF state, respectively, according to some embodiments of the present disclosure, wherein, when in the ON states (FIG. 15A), the switchable magnetic apparatus generates a magnetic field along a radially outward direction apply a magnetic force to a work-piece outside the switchable magnetic apparatus, according to some embodiments of the present disclosure.
Figure 15B:
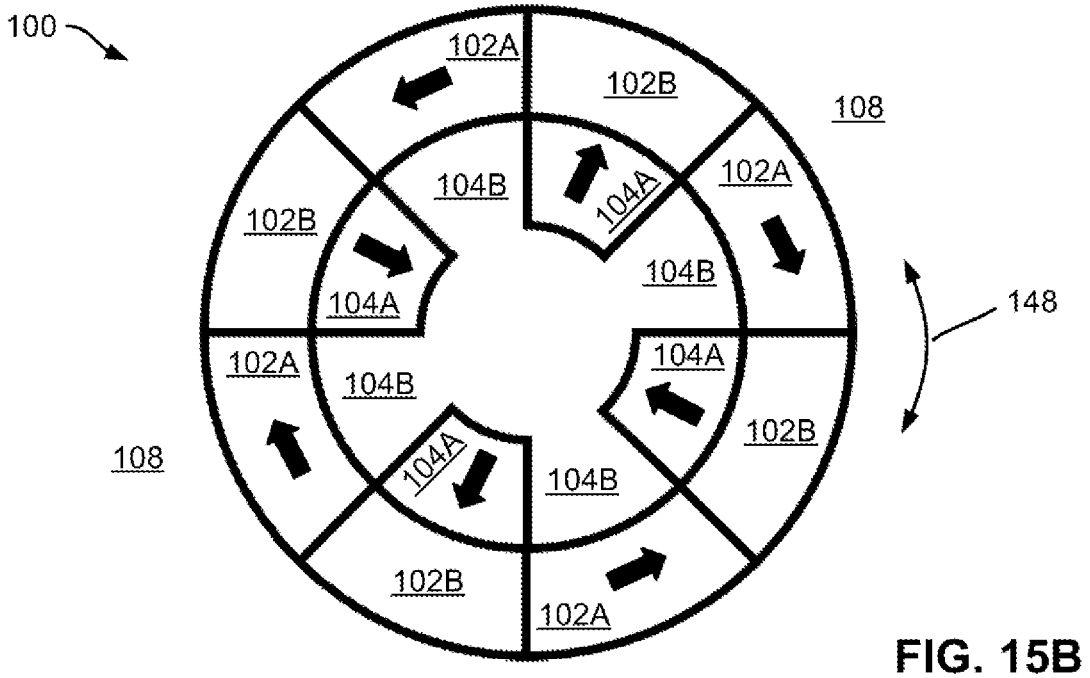

FIGS. 15A and 15B show a switchable magnetic apparatus 100 in some embodiments. The switchable magnetic apparatus 100 in these embodiments is similar to that shown in FIGS. 14A and 14B except that in these embodiments, the rear layer 104 is concentrically inside the front layer 102 and the target side 108 is the outer side of the front layer 102. Rear-layer magnets 104A are overlapping the ferromagnetic blocks 102B along a direction radially inwards from the center of the circle. The front layer 102 or rear layer 104 may be rotated with respect to each other as indicated by the arrow 148 between the ON positions and OFF positions to turn the switchable magnetic apparatus ON (FIG. 15A) and OFF (FIG. 15B).

FIG. 15A shows the switchable magnetic apparatus 100 in the ON position where each ferromagnetic block faces the same magnetic pole from the adjacent front-layer magnets 102A and the adjacent rear-layer magnet 104A. The magnetic flux is then directed radially outwardly towards the target side 108 of the front layer 102.

When using a manipulating mechanism that translates the layers rotationally, the front layer 102 and rear layer 104 may be rotated with respect to each other 90 degrees around the center of the circle to turn the switchable magnetic apparatus 100 OFF. As shown in FIG. 15B, when the switchable magnetic apparatus 100 is in the OFF position, each ferromagnetic blocks 102B faces opposite poles between the front-layer magnets 102A and rear-layer magnets 104A, causing the magnetic flux to be pulled radially inwards away from the outer side of the front layer 102.

Figure 16A:
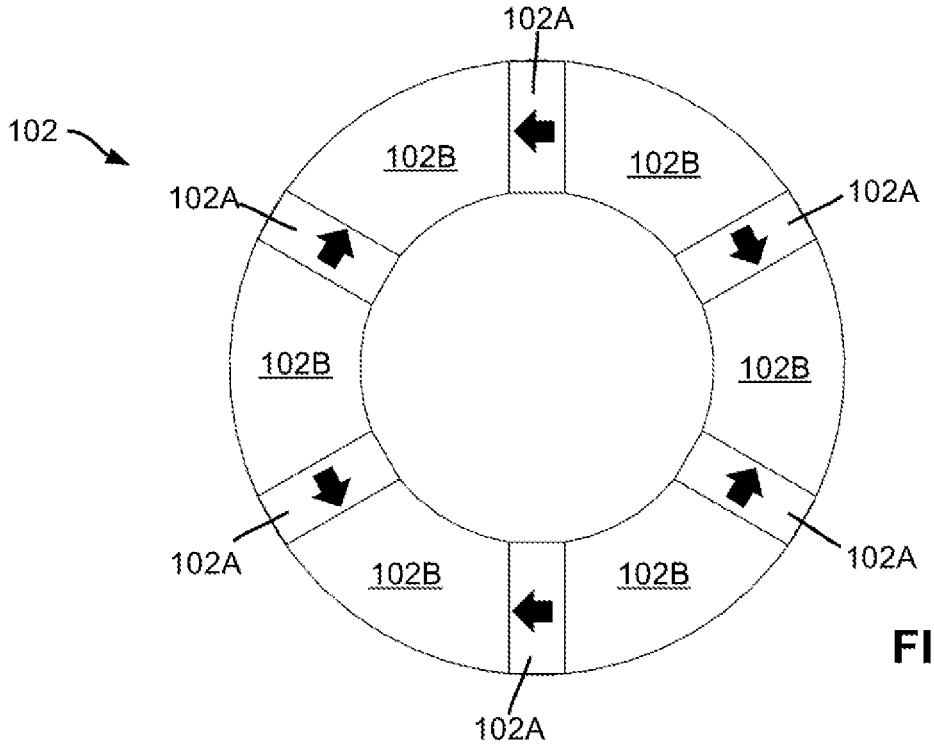
FIGS. 16A and 16B are schematic plan views of the front and rear layers of a switchable magnetic apparatus according to some embodiments of the present disclosure, wherein the front and rear layers are in a circular layout with magnets in different shapes.
Figure 16B:
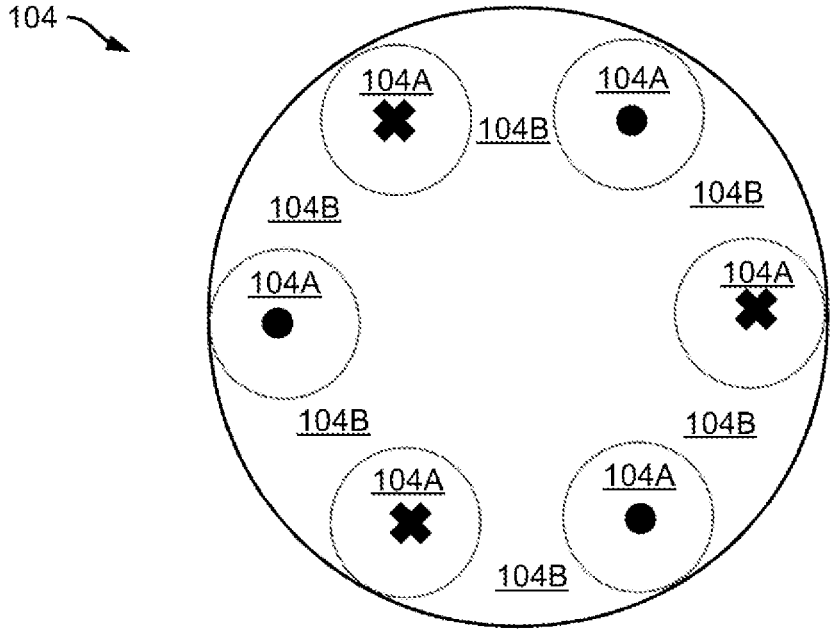

FIGS. 16A and 16B show the front layer 102 and rear layer 104, respectively, of a switchable magnetic apparatus 100 in some embodiments. The front-layer magnets 102A are in rectangular shapes while the rear-layer magnets 104A are circular magnets. There are six (6) ferromagnetic blocks 102B, six front-layer magnets 102A, and six rear-layer magnets 104A. This is to demonstrate the shapes and number of components may vary in various embodiments but is to still be considered part of this disclosure. Relative coverage of the rear-layer magnets 104A and ferromagnetic blocks 102B may not always be 100%. Based on the relative size between the front-layer magnets 102A and rear-layer magnets 104A, the rear-layer magnets 104A may overlap partially with the front-layer magnets 102A.

Figure 17A:
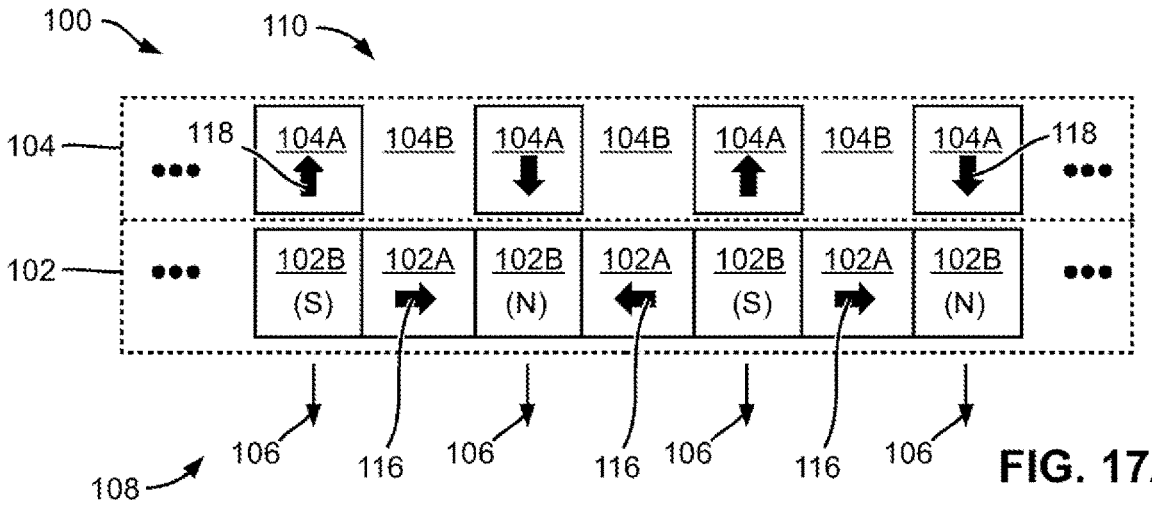
FIG. 17A is a schematic side view of the portion of the switchable magnetic apparatus shown in FIG. 2A showing front-layer magnets and magnetized poles on the front layer thereof.

FIG. 17A illustrates the switchable magnetic apparatus 100 shown in FIG. 2A in the ON state. For illustrative purposes, the arrows 116 and 118 in FIG. 17A represent the polarity from South pole to North pole.

Figure 17B:
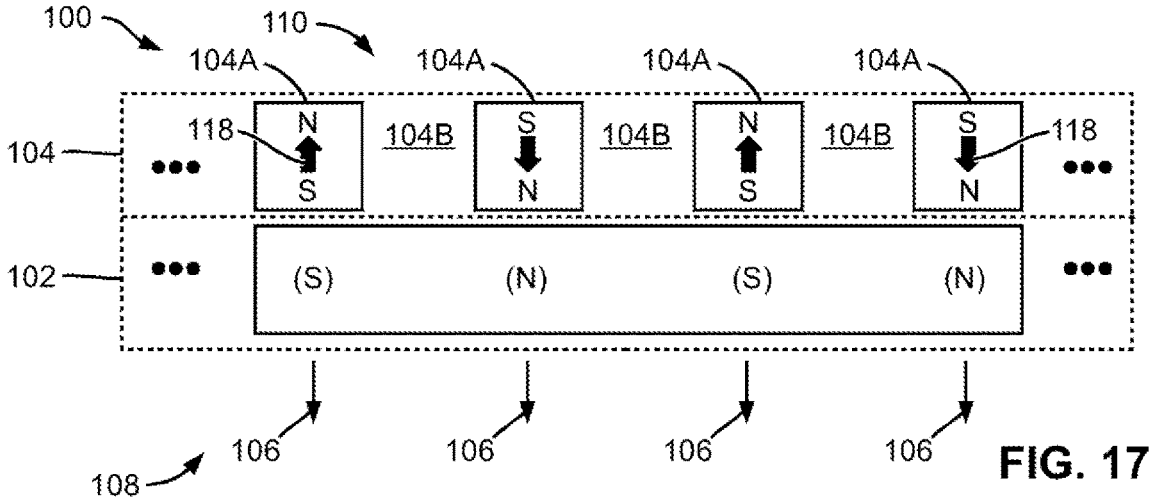
FIG. 17B is a schematic side view of the portion of the switchable magnetic apparatus shown in FIG. 2A showing the magnetized poles on the front layer thereof.

As the front-layer magnets 102A are arranged in alternating polarities, each ferromagnetic block 102B sandwiched between a pair of adjacent front-layer magnets 102A are magnetized to a corresponding pole. Specifically, the ferromagnetic block 102B adjacent the South pole of adjacent front-layer magnets 102A is magnetized to the South pole (denoted "(S)" wherein "0" represents the magnetized pole rather than the magnet pole), and the ferromagnetic block 102B adjacent the North pole of adjacent front-layer magnets 102A is magnetized to the North pole (denoted "(N)"). Thus, as shown in FIG. 17B, the front-layer magnets 102A and the ferromagnetic blocks 102B define a plurality of alternating front-layer poles on the front layer 102, which in these embodiments are alternating magnetized poles.

Figure 17C:
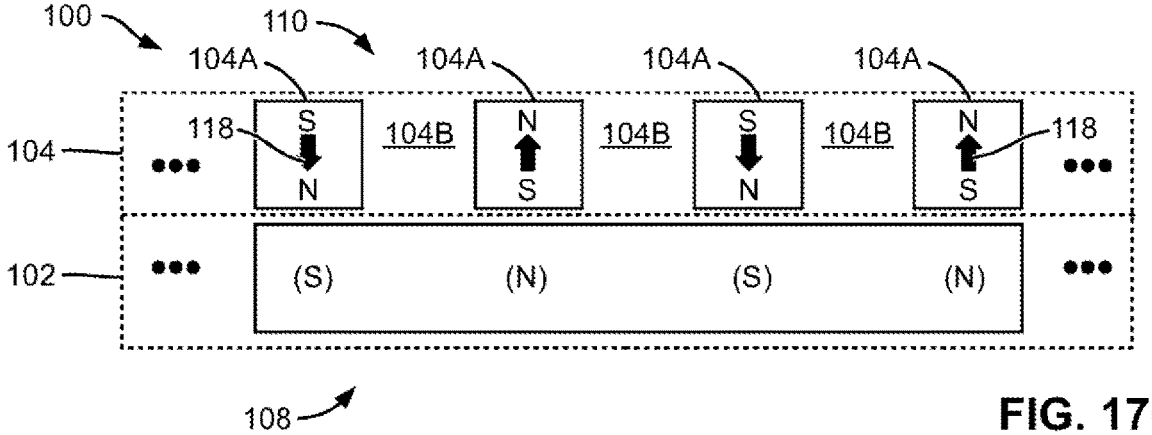
FIG. 17C is a schematic side view of the portion of the switchable magnetic apparatus shown in FIG. 2B showing the magnetized poles on the front layer thereof.

Each rear-layer magnet 104A is at a position overlapping a respective front-layer pole of the front layer 102 along the target direction 106. As shown in FIG. 17B, in the ON state, the pole of each rear-layer magnet 104A adjacent the front layer 102 is the same pole as the front-layer pole adjacent thereto. As shown in FIG. 17C, in the OFF state, the pole of each rear-layer magnet 104A adjacent the front layer 102 is the opposite pole to the front-layer pole adjacent thereto.

Figure 18A:
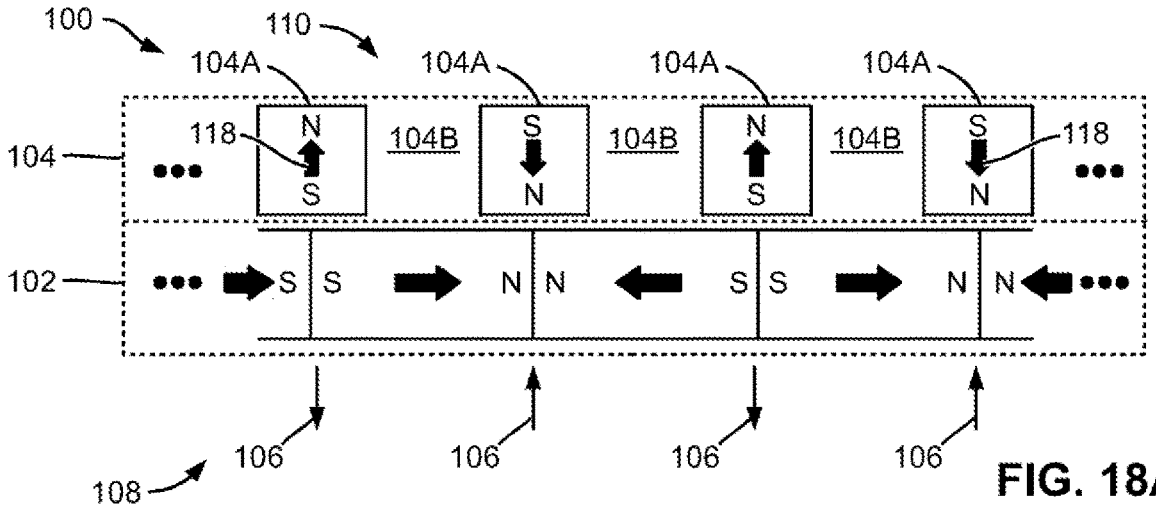
FIGS. 18A and 18B are schematic side views of a portion of a switchable magnetic apparatus in the ON state (FIG. 18A) and the OFF state (FIG. 18B), respectively, according to some embodiments of the present disclosure, showing front-layer magnets and magnetized poles on the front layer thereof.
Figure 18B:
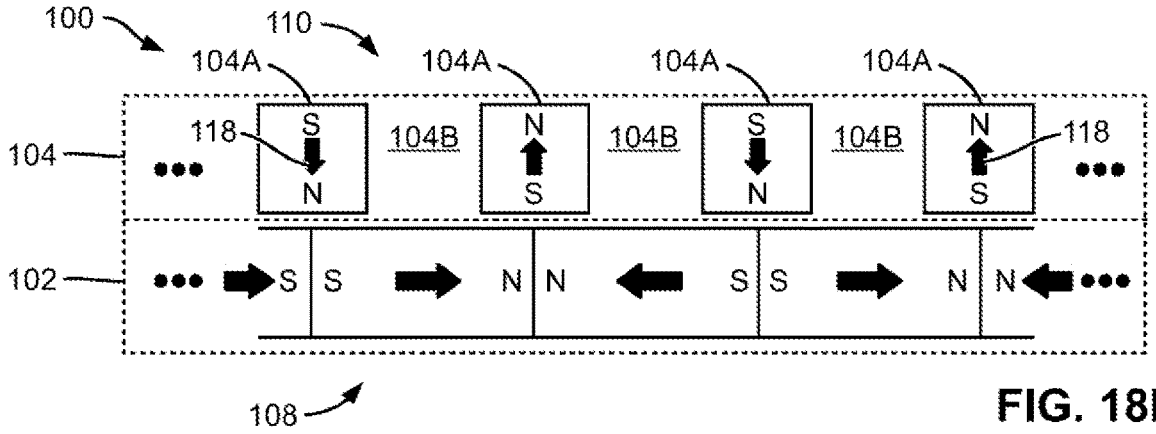
Figure 19A:
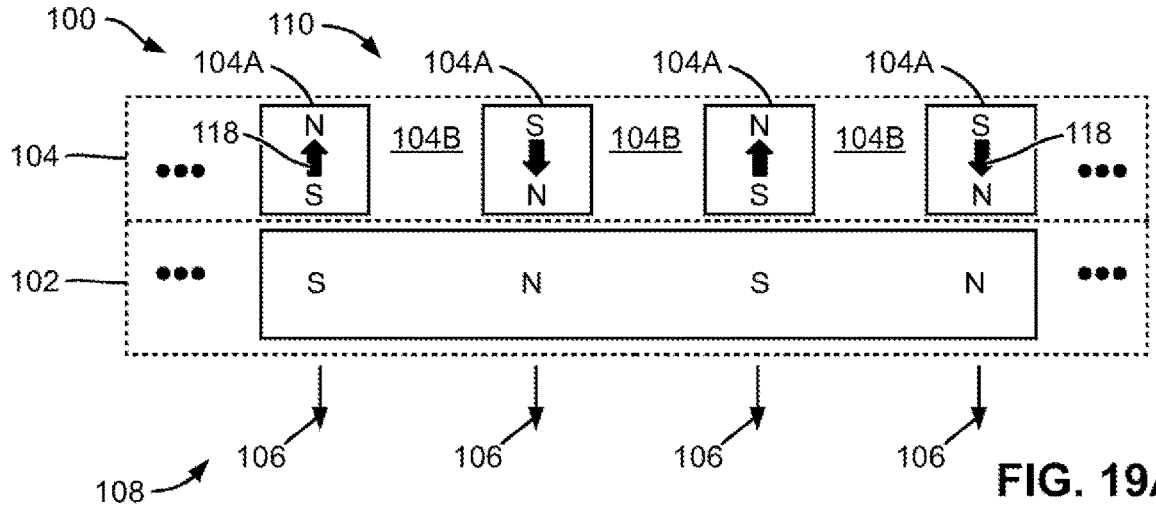
FIGS. 19A and 19B are schematic side views of the portion of the switchable magnetic apparatus shown in FIGS. 18A and 18B in the ON state (FIG. 19A) and the OFF state (FIG. 19B), respectively, showing the magnetized poles on the front layer thereof.
Figure 19B:
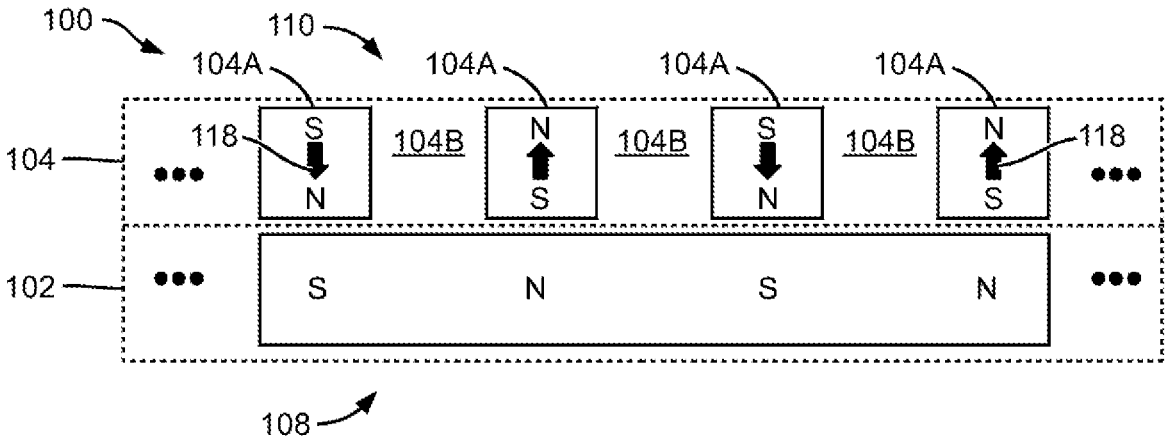

FIGS. 18A and 18B show a switchable magnetic apparatus 100 in some embodiments. The switchable magnetic apparatus 100 in these embodiments is similar to that shown in FIGS. 2A and 2B except that the front layer 102 does not comprise the ferromagnetic blocks 102B. Rather, the front-layer magnets 102A are arranged in alternating polarities and in contact with adjacent ones. Thus, the alternating-polarity front-layer magnets 102A define a plurality of alternating front-layer poles on the front layer 102 (which in these embodiments are alternating magnet poles and represented by "N" and "S" without the brackets "0") as shown in FIGS. 19A and 19B.

Each rear-layer magnet 104A is at a position overlapping a respective front-layer pole of the front layer 102 along the target direction 106. As shown in FIGS. 18A and 19A, in the ON state, the pole of each rear-layer magnet 104A adjacent the front layer 102 is the same pole as the front-layer pole adjacent thereto. As shown in FIGS. 18B and 19B, in the OFF state, the pole of each rear-layer magnet 104A adjacent the front layer 102 is the opposite pole to the front-layer pole adjacent thereto.

Figure 20A:
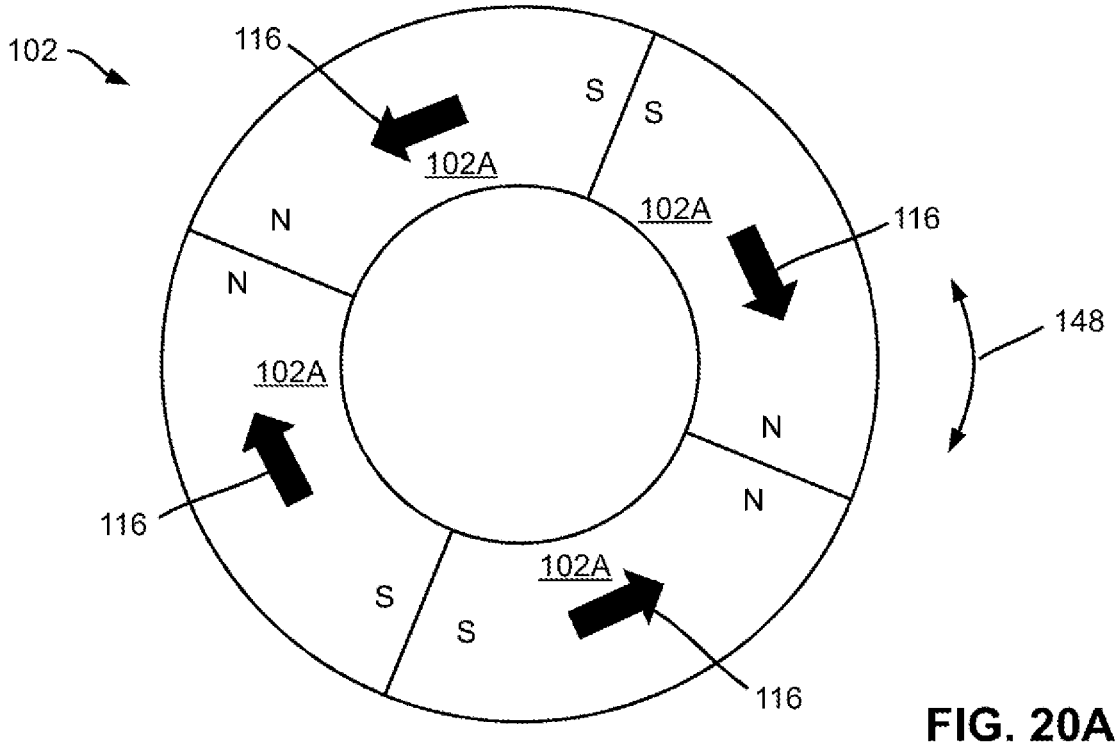
FIGS. 20A and 20B are schematic plan views of a front layer (FIG. 20A) and a rear layer (FIG. 20B) of a switchable magnetic apparatus in the ON state, according to some embodiments of the present disclosure, showing front-layer magnets and magnet poles on the front layer thereof, wherein the front and rear layers are in a disk form with a circular layout.
Figure 20B:
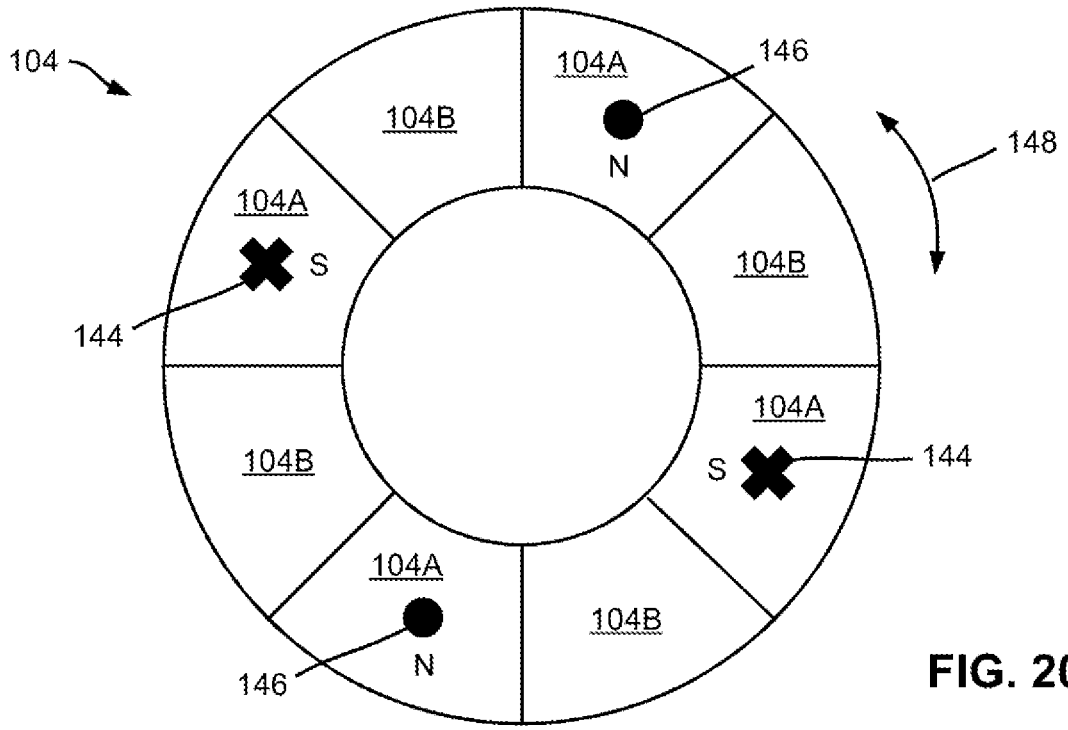
Figure 21:
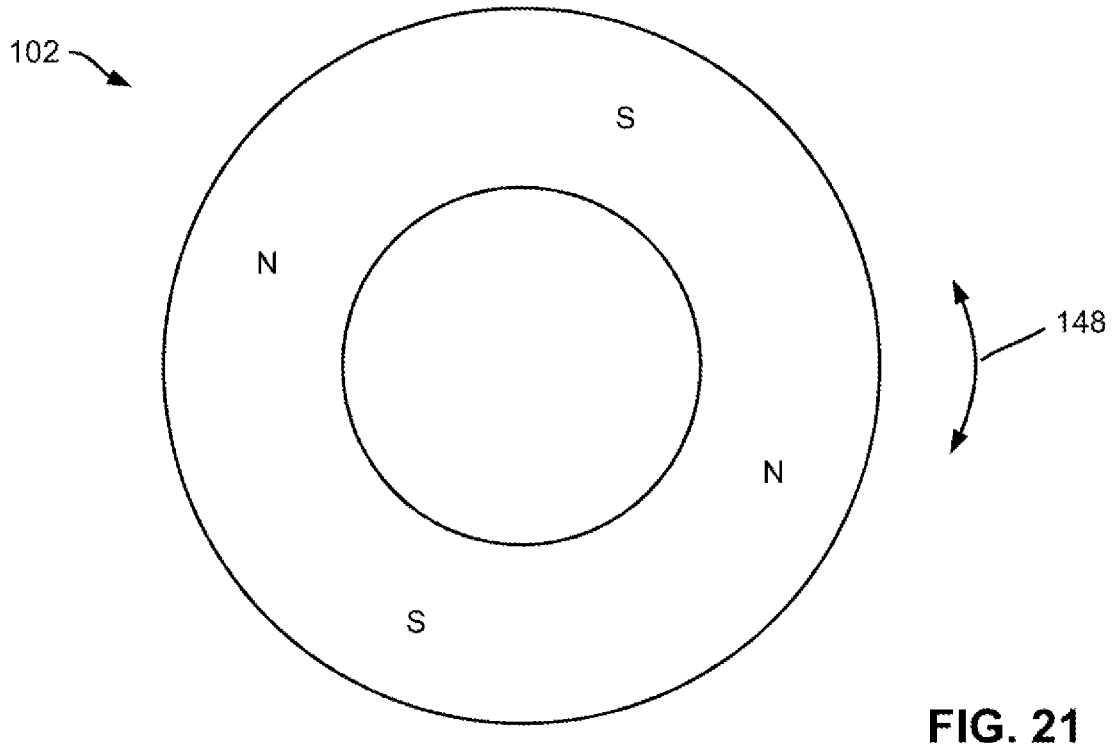
FIG. 21 is a schematic plan view of the front layer shown in FIG. 20A, showing the magnet poles on the front layer thereof.

FIGS. 20A and 20B show a switchable magnetic apparatus 100 in the ON and OFF states, respectively, according to some embodiments of this disclosure. The switchable magnetic apparatus 100 in these embodiments is similar to that shown in FIGS. 12A and 12B except that the front layer 102 does not comprise the ferromagnetic blocks 102B. Rather, the front-layer magnets 102A are arranged in alternating polarities and in contact with adjacent ones. Thus, the alternating-polarity front-layer magnets 102A define a plurality of alternating front-layer poles in a circular pattern on the front layer 102 as shown in FIG. 21.

With above embodiments, those skilled the in art will appreciate that, in various embodiments, the front layer 102 may be defined on any suitable surface (such as a plane or a planar surface, or a curved surface) perpendicular to the target direction, and with a plurality of alternating front-layer poles defined thereon in any suitable pattern.

Figure 22A:
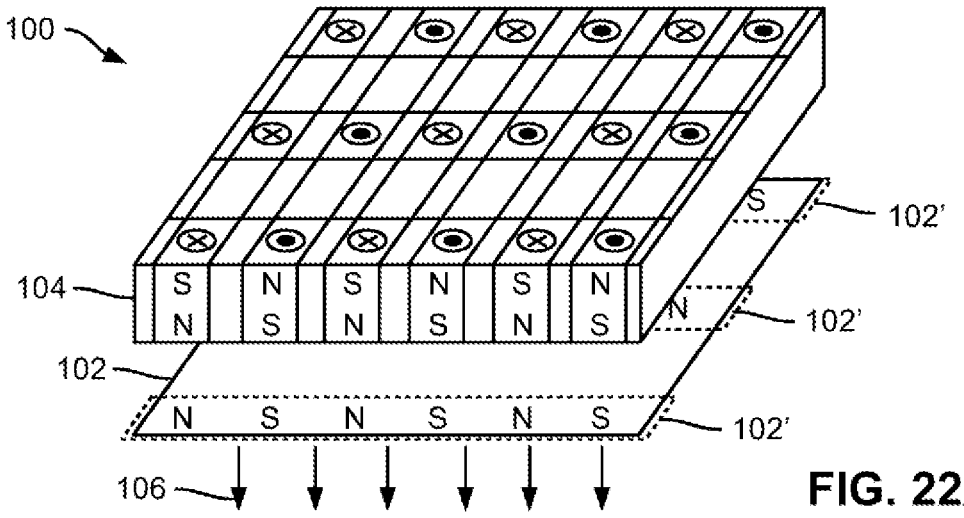
FIG. 22A is a schematic perspective view of a switchable magnetic apparatus according to some embodiments of the present disclosure, wherein the front layer of the switchable magnetic apparatus is defined along a plane and the magnets of the front layer are arranged in a matrix form.

For example, FIG. 22A shows a switchable magnetic apparatus 100 wherein the front layer 102 is defined on a plane perpendicular to the target direction 106, and with a plurality of alternating front-layer poles defined thereon in a plurality of linear patterns 102'. The rear layer 104 is on the rear side of the front layer 102.

Figure 22B:
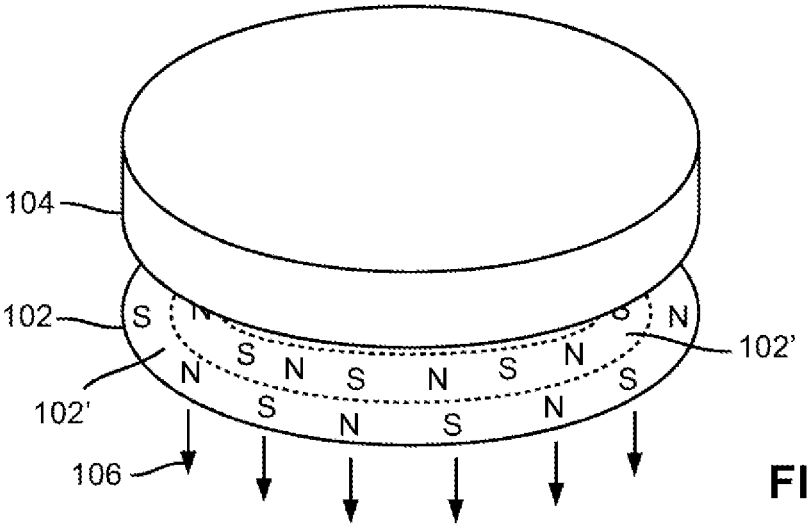
FIG. 22B is a schematic perspective view of a switchable magnetic apparatus according to some embodiments of the present disclosure, wherein the front layer of the switchable magnetic apparatus is defined along a plane and the magnets of the front layer are arranged in a circular form.

FIG. 22B shows a switchable magnetic apparatus 100 wherein the front layer 102 is defined on a plane perpendicular to the target direction 106, and with a plurality of alternating front-layer poles defined thereon in a plurality of circular patterns 102'. The rear layer 104 is on the rear side of the front layer 102. For ease of illustration, the rear-layer magnets are not shown.

Figure 22C:
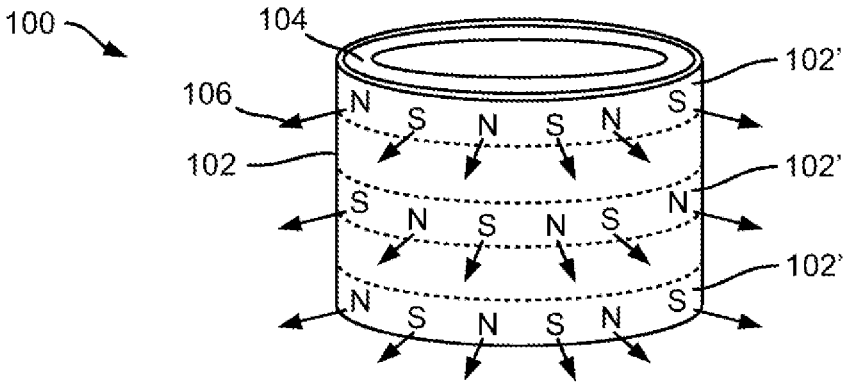
FIG. 22C is a schematic perspective view of a switchable magnetic apparatus according to some embodiments of the present disclosure, wherein the front layer of the switchable magnetic apparatus is defined along a cylindrical surface for generating a magnetic field on the outer side of the front layer.

FIG. 22C shows a switchable magnetic apparatus 100 wherein the front layer 102 is defined on a cylindrical surface perpendicular to the radially outward target direction 106, and with a plurality of alternating front-layer poles defined thereon in a plurality of circular patterns 102'. The rear layer 104 is on the inner side of the front layer 102.

Figure 22D:
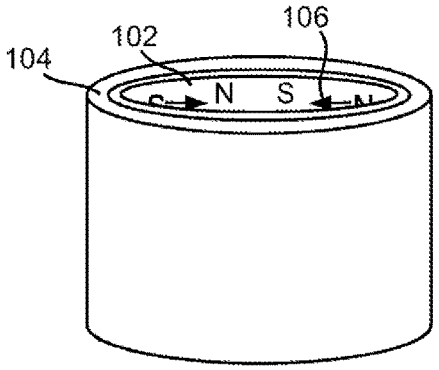
FIG. 22D is a schematic perspective view of a switchable magnetic apparatus according to some embodiments of the present disclosure, wherein the front layer of the switchable magnetic apparatus is defined along a cylindrical surface for generating a magnetic field on the inner side of the front layer.

FIG. 22D shows a switchable magnetic apparatus 100 wherein the front layer 102 is defined on a cylindrical surface perpendicular to the radially inward target direction 106, and with a plurality of alternating front-layer poles defined thereon in a plurality of circular patterns. The rear layer 104 is on the outer side of the front layer 102.

Figure 22E:
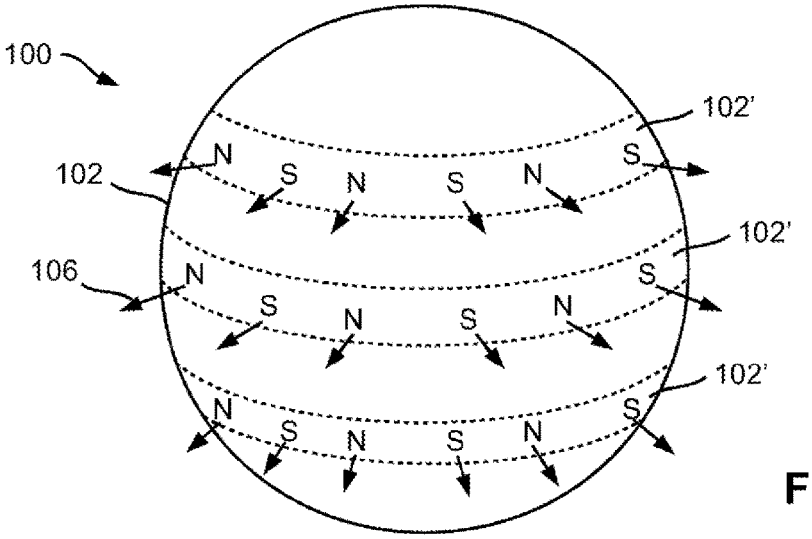
FIG. 22E is a schematic perspective view of a switchable magnetic apparatus according to some embodiments of the present disclosure, wherein the front layer of the switchable magnetic apparatus is defined along a spherical surface.

FIG. 22E shows a switchable magnetic apparatus 100 wherein the front layer 102 is defined on a spherical surface perpendicular to the radially outward target direction 106, and with a plurality of alternating front-layer poles defined thereon in a plurality of circular patterns 102'. The rear layer 104 is inside the front layer 102.

Those skilled in the art will appreciate that the embodiments shown in FIGS. 22A to 22E (and other embodiments disclosed herein) are for illustrative purpose only, and other variants are readily available. For example, in some embodiments, the front layer 102 may be defined by a portion of the surfaces shown in FIGS. 22A to 22E (such as, the front layer 102 may be defined by a portion of a cylindrical surface or a portion of a spherical surface).

In some embodiments, the total number of front-layer and rear-layer magnets 102A and 104A in the front and rear layers 102 and 104 is greater than or equal to three (3). Moreover, in embodiments where the front layer 102 comprises one or more front-layer magnets 102A interleaved with one or more ferromagnetic blocks 102B, the total number of the front-layer magnets 102A and the ferromagnetic blocks 102B is greater than or equal to three (3).

Figure 23:
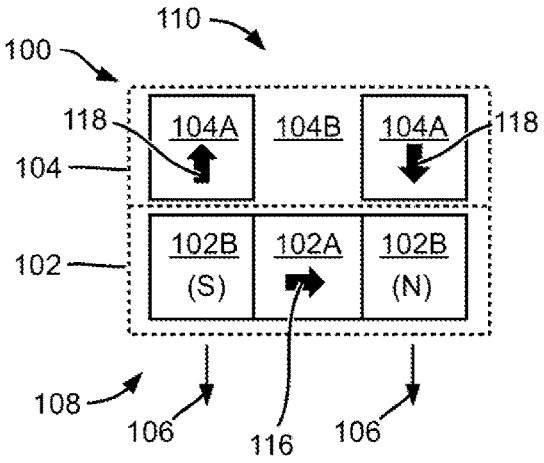
FIG. 23 is a schematic side view of a switchable magnetic apparatus in the ON state, according to some embodiments of the present disclosure, wherein the front layer comprises one magnet and the rear layer comprises two magnets.

FIG. 23 shows a switchable magnetic apparatus 100 wherein the front layer 102 thereof comprises one front-layer magnet 102A and two ferromagnetic blocks 102B, and the rear layer 104 comprises two rear-layer magnets 104A overlapping the two ferromagnetic blocks 102B along the target direction 106.

Figure 24:
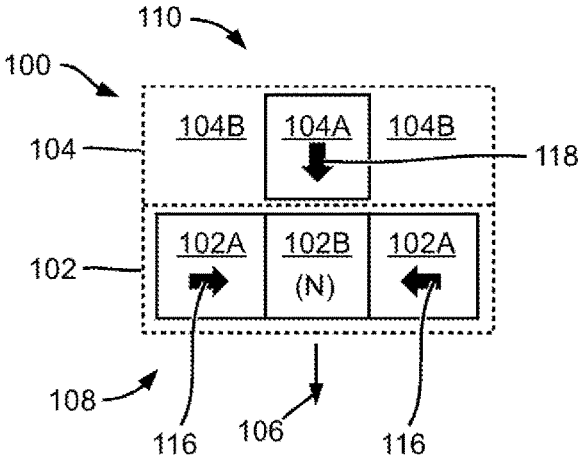
FIG. 24 is a schematic side view of a switchable magnetic apparatus in the ON state, according to some embodiments of the present disclosure, wherein the front layer comprises two magnets and the rear layer comprises one magnet.

FIG. 24 shows a switchable magnetic apparatus 100 wherein the front layer 102 thereof comprises two front-layer magnets 102A sandwiching one ferromagnetic block 102B, and the rear layer 104 comprises one rear-layer magnet 104A overlapping the ferromagnetic block 102B along the target direction 106.

In some embodiments, the directional magnetic field may be strengthened by using an additional ferromagnetic layer.

Figure 25:
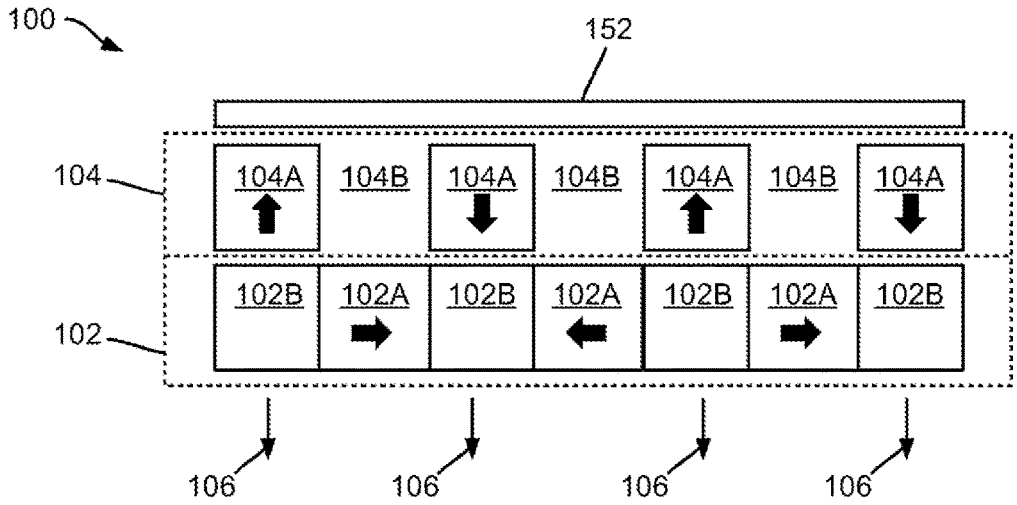
FIG. 25 is a schematic side view of a switchable magnetic apparatus in the ON state, according to some embodiments of the present disclosure, wherein the switchable magnetic apparatus comprises a ferromagnetic layer coupled to the rear side of the rear layer.

For example, FIG. 25 shows a switchable magnetic apparatus 100 in the ON state, according to some embodiments of this disclosure, wherein the switchable magnetic apparatus 100 further comprises a ferromagnetic layer 152 such as a steel plate coupled to the rear side of the rear layer 104.

Figure 26A:
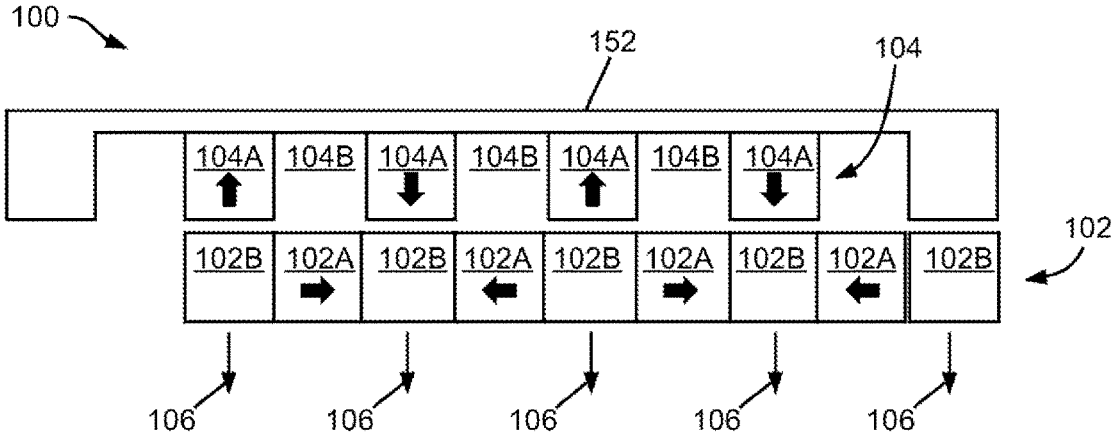
FIGS. 26A and 26B are schematic side views of a switchable magnetic apparatus in the ON state (FIG. 26A) and the OFF state (FIG. 26B), respectively, according to some embodiments of the present disclosure, wherein the switchable magnetic apparatus comprises a ferromagnetic layer coupled to the rear side of the rear layer, and the ferromagnetic layer comprises extrusions extending into the opposite sides of the rear layer.
Figure 26B:
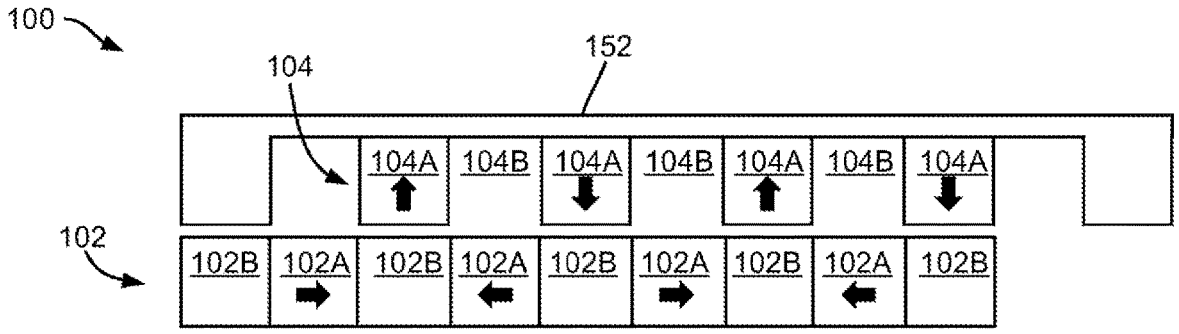

FIGS. 26A and 26B show a switchable magnetic apparatus 100 in some embodiments, wherein FIG. 26A shows the switchable magnetic apparatus 100 in the ON state and FIG. 26B shows the switchable magnetic apparatus 100 in the OFF state. As shown, the ferromagnetic layer 152 comprises extrusions extending into the opposite sides of the rear layer 104. The extrusions allow a magnetic flux circuit to be made with the rear layer 104 and the ferromagnetic block 102B that is not overlapped by a rear-layer magnet 104A.

Figure 27:
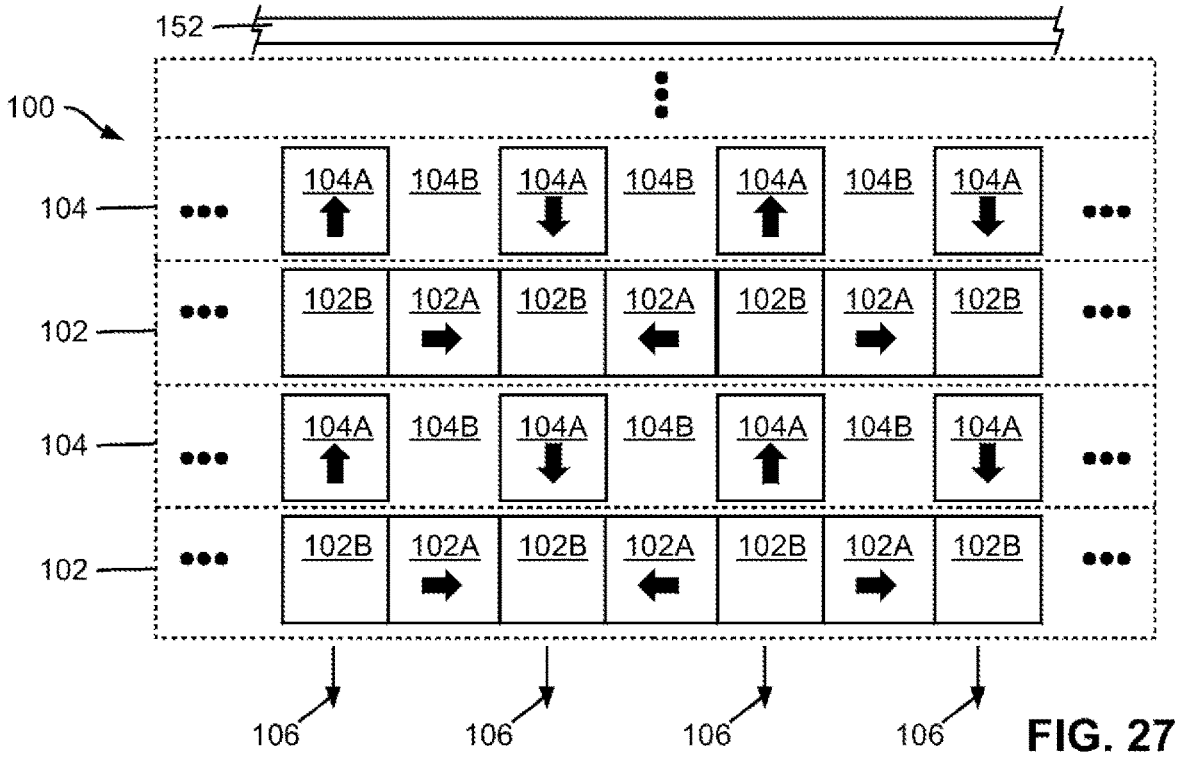
FIG. 27 is a schematic side view of a switchable magnetic apparatus in the ON state, according to some embodiments of the present disclosure, wherein the switchable magnetic apparatus comprises a plurality pairs of front and rear layers, and a ferromagnetic layer coupled to the rearmost one of the plurality pairs of front and rear layers.

FIG. 27 shows a switchable magnetic apparatus 100 in some embodiments. The switchable magnetic apparatus 100 in these embodiments is similar to that shown in FIG. 8 except that in these embodiments, the switchable magnetic apparatus 100 further comprises a ferromagnetic layer 152 coupled to the rearmost one of the plurality pairs of front and rear layers 102 and 104. The ferromagnetic layer 152 may be similar to that shown in FIG. 25 or FIG. 26A.

Figure 28:
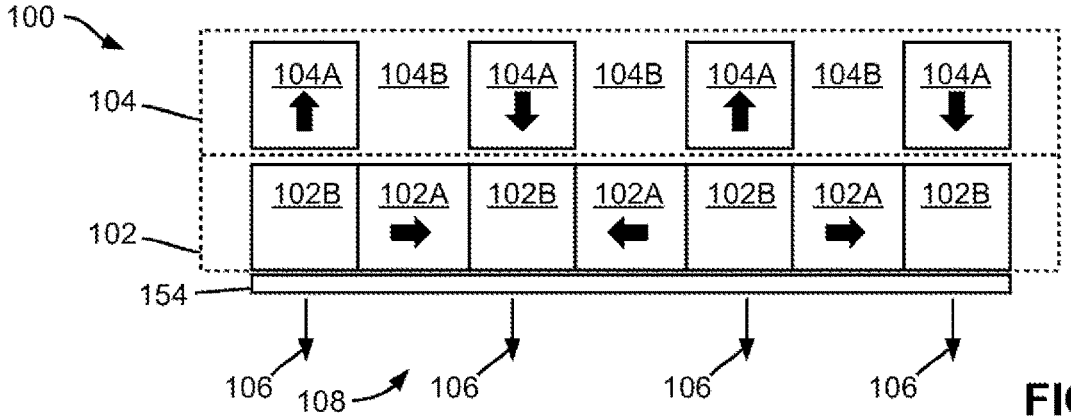
FIG. 28 is a schematic side view of a switchable magnetic apparatus according to some embodiments of the present disclosure, wherein the switchable magnetic apparatus comprises a ferromagnetic layer coupled to the front side of the front layer.

FIG. 28 shows a switchable magnetic apparatus 100 in some embodiments. The switchable magnetic apparatus 100 in these embodiments is similar to that shown in FIGS. 2A and 2B except that in these embodiments, the switchable magnetic apparatus 100 further comprises a ferromagnetic layer 154 in the form of a thin plate coupled to the front side (that is, the target side) of the front layer 102.

Figure 29:
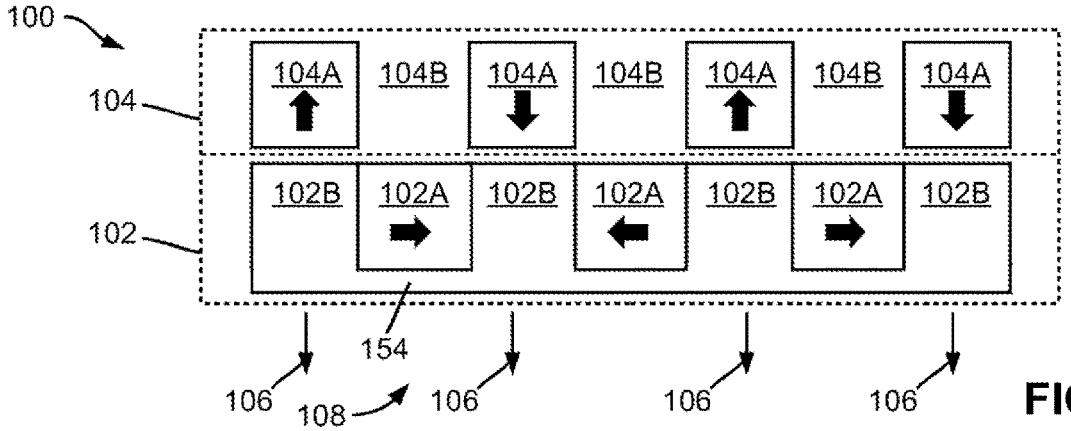
FIG. 29 is a schematic side view of a switchable magnetic apparatus in the ON state, according to some embodiments of the present disclosure, wherein the switchable magnetic apparatus comprises a ferromagnetic layer coupled to the front side of the front layer and integrated with the ferromagnetic blocks of the front layer.

FIG. 29 shows a switchable magnetic apparatus 100 in some embodiments. The switchable magnetic apparatus 100 in these embodiments is similar to that shown in FIG. 28 except that in these embodiments, the ferromagnetic layer 154 is integrated with the front layer 102 and becomes a part thereof.

In some embodiments, the housing may comprise a mechanism for locking and releasing the ON/OFF states. This may be advantageous in cases of instability in either the ON or OFF state.

In some embodiments, the switchable magnetic apparatus may be remotely actuated with an automated actuation device. The automation may be of forms such as a simple remote control, an external wiring, or paired with a phone in the form of an app.

In some embodiments, sensors may be embedded in the switchable magnetic apparatus to relay a signal to communicate the state of the apparatus (such as ON, OFF, defective, and/or the like).

In some embodiments, two switchable magnetic apparatuses 100A and 100B may be used to interact with each other. One switchable magnetic apparatus 100A may be fastened or otherwise coupled to a work-piece while the second switchable magnetic apparatus 100B magnetically connects to the first apparatus 100A. This may allow for engagement between the magnetic apparatus and a non-ferromagnetic work-piece. In another embodiment, two switchable magnetic apparatuses 100 may engage with each other via a non-ferromagnetic work-piece in between. In this embodiment, the two apparatuses may create a clamping force to connect to the non-ferromagnetic work-piece.

Figure 30:
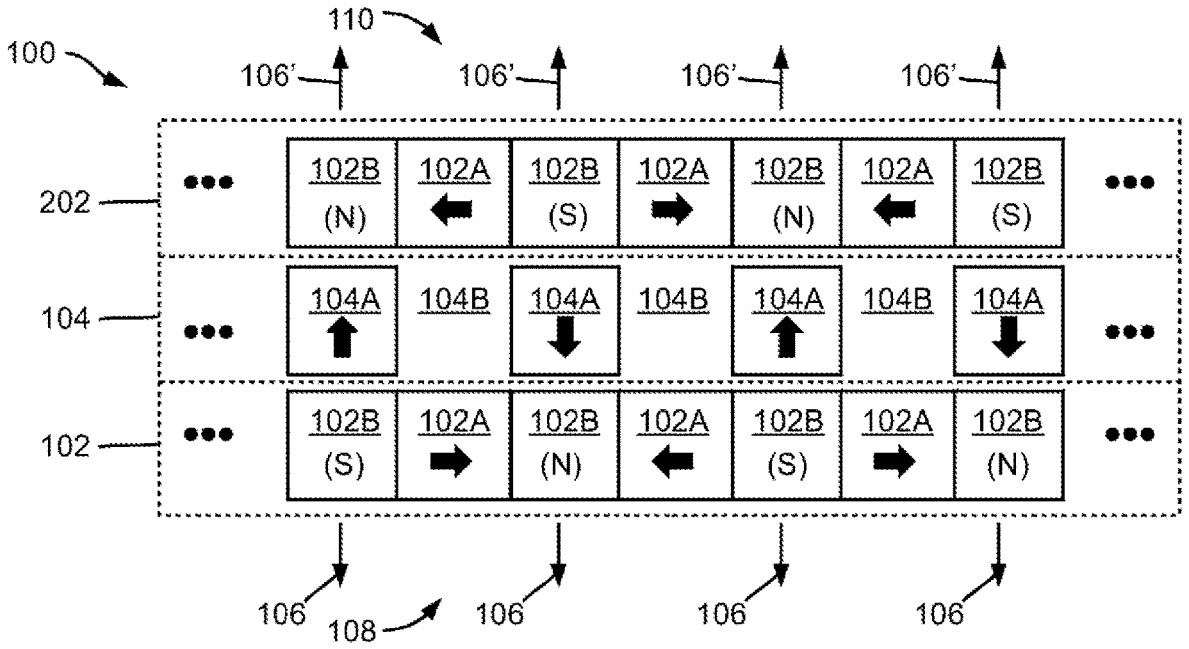
FIG. 30 is a schematic side view of a switchable magnetic apparatus in the ON state, according to some embodiments of the present disclosure, wherein the switchable magnetic apparatus generates magnetic fields on opposite sides in the ON state.

FIG. 30 shows a switchable magnetic apparatus 100 in some embodiments. The switchable magnetic apparatus 100 in these embodiments is similar to that shown in FIGS. 2A and 2B except that in these embodiments, the switchable magnetic apparatus 100 further comprises a second "front" layer 202 on the rear side of the rear layer 104, and both the front and rear sides 108 and 110 are the target sides. The alternating polarities of the magnets 102B of the second "front" layer 202 are reversed compared to those of the magnets 102B of the front layer 102, and thus the poles defined on the second "front" layer 202 are reversed compared to those defined on the front layer 102, such that the magnetic fields on the front and rear sides may be synchronously turned ON and OFF.

Figure 31A:
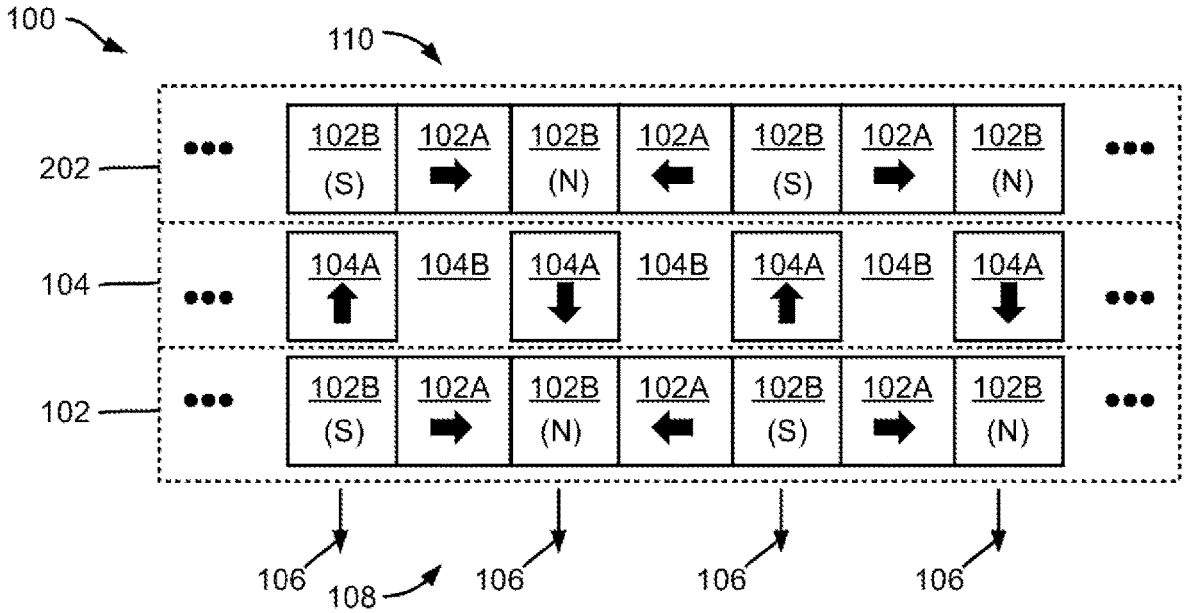
FIGS. 31A and 31B are schematic side views of a switchable magnetic apparatus according to some embodiments of the present disclosure, wherein the switchable magnetic apparatus generates a first magnetic field on a first side in the first state (FIG. 31A) and generates a second magnetic field on a second side in the second state (FIG. 31B)
Figure 31B:
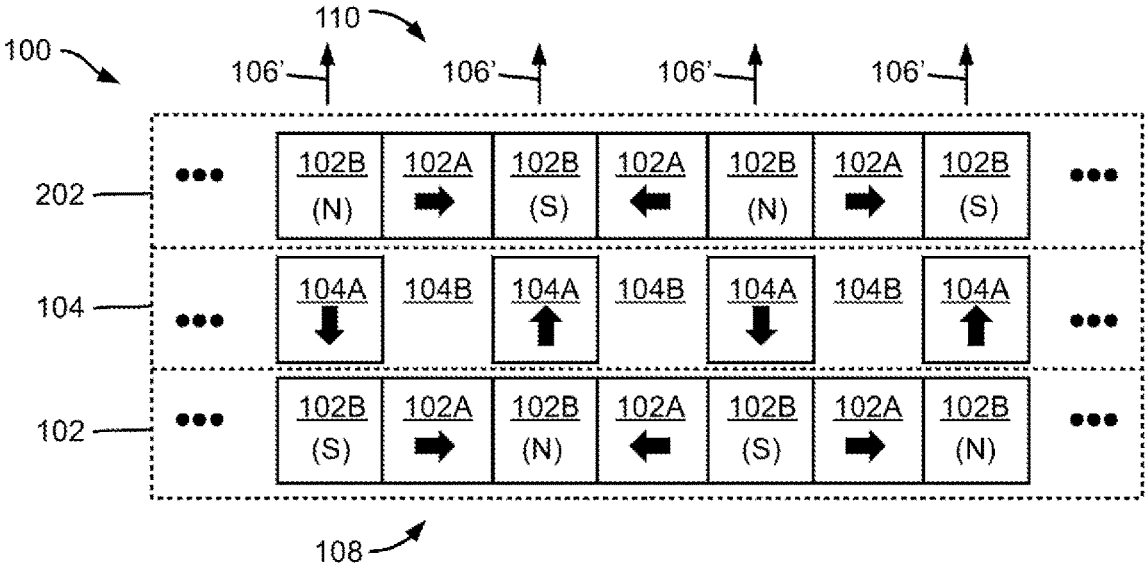

FIGS. 31A and 31B show a switchable magnetic apparatus 100 in some embodiments. The switchable magnetic apparatus 100 in these embodiments is similar to that shown in FIG. 30 except that in these embodiments, the alternating polarities of the magnets 102B of the second "front" layer 202 are the same as those of the magnets 102B of the front layer 102, and thus the poles defined on the second "front" layer 202 are the same as those defined on the front layer 102, such that the magnetic fields on the front and rear sides may be alternatively turned ON and OFF (that is, when the magnetic field on the front side is ON, that on the rear side is OFF; when the magnetic field on the front side is OFF, that on the rear side is ON).

Figure 32:
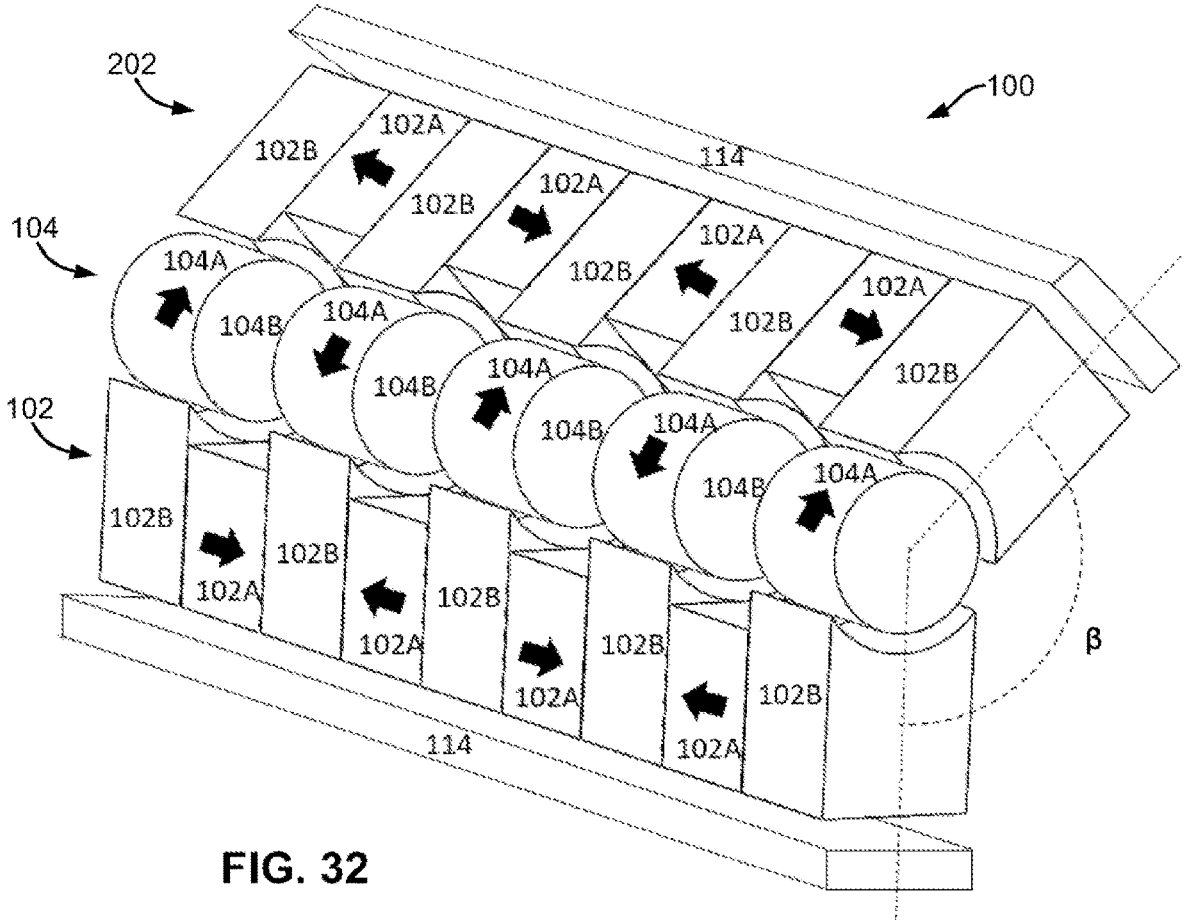
FIG. 32 is a schematic perspective view of a switchable magnetic apparatus according to some embodiments of the present disclosure, wherein the switchable magnetic apparatus comprises two front layers at an angle with respect to a "rear" layer sandwiched therebetween.

FIG. 32 shows a switchable magnetic apparatus 100 in some embodiments. The switchable magnetic apparatus 100 in these embodiments is similar to that shown in FIG. 30 except that in these embodiments, the two front layer 102 and 202 are at an angle $\beta$ with respect to the rear layer 104 (for example, the angle is an obtuse angle and $\beta \neq 180°$). In some embodiments, the two front layer 102 and 202 may be rotatable with respect to the rear layer 104 for adjusting the angle $\beta$.

Figure 33:
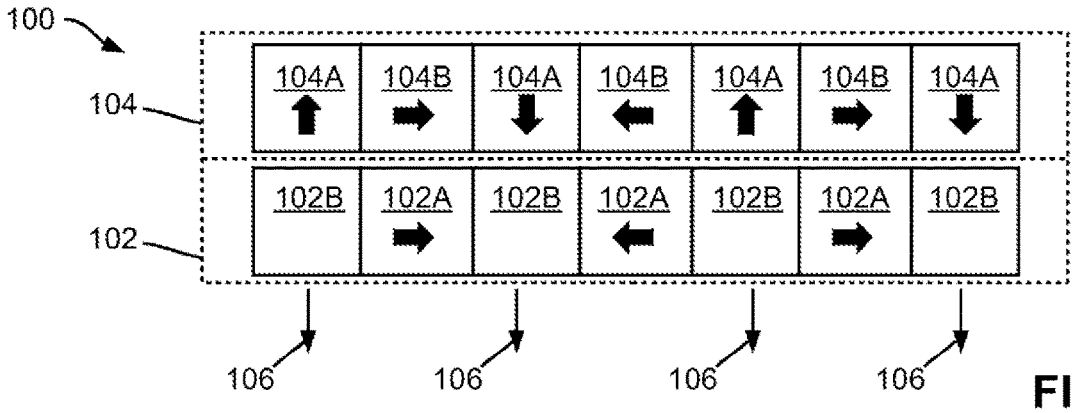
FIG. 33 is a schematic side view of a switchable magnetic apparatus according to some embodiments of the present disclosure, wherein the rear layer of the switchable magnetic apparatus is a Halbach array.

FIG. 33 shows a switchable magnetic apparatus 100 in some embodiments. The switchable magnetic apparatus 100 in these embodiments is similar to that shown in FIGS. 2A and 2B except that in these embodiments, the non-ferromagnetic blocks 104B of the rear layer 104 are replaced with magnet blocks (also identified using reference numeral 104B) with polarities in the same plane of the rear layer 104 such that the magnets 104A and 104B of the rear layer thus form a Halbach array. In the ON state, the polarity of each magnet block 104B is aligned with that of the front-layer magnet 102A overlapped therewith, and therefore, the polarities of the magnet blocks 104B is alternating in a same manner as those of the front-layer magnets 102A. The switchable magnetic apparatus 100 in these embodiments may be switched ON and OFF in a manner similar to those described above.

Figure 34:
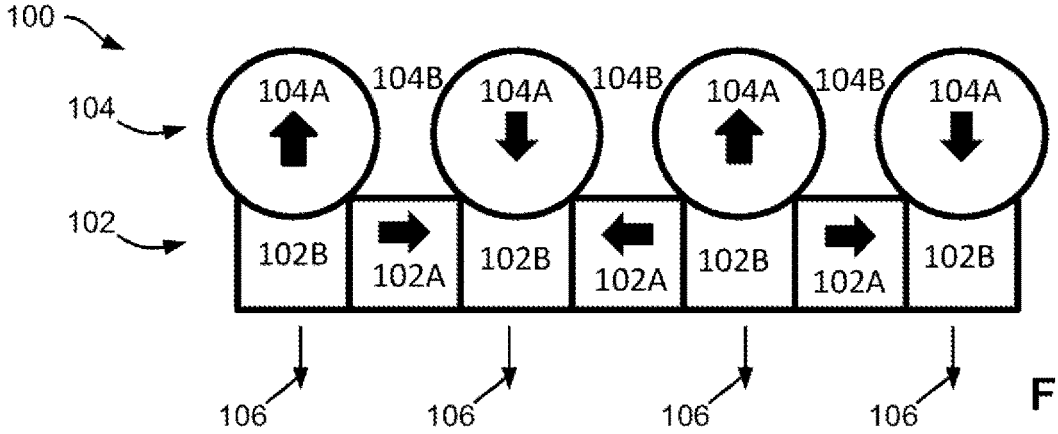
FIG. 34 is a schematic side view of a switchable magnetic apparatus according to some embodiments of the present disclosure, wherein the rear layer of the switchable magnetic apparatus comprises circular rear-layer magnets partially buried into the front layer.

In some embodiments as shown in FIG. 34, the rear-layer magnets 104A may be partially buried into the ferromagnetic block 102B of the front layer 102.

In some embodiments, the rear-layer magnets 104A may only overlap a portion of the poles defined on the front layer 102. In other words, the number of the rear-layer magnets 104A is less than that of the poles defined on the front layer 102.

Figure 35:
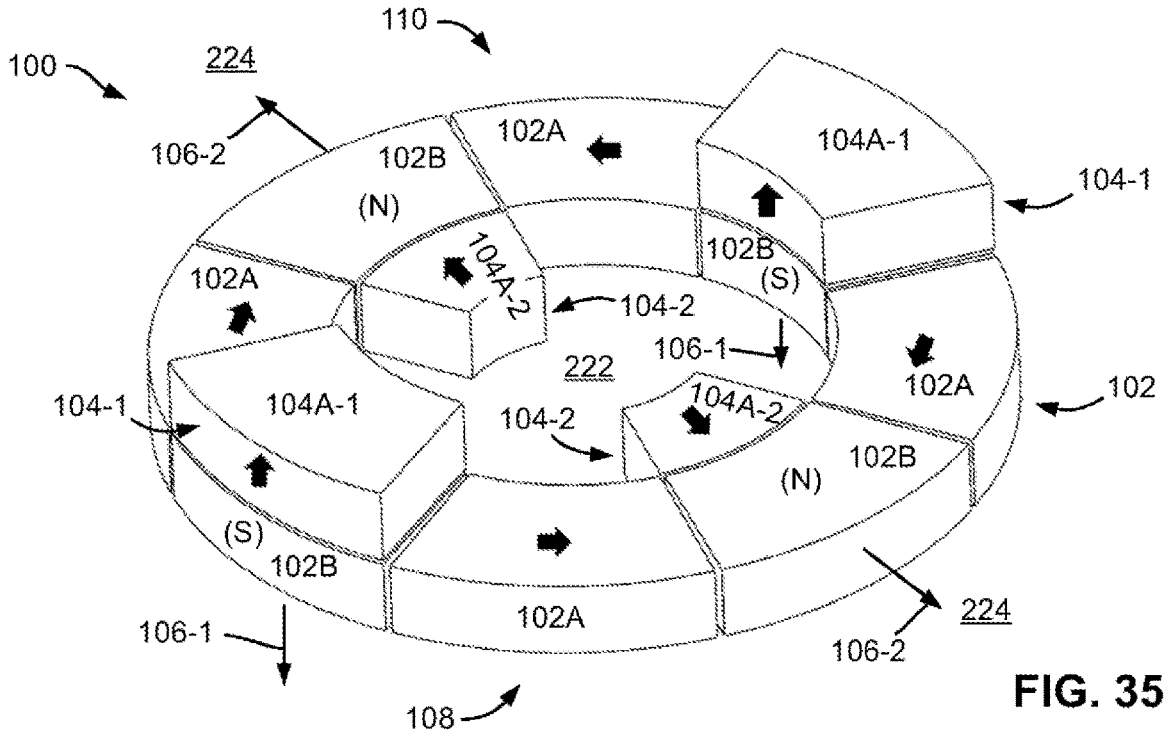
FIG. 35 is a schematic perspective view of a switchable magnetic apparatus having two rear layers, according to some embodiments of the present disclosure.

In some embodiments shown in FIG. 35, the front-layer magnets 102A and the ferromagnetic blocks 102B of the front layer 102 are arranged in a ring pattern. The switchable magnetic apparatus 100 in these embodiments comprises a first "rear" layer 104-1 on the rear side 110 with first rear-layer magnets 104A-1 overlapping a first portion of the poles defined on the front layer 102 (which are a first portion of ferromagnetic blocks 102B) for generating a first magnetic field along a first target direction 106-1 on a first target side (which is the front side 108 of the front layer 102).

The switchable magnetic apparatus 100 also comprises a second "rear" layer 104-2 on the inner side 222 with second rear-layer magnets 104A-2 overlapping a second portion of the poles defined on the front layer 102 (which are a second portion of ferromagnetic blocks 102B) for generating a second magnetic field along a second target direction 106-2 on a second target side (which is the outer side 224 of the front layer 102). In these embodiments, no two first and second rear-layer magnets 104A-1 and 104A-2 overlap with a same ferromagnetic block 102B on the front layer 102.

Figure 36:
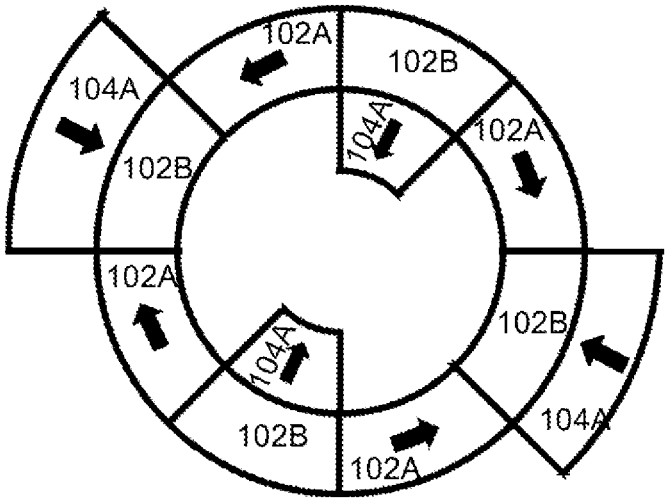
FIG. 36 is a schematic perspective view of a switchable magnetic apparatus having two rear layers, according to yet some embodiments of the present disclosure.

In some embodiments, the rear layer 104 may be broken up to have some of the rear-layer magnets 104A on one side of the front layer 102 and some other rear-layer magnets 104A being on one or more opposite or adjacent sides of the front layer 102. FIG. 36 shows the separated rear-layer magnets 104A being on opposite sides of the front layer 102, where one or more work-pieces 106 may be on either or both sides of the plane defined by the front-layer and rear-layer magnets 102A and 104A (that is, "above" and/or "below" the paper in FIG. 36).

Figure 37:
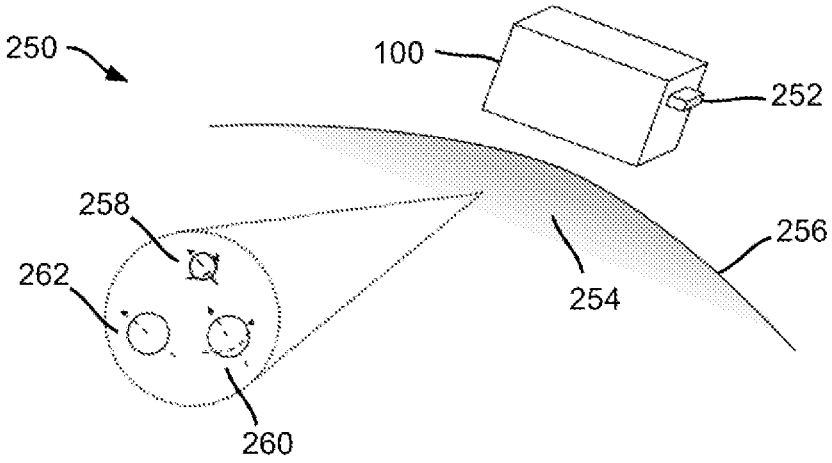
FIG. 37 is a schematic diagram showing a switchable magnetic apparatus used to modulate polarization in materials, according to some embodiments of the present disclosure.

FIG. 37 shows a magnet apparatus 100 used to modulate polarization in materials 250, such as in applications of nuclear magnetic resonance (NMR), vaporized atomic gases, or magnetic relaxometry. A switch or lever 252 is coupled to the switchable magnetic apparatus 100 for turning the switchable magnetic apparatus 100 ON and OFF. Such an apparatus 100 may be used to align polarization in materials or may be used to perturb the polarization of materials using the switch 252, an effect which may be measured to infer properties of a material. The particles 254 in the material 250 bounded by an arbitrary contour 256 (i.e. skin or glass), may be of any physical state (i.e. liquid or gas). NMR and NMR imaging often utilizes magnetic fields to spin polarize protons 258 (not drawn to scale) and measure the contrast between their behavior in varying conditions. Vaporized atomic gases, such as Rubidium and Cesium 260, are often spin polarized using magnetic fields, where the measurement of their behavior may be used for extremely sensitive magnetic field detection. Magnetic relaxometry may utilize magnetic fields to align ferrous nanoparticles 262 for use in imaging their behaviors in varying conditions. The magnetic apparatus 100 may be switched ON during use and may be switched OFF when not being used, a case in which it will not generate potentially harmful forces on nearby magnetic objects.

The switchable magnetic apparatus 100 may be used in various applications. For example, the switchable magnetic apparatus 100 may be used in apparatuses, parts, and/or components for releasably and reliably securing weight plates in their predefined positions of a fitness device and preventing unwanted axial shift of the weight plates from their predefined positions.

As those skilled in the art understand, a fitness device such as a bar-plate assembly usually comprises a plurality of removable weights or plates for selectively positioning on opposite end portions of an elongated lifting bar. The removable plates are often releasably retained in place by fixed inner and removable outer weight-retention members or collars. Outer collars are slidably received on the bar and releasably secured in fixed position thereon by suitable locking devices, such as set screws.

It is essential that the removable weights be releasably but reliably secured in fixed position relative to the bar so that the risk of axial movement between the weights and the bar is substantially eliminated. Any substantial user-manipulated tilting of the bar from its normally horizontal exercising position may cause the weight or weights at the lower end of the tilted bar to exert an axially outward force on an associated outer weight retaining collar and toward a free end of the bar.

Such a tilting motion may cause the weights at the lower end of the bar to impact upon the associated outer retaining collar, thereby causing risk of loosening, if not dislodging the outer weight retaining collar from the bar. A sudden loss of weight at one end of the bar can result in serious injury to the user.

In some embodiments, a switchable magnetic apparatus 100 may be used as an engagement component and located at or about the interface of a weight plate and a mounting structure such as an elongated bar. When activated, the switchable magnetic apparatus 100 applies a magnetic force along a radial direction to press the weight plate against the mounting structure thereby releasably and reliably securing the weight plate in position and preventing any axial and/or rotational movement thereof. The switchable magnetic apparatus 100 may also be deactivated for releasing the weight plate from the elongated bar.

Thus, the fitness device using switchable magnetic apparatus 100 obviates or mitigates at least one disadvantage of the conventional weight-plate securing methods by immobilizing or securing the weight plate by using a switchable magnetic component in which the magnetic force may be controllably activated and radially directed through the bar, or deactivated allowing the weights to freely slide along the axial direction and remove from the bar. Therefore, no external means of securement is required for immobilizing the weight plate.

Figure 38A:
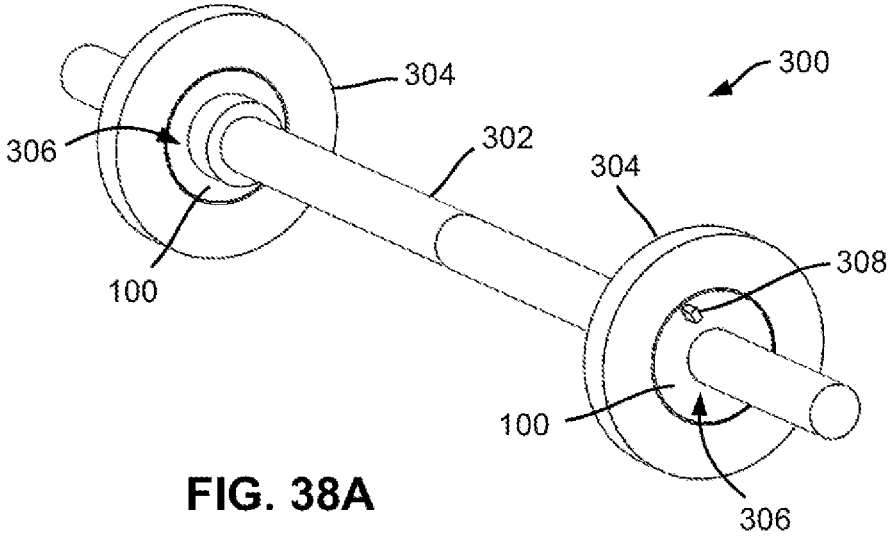
FIG. 38A is a schematic perspective view of a bar-weight assembly comprising a pair of switchable magnetic apparatuses, according to some embodiments of the present disclosure.

FIG. 38A shows an example of a bar-plate assembly 300 comprising a base structure 302 such as an elongated cylindrical lifting bar and a plurality of weight plates 304. The lifting bar 302 comprises one or more ferromagnetic components such as one or more steel components at least at two points of securement 306 for releasably coupling to the plurality of weight plates 304.

Figure 38B:
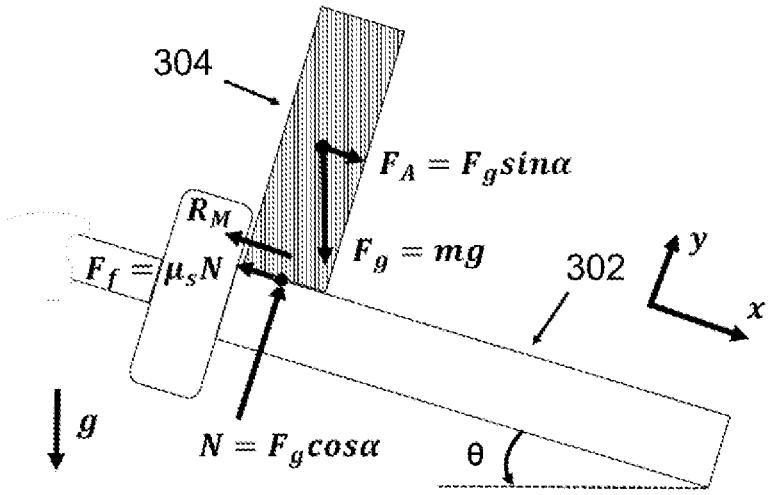
FIG. 38B is a diagram of forces in the tilted bar assembly shown in FIG. 38A.

In these embodiments, magnetic methods are used to secure the weight plates 304 on the bar 302 at the point of securement 306. A force diagram (free-body diagram) of a tilted bar-weight assembly 300 is shown in FIG. 38B. The bar-weight assembly 300 is typically symmetrical and so the diagram depicts an arbitrary side of the bar assembly 300 at the point of securement 306. The sources of force are due to gravity, friction, and the magnetic securing assembly. The free-body diagram is static and thus the sum of the forces is zero. Equation (1) shows the balance of forces along the central axis of the bar 302 (i.e., the x-axis in FIG. 38B) which is the axis of motion in an improperly constrained bar-weight assembly 300.

$$\in F_x = F_A - F_f - R_M = 0 \quad (1)$$

where, $$F_A = F_g \sin\alpha = mg \sin\alpha \quad (2)$$

$$F_f = \mu_s N = \mu_s F_g \cos\alpha = \mu_s mg \cos\alpha \quad (3)$$

Here, $F_A$ is the applied force from tilt. $F_f$ is the force from friction between the plate 304 and bar 302. $R_M$ is the reaction force from the magnetic switch that brings the sum of forces to zero thereby preventing relative motion of the weight 304 and the bar 302. $F_g$ is the force of gravity on the weighted plate, and g is the acceleration due to gravity. m is the mass of the weighted plate. θ is the angle of tilt. $\mu_s$ is the coefficient of static friction between the plate 304 and bar 302. N is the normal force. Embodiments herein focus on presenting a device which produces a magnetic reaction force, Rm, which is sufficient to hold maximum force in the system, which is at θ=90°, and $F_A = F_g$ (typically largest plate is 45 lbs).

As will be described in more detail below, securement may be accomplished by a magnet or magnet array. The activation of the magnets results in a magnetic force pressing the weight plates 304 to the bar 302 and therefore securing the weight plates 304 thereto. The magnet array may consist of a unique pattern of permanent magnet, ferromagnetic, non-ferromagnetic, and electromagnetic elements.

The magnetic device may be activated and deactivated by the relative movement or rearrangement of permanent magnet, electromagnetic, or ferromagnetic elements. This may be conducted by radial, circumferential, rotational, or other movement of such components.

Figure 39:
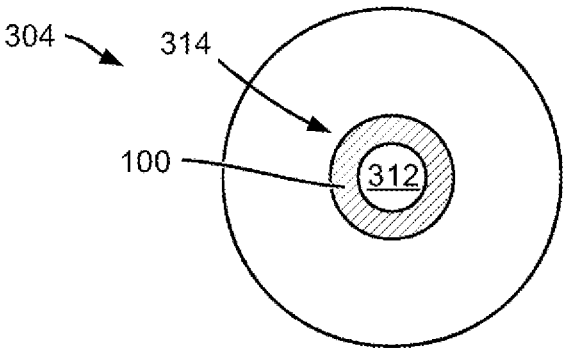
FIG. 39 is a schematic cross-sectional view of a weight plate shown in FIG. 38A, the weight plate comprising a switchable magnetic device.

As shown in FIG. 39, the weight plate 304 comprises a central bore 312 for passing the lifting bar 302 therethrough to engage the weight plate 304 thereto, and a securement structure 314 about the central bore 312. The securement structure 314 comprises a switchable magnetic apparatus 100 such as that shown in FIGS. 14A and 14B. As shown in FIG. 38A, a lever 308 is coupled to the switchable magnetic apparatus 100 for turning the switchable magnetic apparatus 100 ON and OFF.

When the weight plate 304 is coupled to the lifting bar 302 and the switchable magnetic apparatus 100 is switched to the ON state, the switchable magnetic apparatus 100 generates magnetic flux radially inwardly into the lifting bar 302 to create the radially attractive securement force Rm. FIG. 40 shows the force diagram (free-body diagram) of a tilted bar-weight assembly 300 when the switchable magnetic apparatus 100 is switched to the ON state.

When switchable magnetic apparatus 100 is switched to the OFF state, the radially inward magnetic flux is removed thereby deactivating the securement force Rm (i.e., eliminating the securement force or reducing the securement force to a negligible level or to a level insufficient for securing the weight plate 304) to allow the weight plate 304 to be removed from the lifting bar 302.

Those skilled in the art will appreciate that, instead of using the switchable magnetic apparatus 100, other switchable magnetic apparatuses may be used in the weight plate 304 for releasably securing the weight plate 304 to the lifting bar 302. For example, FIGS. 41A and 41B show a switchable magnetic apparatus 320 for coupling to the weight plate 304 about the bore 312 thereof. The switchable magnetic apparatus 320 comprises an outer ring 322, an intermediate ring structure 324, and an inner ring structure 326 forming the bore 312.

The intermediate ring structure 324 is rotatable relative to the outer and inner rings 322 and 326 between an ON position for activating an attractive magnetic force to the lifting bar 302 and an OFF position for deactivating the attractive magnetic force.

The outer ring 322 comprises a ferromagnetic switch-off arc 332.

The intermediate ring 324 comprises a magnetic arc 334 having a plurality of permanent magnets 336 circumferentially distributed therein and spaced by one or more mid-piece ferromagnetic magnetic-flux guides 338A (e.g., the magnetic arc 334 comprising four (4) magnets 336 units spaced by two mid-piece ferromagnetic magnetic-flux guides 338A as shown in FIGS. 41A and 41B). The magnetic arc 334 also comprises two end-piece ferromagnetic magnetic-flux guides 338B on opposite circumferential ends thereof. The angular span or width of the magnetic arc 334 is substantially equal to that of the switch-off arc 332 of the outer ring 322.

The magnets 336 may be made of any suitable magnetic materials. For example, in some embodiments, the magnets 336 may be N52-grade magnets with rectangular cross-sections. In some other embodiments, the magnets 336 may comprise other permanent magnet materials such as NdFeB, NiCo, and/or the like. In some other embodiments, the magnets 336 may be electromagnets.

Each magnet 336 may comprise one or more magnet units with aligned magnetic poles. Moreover, the magnetic poles of the magnets 336 are arranged in alternating polarities along the circumferential direction as indicated by the arrows 340. In other words, starting from any circumferential end of the magnetic arc 334, the polarities of the odd-numbered magnets are opposite to those of the even-numbered magnets (e.g., N-S, S-N, N-S, S-N, . . . ; or S-N, N-S, S-N, N-S, . . . ). Such an alternating polarity arrangement facilitates the magnetic fields to pass into the lifting bar 302 (not shown).

In these embodiments, the intermediate ring 324 of the securement structure 314 further comprises a non-ferromagnetic bracket (not shown) coupled to the magnet arc 334 for rotating the magnet arc 334 between the ON and OFF positions.

The inner ring 326 comprises a switch-off arc 342 and a switch-on arc 344 spaced by a non-ferromagnetic spacer 346. The switch-off arc 342 is at an angular position corresponding to that of the switch-off arc 332 of the outer ring 322 with an angular span equal to that of the switch-off arc 332. The switch-on arc 344 has an angular span equal to that of the magnetic arc 334 of the intermediate ring 324 and comprises a plurality of ferromagnetic blocks 352 and a plurality of non-ferromagnetic spacers 354 alternately arranged along the circumferential direction. Each ferromagnetic block 352 corresponds to a respective magnetic-flux guide 338 of the magnetic arc 334 of the intermediate ring 324 and has an angular width equal to that of the corresponding magnetic-flux guide 338. Each non-ferromagnetic spacer 354 corresponds to a respective magnet 336 of the magnetic arc 334 of the intermediate ring 324 and has an angular width equal to that of the corresponding magnet 336.

When the magnetic arc 334 of the intermediate ring 324 is at the ON position, the magnetic arc 334 is angularly offset from the switch-off arcs 332 and 342 of the outer and inner rings 322 and 326, and is angularly aligned with the switch-on arc 344 of the inner ring 326. More specifically, the magnets 336 of the magnetic arc 334 are aligned with the non-ferromagnetic spacers 354 of the switch-on arc 344 and the ferromagnetic magnetic-flux guides 338 of the magnetic arc 334 are aligned with the ferromagnetic blocks 352 of the switch-on arc 344, thereby directing magnetic flux radially inwardly through the non-ferromagnetic sleeve 364 into the lifting bar 302 to create the radially attractive securement force Rm.

When the magnetic arc 334 of the intermediate ring 324 is at the OFF position, the magnetic arc 334 is angularly aligned with the switch-off arcs 332 and 342 of the outer and inner rings 322 and 326. The magnets 336 pass the magnetic flux through the ferromagnetic flux guides 338 into the switch-off arcs 332 and 342. The switch-off arcs 332 and 342 "short-circuit" the magnetic flux and thus deactivate the securement force Rill (i.e., eliminating the securement force or reducing the securement force to a negligible level or to a level insufficient for securing the weight plate 304).

Figure 42A:
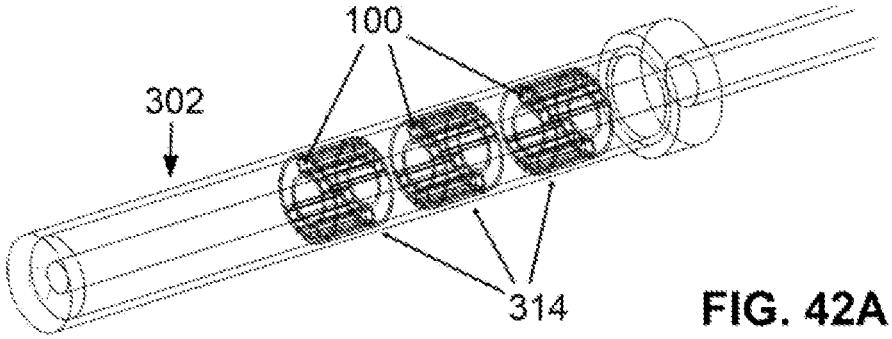
FIG. 42A is a schematic perspective view of a lifting bar shown in FIG. 38A, according to some embodiments of this disclosure, the lifting bar comprising one or more switchable magnetic devices.

In some embodiments, the securement structure 314 may be coupled to the lifting bar 302. As shown in FIG. 42A, the lifting bar 302 in these embodiments may comprise one or more securement structures 314 on opposite ends thereof with each securement structure 314 comprising a switchable magnetic apparatus 100 such as that shown in FIGS. 15A and 15B. The weight plate 304 comprises a ferromagnetic material at least about the bore 312 thereof.

When the weight plate 304 is coupled to the lifting bar 302 and the switchable magnetic apparatus 100 is switched to the ON state, the switchable magnetic apparatus 100 generates magnetic flux radially outwardly into the weight plate 304 to create the radially attractive securement force Rm. When switchable magnetic apparatus 100 is switched to the OFF state, the radially outward magnetic flux is removed thereby deactivating the securement force Rm to allow the weight plate 304 to be removed from the lifting bar 302.

Figure 42B:
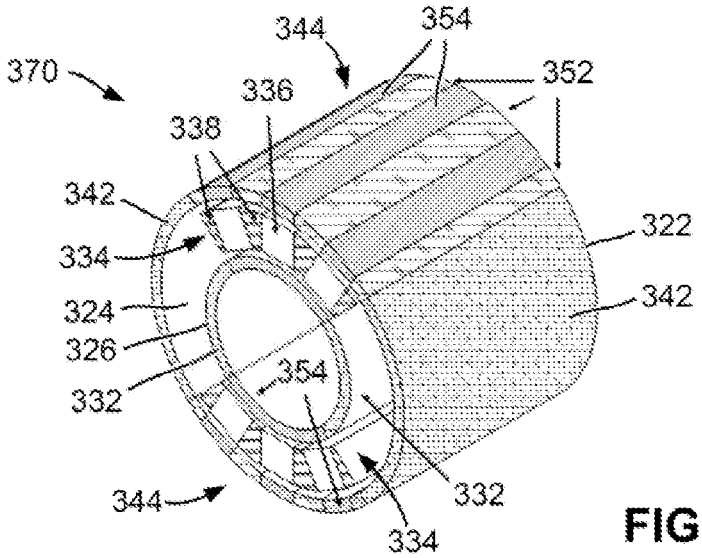
FIG. 42B is a schematic perspective view of a switchable magnetic device shown in FIG. 42A.

Those skilled in the art will appreciate that, instead of using the switchable magnetic apparatus 100, other switchable magnetic apparatuses may be used in the lifting bar 302 for releasably securing the weight plate 304 to the lifting bar 302. For example, FIG. 42B shows a switchable magnetic apparatus 370 for coupling to the lifting bar 302.

The switchable magnetic apparatus 370 comprises an outer ring 322, an intermediate ring structure 324, and an inner ring structure 326. The intermediate ring structure 324 is rotatable relative to the outer and inner rings 322 and 326 between an ON position for activating an attractive magnetic force to the lifting bar 302 and an OFF position for deactivating the attractive magnetic force.

In these embodiments, the rings 322 to 326 have a symmetric structure. In particular, the inner ring 322 comprises two ferromagnetic switch-off arcs 332 at symmetric positions with respect to the center or origin of the inner ring 322, wherein each switch-off arc 332 is similar to the switch-off arc 332 shown in FIG. 41A.

The intermediate ring 324 comprises two magnetic arcs 334 at symmetric positions with respect to the center or origin of the intermediate ring 324, wherein each magnetic arc 334 is similar to the magnetic arc 334 shown in FIG. 41A.

The outer ring 326 comprises two switch-off arcs 342 at symmetric positions with respect to the center or origin of the outer ring 326 and two switch-on arc 344 at symmetric positions with respect to the center or origin thereof, wherein each switch-off arc 342 is similar to the switch-off arc 342 shown in FIG. 41A and each switch-on arc 344 is similar to the switch-on arc 344 shown in FIG. 41A.

When the securement structure 314 is at the ON position as shown in FIG. 42B, magnetic flux from magnets 336 is guided through the magnetic flux guides 338, magnetic flux guides 352, and radially outwardly through the bar 302, creating a radially attractive securement force on the weighted plate 304 (not shown). When the securement structure 314 is switched to the OFF position, the switch-off arcs 332 and 342 "short-circuit" the magnetic flux and thus deactivate the securement force.

Figure 43A:
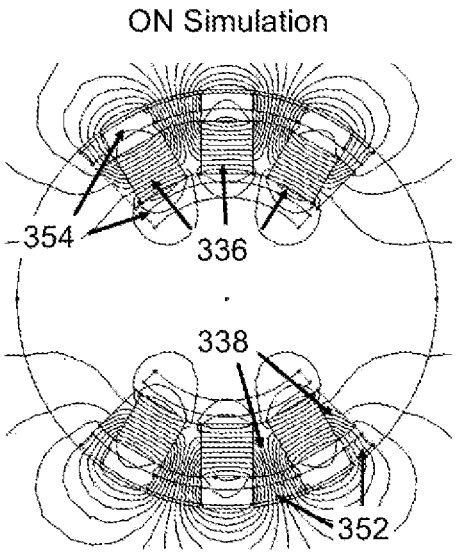
FIGS. 43A and 43B show the simulation results of the switchable magnetic device shown in FIG. 42B in the ON and OFF state, respectively.
Figure 43B:
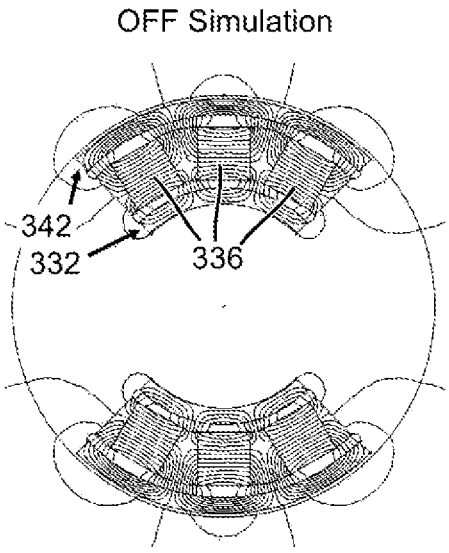

FIGS. 43A and 43B show the simulation results of the switchable magnetic apparatus 370 using the Finite Element Method Magnetics (FEMM) software authored by David Meeker of MA, USA. As shown in FIG. 43A, when the switchable magnetic apparatus 370 is in the ON state, the magnetic flux extends through ferromagnetic guides 338 and ferromagnetic guides 352, and radially extends out of the lifting bar 302. As shown in FIG. 43B, when the switchable magnetic apparatus 370 is in the OFF state, the magnetic flux extends outside the lifting bar 302 is significantly reduced as it is sent towards the opposing poles of the magnets 336 through the switch-off arcs 332 and 342.

In some embodiments, the securement structures 314 may be embedded in multiple members of the bar-plate assembly 300 such that the securement structures 314 may coordinate with each other to produce securement. For example, in one embodiment, the lifting bar 302 and each weight plate 304 may comprise a securement structure 314, wherein the magnets 336 of the weight plates 304 has an inversed polarity arrangement compared to that of the lifting bar 302. For example, the polarity arrangement of the securement structures 314 of the weight plates 304 may be N-S, S-N, N-S, S-N, . . . , and that of the securement structure 314 of the lifting bar 302 may be S-N, N-S, S-N, N-S, . . . . When the securement structures 314 of the lifting bar 302 and the weight plates 304 are activated, the combined magnetic forces would make up an enhanced securement force.

In some embodiments, the securement structure 314 may be implemented as a removable stopper attachable to the lifting bar 302 for constraining the movement of assembled weight plates 304. For example, in one embodiment, the lifting bar 302 may comprise a fixed stopper of any suitable type about each end thereof for delimiting the longitudinally inward movement of the weight plates 304 on the lifting bar 302. The lifting bar 302 may also comprise two removable stoppers each comprising a securement structure 314 for attaching to the lifting bar 302 on the longitudinal distal sides of the weight plates 304 for delimiting the longitudinally outward movement of the weight plates 304 on the lifting bar 302.

In some embodiments, the securement structure 314 may be installed on other fitness equipment systems such as pulley system equipment whereas the weights are vertically stacked on a post. The post may comprise a securement structure 314 removably attached to the post on top of the weights for immobilizing the weights in the user's desired sequence. Therefore, the traditional securing pin is not needed.

Figure 44A:
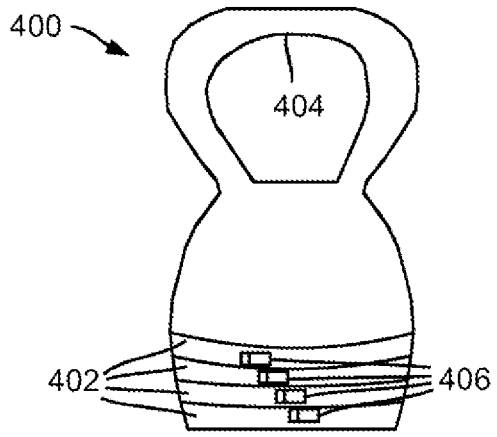
FIG. 44A is a schematic side view of a kettlebell having one or more weight components, each weight component comprising a switchable magnetic device.
Figure 44B:
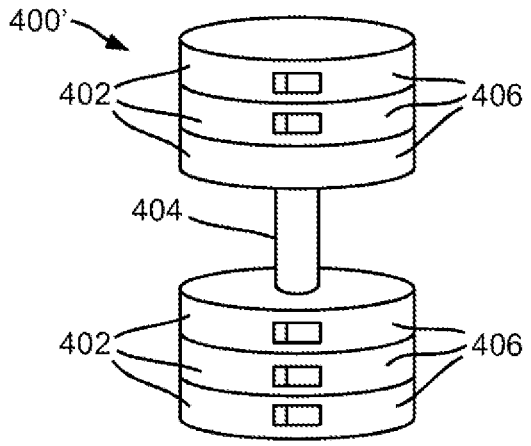
FIG. 44B is a schematic side view of a dumbbell having one or more weight components, each weight component comprising a switchable magnetic device.

In some embodiments as shown in FIGS. 44A and 44B, the securement structure 114 may be installed within devices such as kettlebells 400 or dumbbells 400' for securing a variety of weights 402 to the handle structure 404 (which is the base structure) having a ferromagnetic securement post (not shown). Each weight 402 comprises a securement structure 314 (not shown) having a suitable switchable magnetic apparatus 100 as described above (such as that shown in FIGS. 14A and 14B) and a switch 406 for activating the securement structure 314 to attach the weight 402 to the handle 404 or a previously attached weight 402, and for deactivating the securement structure 314 to remove the weight 402.

In some embodiments, the kettlebells 400 or dumbbells 400' may not comprise a securement post. In these embodiments, the base structure of the kettlebells 400 or dumbbells 400' may comprise a ferromagnetic component such as a ferromagnetic plate and each weight 402 may comprise a securement structure 314 having a suitable switchable magnetic apparatus 100 as described above (such as that shown in FIGS. 12A to 13B) for releasably coupling to the ferromagnetic component.

In the embodiments where the securement structure 314 is in the weight plate 304, the securement structure 314 may be activated or deactivated by means of a mechanical switching structure, such as a handle, lever, thumb switch, or the like, accessible from the outside of the weight plate 304. In the embodiments where the securement structure 314 is in the lifting bar 302 or post, the securement structure 314 may be activated or deactivated by a mechanical switching structure accessible on each end of the lifting bar 302 or post. In some embodiments such as those described above, the mechanical switching structure may be binary (ON or OFF).

In some other embodiments, the mechanical switching structure may be continuously variable, or incremental (such as steps of force), which, when actuated, may cause the magnetic arc 334 continuously or incrementally move between the switch-off position and the switch-on position. Therefore, when the magnetic arc 334 is at the switch-off position, the magnetic holding force is deactivated. When the magnetic arc 334 partially overlaps with the switch-on arc 344, the magnetic holding force is activated with a reduced strength determined by the overlapping between the magnets 336 of the magnetic arc 334 and the non-ferromagnetic spacers 354 of the switch-on arc 344 and the overlapping between the ferromagnetic blocks 338 of the magnetic arc 334 and the ferromagnetic blocks 352 of the switch-on arc 344.

When the magnetic arc 334 fully overlaps with the switch-on arc 344, the magnetic holding force is activated with the maximum strength.

Figure 45:
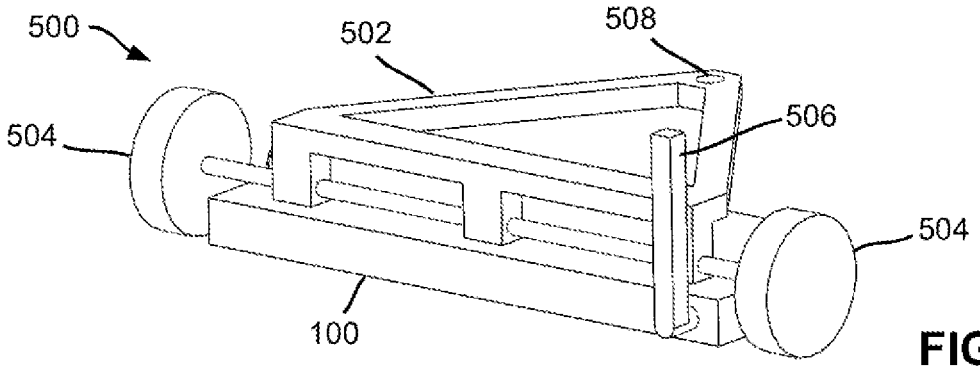
FIG. 45 is a schematic perspective view of a magnetic sweeper comprising a switchable magnetic apparatus, according to some embodiments of the present disclosure.

FIG. 45 shows a magnetic sweeper 500 to collect and remove foreign object debris (FOD) that may be attracted by magnetic forces. The magnetic sweeper 500 comprises a body 502 having a pair of wheels 504 and a switchable magnetic apparatus 100 (such as that shown in FIGS. 26A and 26B) on the bottom side thereof. A lever 506 is coupled to the switchable magnetic apparatus 100 for turning the switchable magnetic apparatus 100 ON and OFF. The magnetic sweeper 500 may be coupled to a driving vehicle (not shown) via the tow hitch 508. After switching the switchable magnetic apparatus 100 ON using the lever 506, the magnetic sweeper 500 may be towed to travel over a surface to remove FOD.

As those skilled in the art understand, applying force while moving translationally is used in fields such as connecting adhesives, holding components in place to allow fastening, and holding a tool on a work-piece where the tool may interact with the work-piece for conducting operations such as topographical scanning, cleaning, and non-destructive testing.

In some embodiments, the switchable magnetic apparatus 100, 320, or 370 may be used in apparatuses such as a pressure applicator for translating by rolling while continuously applying a controllable holding force to a ferromagnetic work-piece, to apply a force to an intermediate material to be held to the ferromagnetic work-piece, or to hold a tool in proximity with a ferromagnetic work-piece for the tool to interact therewith.

A roller assembly may be used to translate the pressure applicator with respect to the work-piece. In some embodiments, the roller assembly may maintain the switchable magnetic apparatus at a constant, predetermined distance from the work-piece. In some other embodiments, the roller assembly may allow the distance between the switchable magnetic apparatus and the work-piece to be controlled passively with a mechanism such as springs to keep the holding force constant. For example, the holding force may compress a spring until the spring force and holding force attain an equilibrium. As one of the forces become larger than the other, a change in distance between the switchable magnetic apparatus and the work-piece may be passively controlled by the spring's compression to bring the forces back into equilibrium.

In yet some other embodiments, the roller assembly may allow active control of the distance between the switchable magnetic apparatus and the work-piece by means such as manually or electronically controlled actuators thereby allowing for applying a controllable holding force to the work-piece.

Figure 46A:
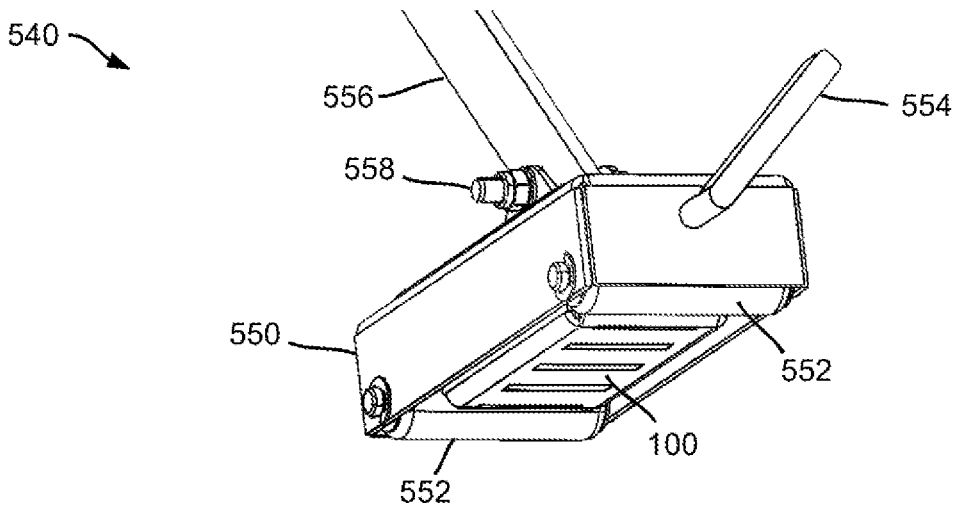
FIG. 46A is a schematic perspective view of a pressure applicator comprising a switchable magnetic apparatus, according to some embodiments of the present disclosure.
Figure 46B:
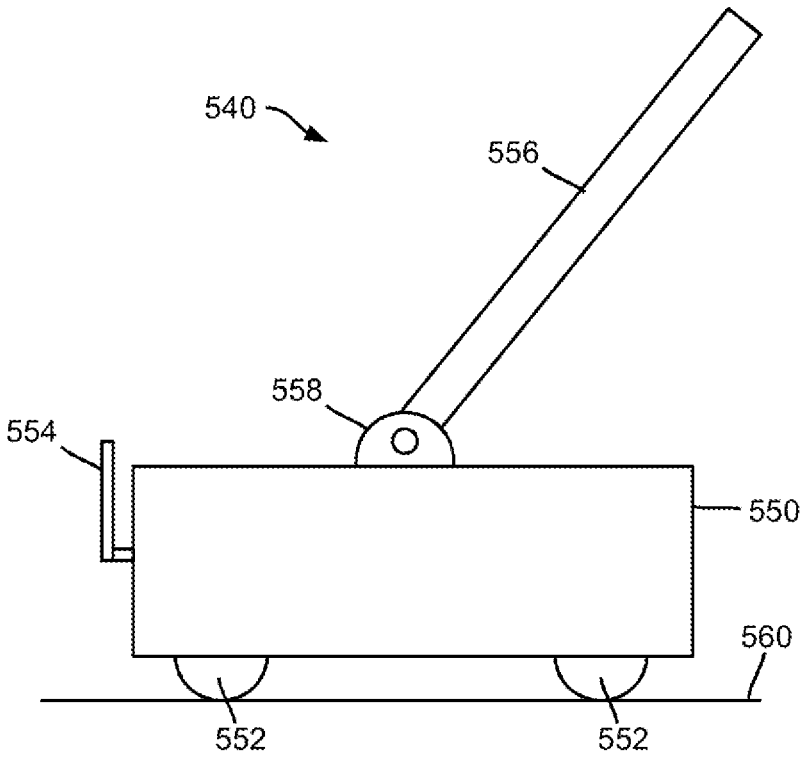
FIG. 46B is a side view of the pressure applicator shown in FIG. 46A.

For example, in some embodiments as shown in FIGS. 46A and 46B, a pressure applicator 540 comprises a body 550 receiving therein a pair of rollers 552 on a bottom side thereof and a switchable magnetic apparatus 100 (such as that shown in FIGS. 6A and 6B) between the rollers 552. A lever 554 is coupled to the switchable magnetic apparatus 100 and extends out of the body 550 for switching the switchable magnetic apparatus 100 ON and OFF. The pressure applicator 540 also comprises a handle 556 coupled to the body 550 via a pivot 558 for a user (not shown) to move the pressure applicator 540 on a target surface 560 while applying pressure thereto through the rollers 628.

When a user positions the pressure applicator 540 on the ferromagnetic or magnetic target surface 560 (or a target surface with a ferromagnetic component thereunder) and switches the switchable magnetic apparatus 100 ON, the switchable magnetic apparatus 100 attracts the pressure applicator 540 onto the target surface 560 and applies a force thereto. The user may then use the handle 556 to roll the pressure applicator 540 on the target surface 560, for example, to apply pressure-sensitive adhesives thereto.

The target surface 560 may be in any orientation, and the pressure applicator 540 may be movably coupled to the target surface 560 from top, bottom, or side as needed. The distance between the body 550 of the pressure applicator 540 and the target surface 560 may be adjustable for controlling the magnetic force applied thereto.

Figure 47A:
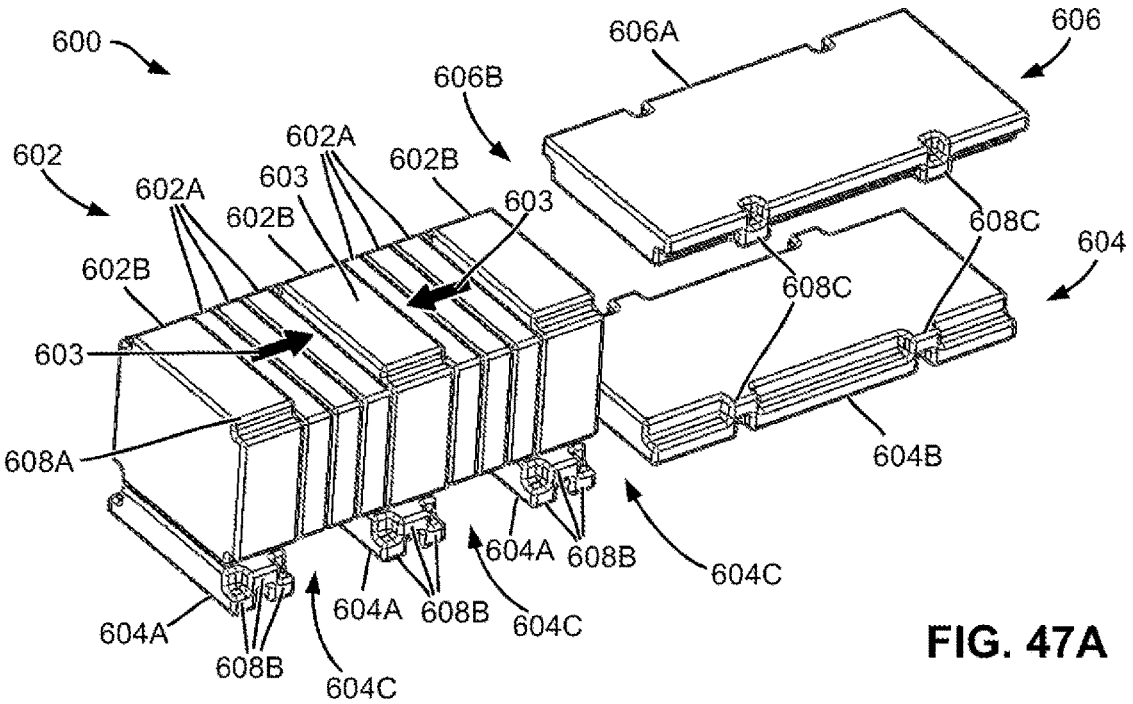
FIG. 47A is a perspective view of a switchable magnetic device according to some embodiments of this disclosure, wherein the switchable magnetic device comprises a magnetic array sandwiched between a front layer and a rear layer.
Figure 47B:
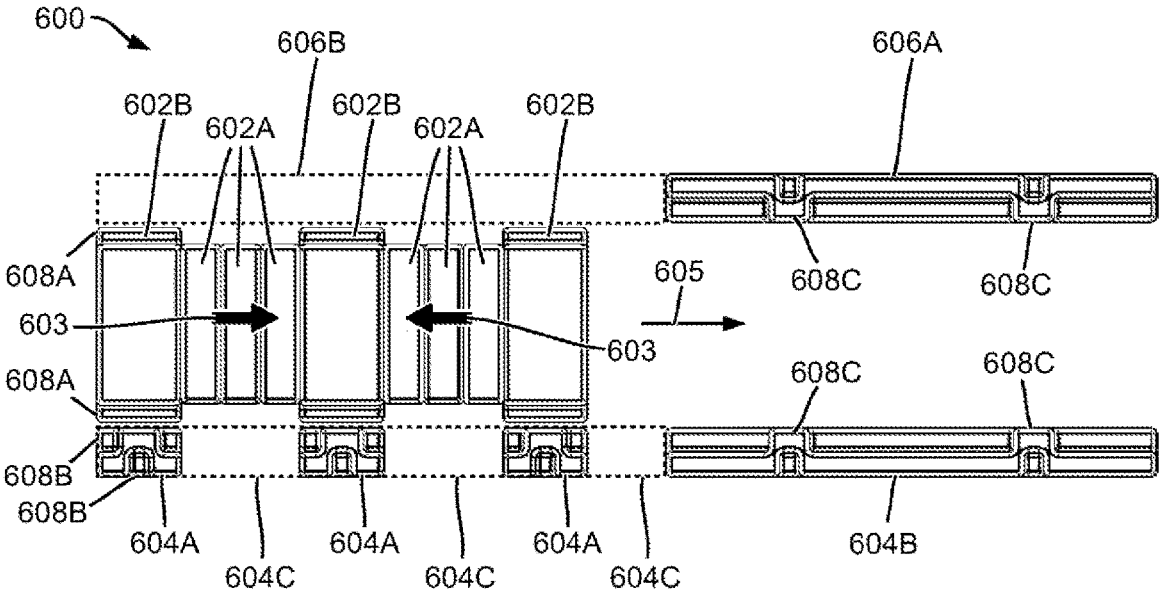
FIG. 47B is a side view of the switchable magnetic device shown in FIG. 47A.

Other switchable magnetic apparatuses 100 may also be used. For example, FIGS. 47A and 47B shows a switchable magnetic device numeral 600 that may be used in the pressure applicator 540. The switchable magnetic device 600 in these embodiments comprises a permanent magnet array 602 sandwiched between a front layer 604 and a rear layer 606.

The permanent magnet array 602 comprises a plurality of permanent magnets 602A sandwiched between a plurality of ferromagnetic flux-guides 602B. The magnets 602A have their polarity directed towards the ferromagnetic flux-guides 602B where adjacent magnets 602A have alternating polarity direction, as indicated by the arrows 603. In other words, the magnets 602A have longitudinally arranged polarities, and adjacent magnets 602A have opposite polarities.

The front layer 604 comprises a plurality of first ferromagnetic zones 604A spaced apart by a plurality of non-ferromagnetic zones 604C which in these embodiments may be gaps, and one second ferromagnetic zone 604B. The length of each first ferromagnetic zone 604A (defined along a longitudinal direction) is about the same as that of the corresponding ferromagnetic flux-guides 602B. The length of each first non-ferromagnetic zone 604C is about the same as that of the corresponding permanent magnet 602A. The length of the second ferromagnetic zone 604B is generally equal to or greater than that of the permanent magnet array 602.

The rear layer 606 comprises a ferromagnetic zone 606A at a position longitudinally overlapping the second ferromagnetic zone 604B and a non-ferromagnetic zone 606B at a position longitudinally overlapping the first ferromagnetic zones 604A and the non-ferromagnetic zones 604C. The lengths of the ferromagnetic zone 606A and the non-ferromagnetic zone 606B are generally equal to or greater than that of the permanent magnet array 602. In these embodiments, the non-ferromagnetic zone 606B is an empty space.

The magnetic array 602 is longitudinally movable between an ON position configuring the switchable magnetic device 600 to an ON state for applying a magnetic force to a work-piece (not shown) adjacent the front layer 604, and an OFF position configuring the switchable magnetic device 600 to an ON state for effectively removing the magnetic force from the work-piece.

When the magnetic array 602 is in the ON position, the ferromagnetic flux-guides 602B longitudinally overlap the ferromagnetic zones 604A of the front layer 604, the magnets 602A longitudinally overlap the non-ferromagnetic zones 604C of the front layer 604, and the non-ferromagnetic zone 606B of the rear layer 606 longitudinally overlaps the magnetic array 602. In this position, the magnetic flux from magnets 602A pass through the ferromagnetic flux-guides 602B and into the ferromagnetic zones 604A which direct the flux away from the magnetic array 602 and towards the work-piece adjacent the front layer 604.

When the magnetic array 602 is in the OFF position, the magnetic array 602 overlaps the ferromagnetic zone 604B of the front layer 604 and the ferromagnetic zone 606A of the rear layer 606. In this position the magnetic flux from magnets 602A pass through the ferromagnetic flux-guides 602B and into the ferromagnetic zones 604B and 606A where the magnetic flux changes direction to stay within the ferromagnetic zones then is directed towards an opposing pole ferromagnetic flux-guide 602B and towards an opposing pole of a magnet 602A, keeping the magnetic flux internal to the magnetic device 600.

The arrow 605 in FIG. 47B shows the linear actuation direction for moving the magnetic array 602 from the ON position to the OFF position. As shown in FIGS. 47A and 47B, the ferromagnetic flux-guides 602B, the ferromagnetic zones 604A, the ferromagnetic zone 604B, and the ferromagnetic zones 606A comprise a plurality of extrusions 608A, 608B, and 608C thereon for controllably engaging corresponding constraining structures (described later) to retain the front layer 604, the magnetic array 602, and the rear layer 606 in position.

Figure 48:
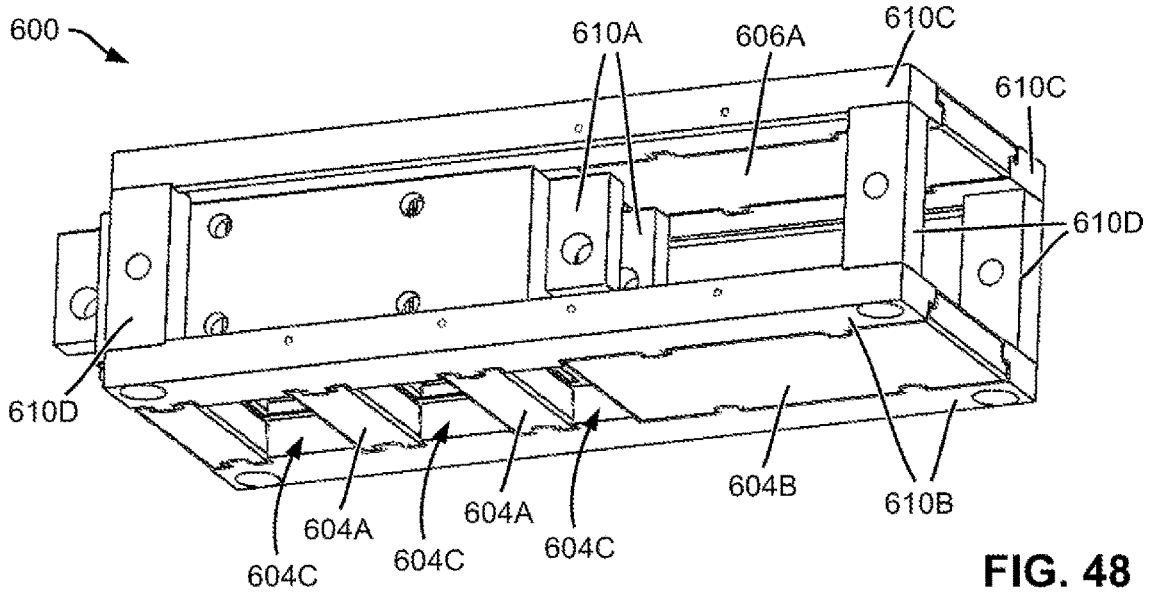
FIG. 48 is a perspective view of the magnetic device shown in FIG. 47A illustrating constraining structures for retaining the front layer, the magnetic array, and the rear layer.

FIG. 48 shows the magnetic device 600 with the constraining structures 610A, 610B, 610C, and 610D in the form of brackets. The constraining structures 610B, 610C, and 610D form a frame for retaining the front layer 604 and rear layer 606 in position. In particular, the front brackets 610B comprise recesses matching the extrusions 608B and 608C on ferromagnetic zones 604A and ferromagnetic zone 604B for retaining the front layer 604. The rear brackets 610C comprise recesses matching the extrusions 608C on the ferromagnetic zone 606A for retaining the rear layer 606. The front brackets 610B and rear brackets 610C are coupled by the connectors 610D.

The constraining structures 610A are in the form of a pair of magnetic brackets with recesses matching the extrusions 608A on ferromagnetic flux-guides 602B for coupling to the magnetic array 602. The constraining structures 610A are retained in the frame and longitudinally movably engaging the front brackets 610B and rear brackets 610C via a suitable movement-facilitating mechanism such as bearings or a low friction surface to allow the magnetic array 602 longitudinally movable within the frame between the ON position and the OFF position.

Figure 49A:
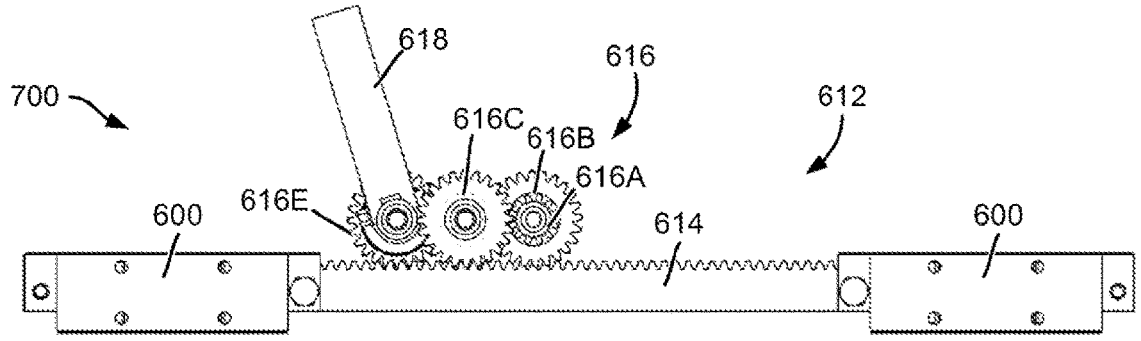
FIG. 49A is a side view of a switchable magnetic system comprising an actuation assembly coupled to two switchable magnetic devices shown in FIG. 47A, according to some embodiments of this disclosure.
Figure 49B:
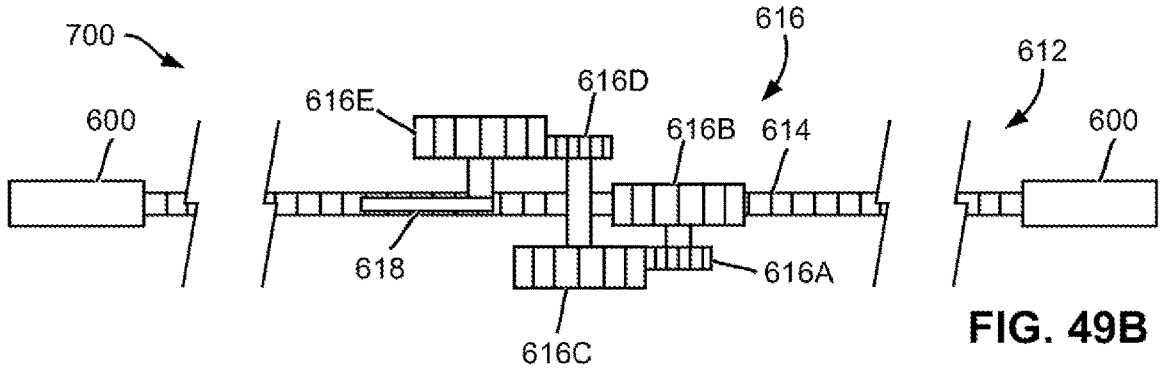
FIG. 49B is a rear view of the switchable magnetic system shown in FIG. 49A.

The switchable magnetic device 600 may be actuated by an actuation assembly. FIGS. 49A and 49B show a switchable magnetic system 200 comprising an actuation assembly 612 coupled to two switchable magnetic devices 600. The actuation assembly 612 comprises a gear rack 614, a gear assembly 616, and a lever 618. The gear rack 614 is connected to the magnet brackets 610A of each switchable magnetic device 600. The gear assembly 616 allows the transformation of linear motion of the gear rack 614 into rotational motion. The gear assembly 616 comprises a plurality of gears 616A and 616B to achieve the desired gear ratio. The lever 618 is attached to the shaft of the final gear 616E to allow the lever 618 to actuate the gear assembly 616 to achieve linear actuation of the magnetic array 602 between the ON and OFF positions. The lever 618 may be of a length to apply a desired mechanical advantage. The gear rack 614 may be attached to one or more magnetic devices 600.

Figure 50A:
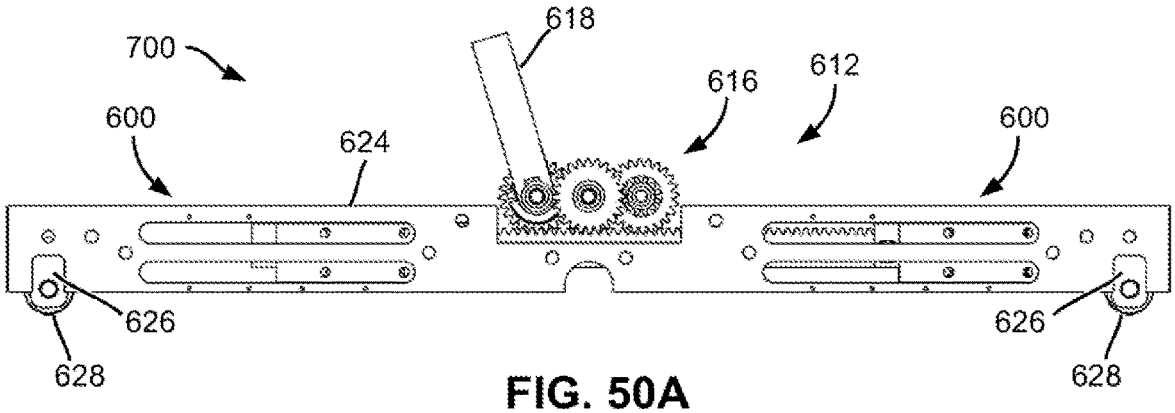
FIG. 50A is a side view of a movable magnetic system comprising a housing receiving therein an actuation assembly coupled to two switchable magnetic devices shown in FIG. 47A, and a plurality of rollers coupled to the housing, according to some embodiments of this disclosure.
Figure 50B:
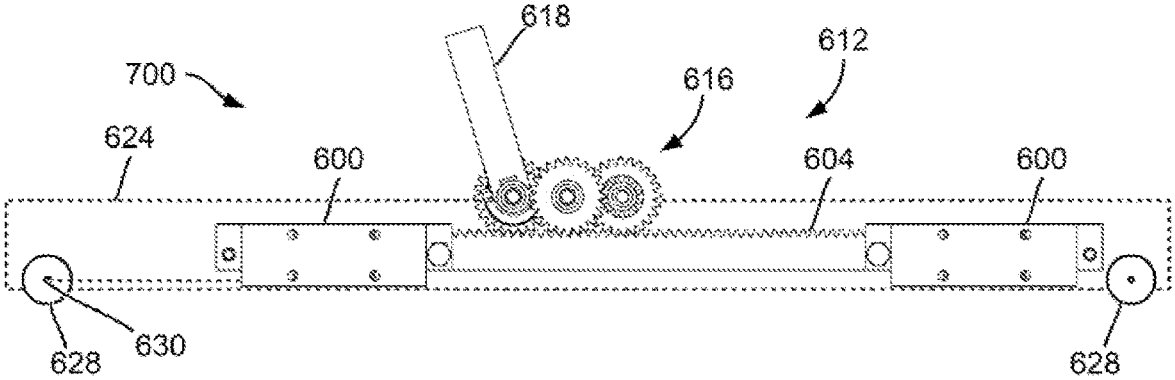
FIG. 50B is a side view of the movable magnetic system shown in FIG. 50A with the housing represented using broken lines for showing the positions of the rollers.

In some embodiments, the magnetic devices 600 and the actuation assembly 612 of the switchable magnetic system 700 may be integrated or otherwise coupled with a rolling assembly. FIGS. 50A and 50B show the switchable magnetic system 700 having a housing 624 receiving therein two magnetic devices 600 and an actuation assembly 612, and a rolling assembly 622 having a plurality of rollers or wheels 628 rotatably coupled to the housing 624 via respective roller supports 626.

Figure 50C:
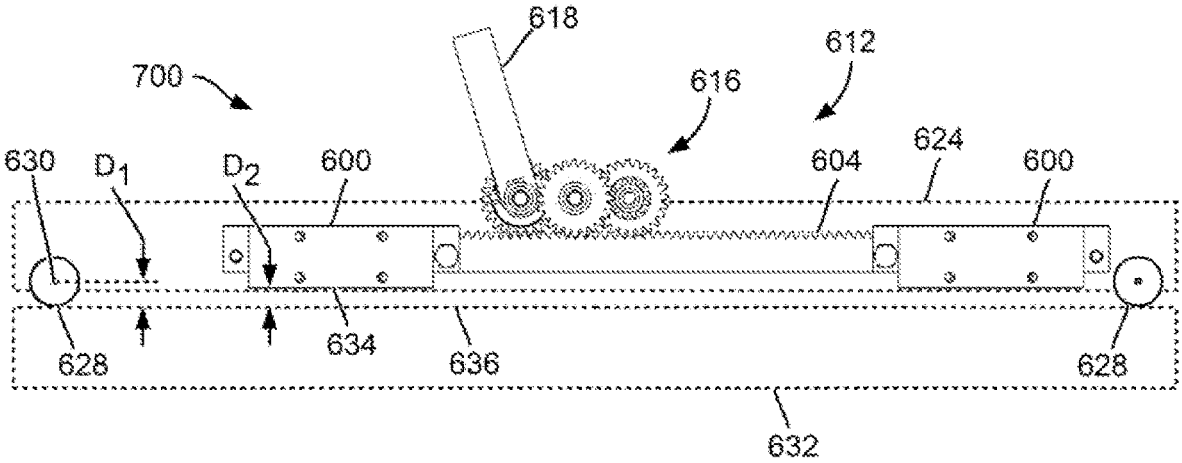
FIG. 50C is a side view of the movable magnetic system shown in FIG. 50A engaging a ferromagnetic work-piece, wherein the housing is represented using broken lines for showing the positions of the rollers.

As shown in FIG. 50B, the rollers 628 in these embodiments are at positions longitudinally non-overlapping the magnetic devices 600. As shown in FIG. 50C, when the magnetic devices 600 are at the ON state and engage a work-piece 632, the rotation axis 630 of each roller 628 is at a distance D1 greater than the distance D2 between the front surface 634 of each magnetic device 600 and the rear engaging surface 636 of the work-piece 632 (that is the target surface 636) for maintaining a reduced gap between the magnetic devices 600 and work-piece 632. As those skilled in the art will appreciate, the strength of a magnetic force between two magnetically attracting objects is reversely proportional to the square of the distance therebetween. Therefore, reducing the gap between magnetic devices 600 and work-piece 632 may enhance the strength of the magnetic force therebetween.

In these embodiments, the rollers may be made of any suitable materials such as suitable ferromagnetic materials and/or non-ferromagnetic materials.

Figure 51:
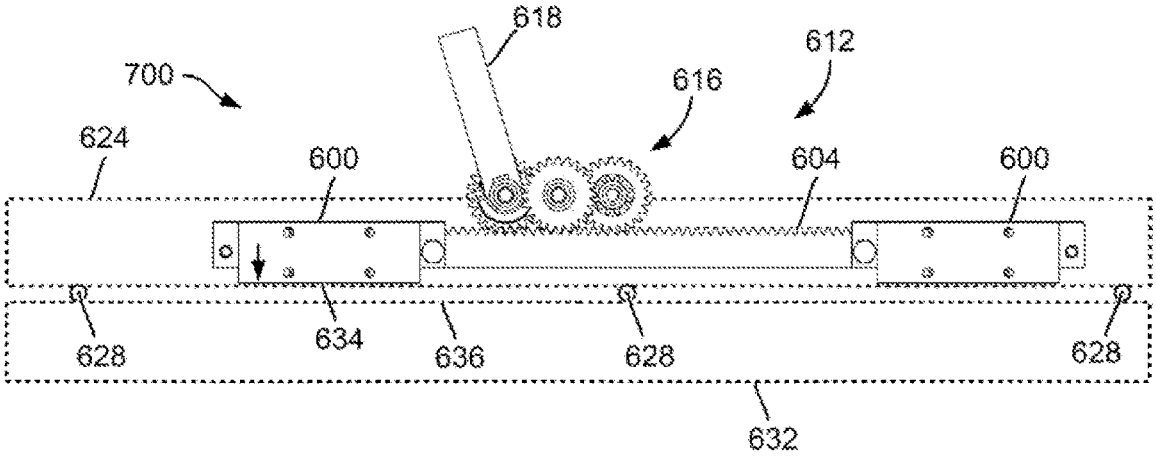
FIG. 51 is a side view of the movable magnetic system shown in FIG. 50A engaging a ferromagnetic work-piece, according to some embodiments of this disclosure, wherein the housing is represented using broken lines for showing the positions of the rollers.

In some embodiments as shown in FIG. 51, the switchable magnetic system 700 may comprise a plurality of rollers 628 coupled to the housing 624. The rollers 628 have small diameters for reducing the gap between the magnetic devices 600 and work-piece 632.

Figure 52:
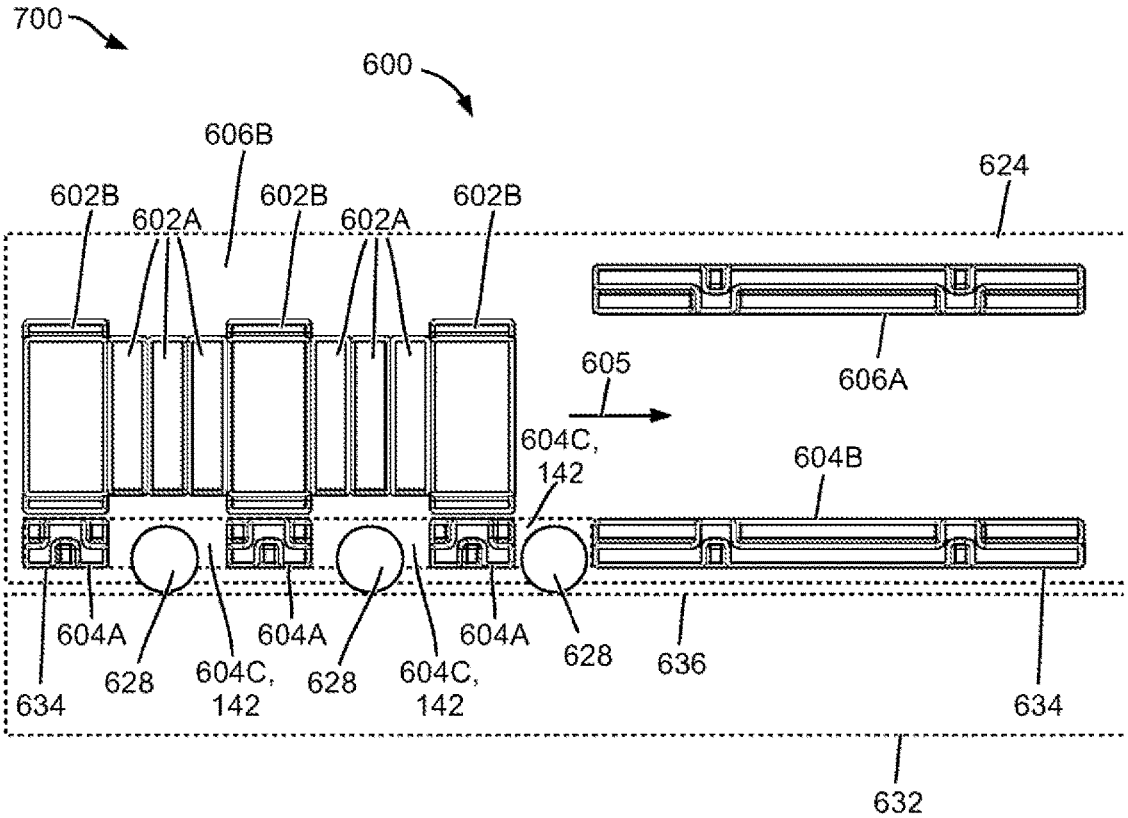
FIG. 52 is a side view of the movable magnetic system shown in FIG. 50A engaging a ferromagnetic work-piece, according to some other embodiments of this disclosure.

In some embodiments as shown in FIG. 52, the switchable magnetic system 700 may comprise a plurality of non-ferromagnetic rollers 628 in the recesses 642 located in the non-ferromagnetic zones 604C. When the magnetic devices 600 are at the ON state and engage a work-piece 632, the rotation axis 630 of each roller 628 is at a distance greater than that between the front surface 634 of each magnetic device 600 and the target surface 636 of the work-piece 632 for maintaining a reduced gap between the magnetic devices 600 and work-piece 632.

Figure 53:
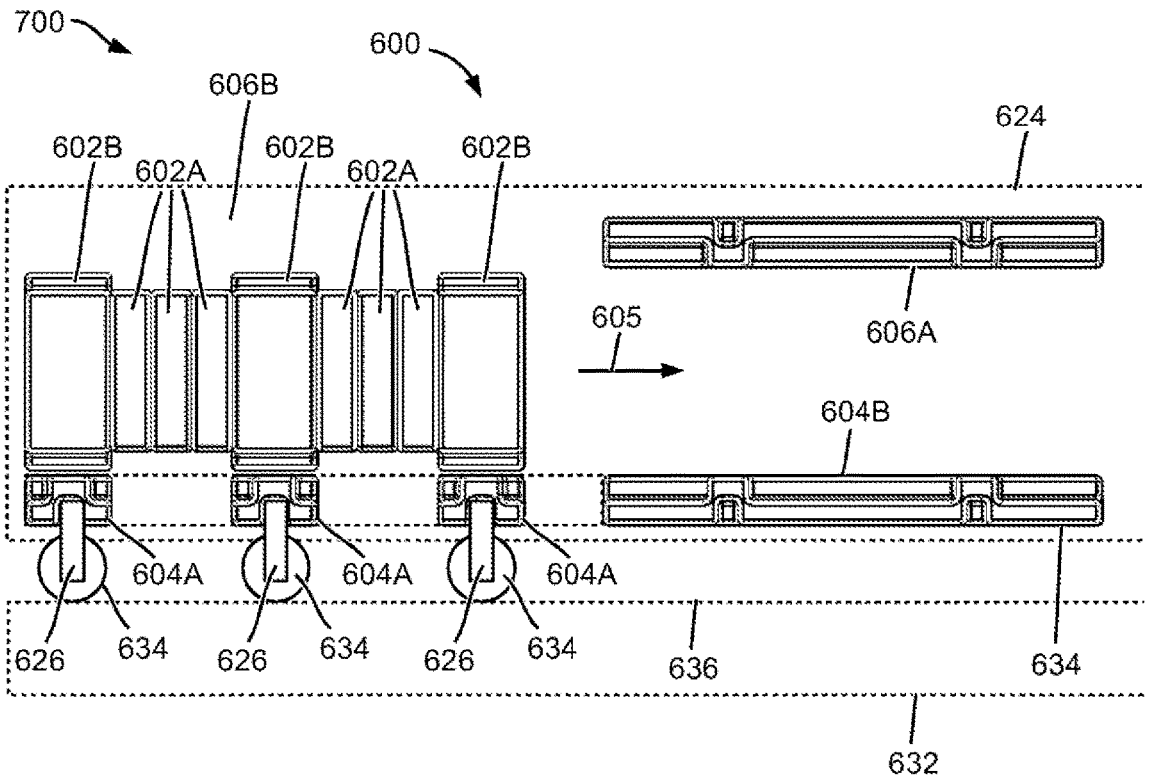
FIG. 53 is a side view of the movable magnetic system shown in FIG. 50A engaging a ferromagnetic work-piece, according to yet some other embodiments of this disclosure.

In some embodiments as shown in FIG. 53, the switchable magnetic system 700 may comprise a plurality of ferromagnetic rollers 628 located positions overlapping the in the first ferromagnetic zones 604A. Each roller 628 is magnetically coupled to the ferromagnetic zones 604A via respective ferromagnetic roller supports 626.

When the magnetic devices 600 are at the ON state, the magnetic devices 600 apply the magnetic holding force to either the work-piece 632 or an intermediate ferromagnetic material 632 coupled to the work-piece at least via the ferromagnetic roller supports 626 and the rollers 628.

When engaging the ferromagnetic work-piece 632 or an intermediate ferromagnetic material 632 coupled to the work-piece, the system 700 may be mechanically rolled along the target surface thereof to attain translation while continually applying holding force thereto. In some embodiments, a tool may also be integrated into the system 700 to hold the tool in proximity with the work-piece 632 to operate thereon.

In above embodiments, the magnets 602A and ferromagnetic flux-guides 602B of the magnetic array 602 are longitudinally arranged and the magnetic array 602 is longitudinally movable to overlap and non-overlap with the ferromagnetic zone 606A of the rear layer 606 and the second ferromagnetic zone 604B of the front layer 604 to switch the switchable magnetic device 600 to ON and OFF.

Figure 54:
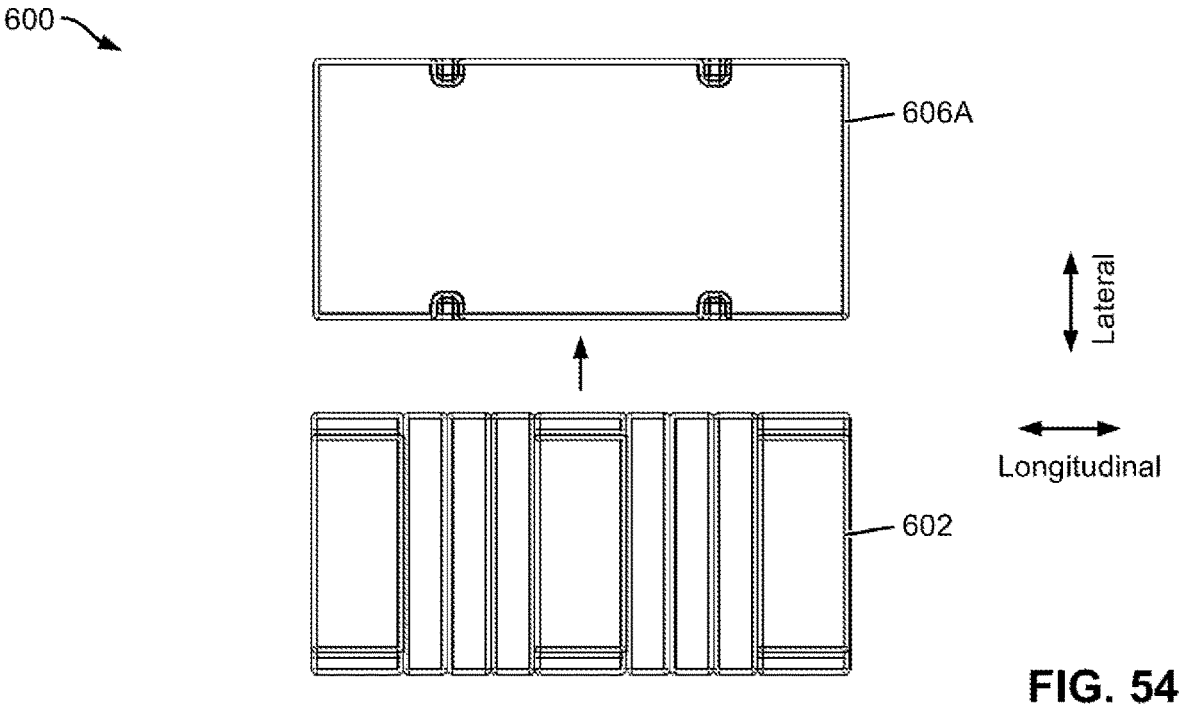
FIG. 54 is a rear view of a switchable magnetic device, according to some other embodiments of this disclosure.

In some embodiments as shown in FIG. 54, the magnets 602A and ferromagnetic flux-guides 602B of the magnetic array 602 are longitudinally arranged and the magnetic array 602 is laterally movable to overlap and non-overlap with the ferromagnetic zone 606A of the rear layer 606 and the second ferromagnetic zone 604B of the front layer 604 to switch the switchable magnetic device 600 to ON and OFF.

In some embodiments, the switchable magnetic device 600 may comprise a stationary magnet array 602, and the front and rear layers are movable between the ON and OFF positions.

Figure 55A:
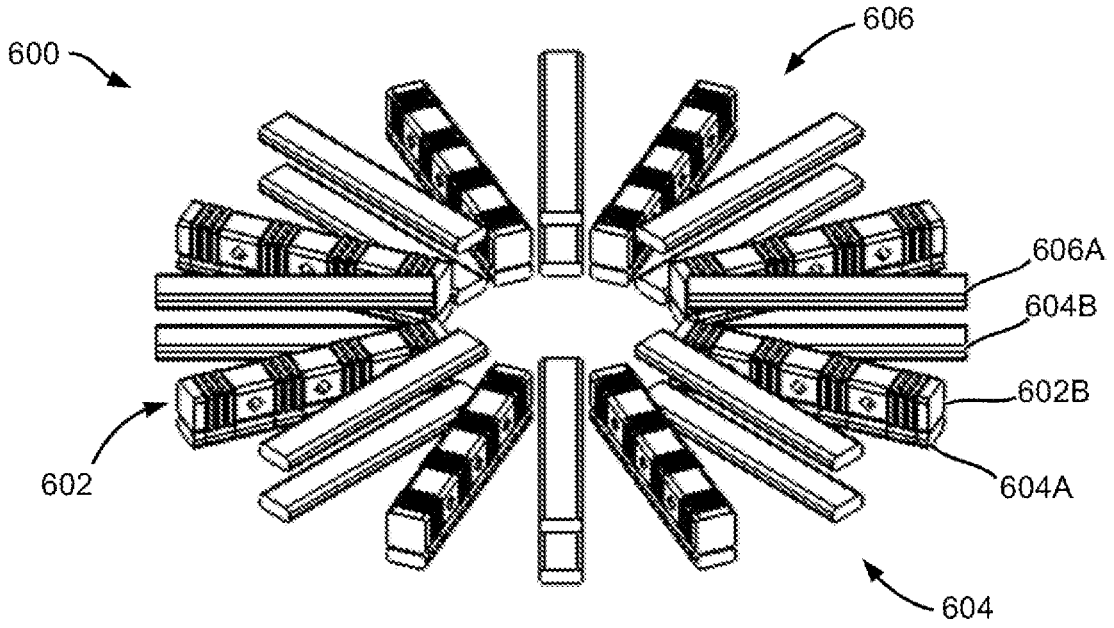
FIGS. 55A and 55B are perspective views of a switchable magnetic device in the ON state and the OFF state, respectively.
Figure 55B:
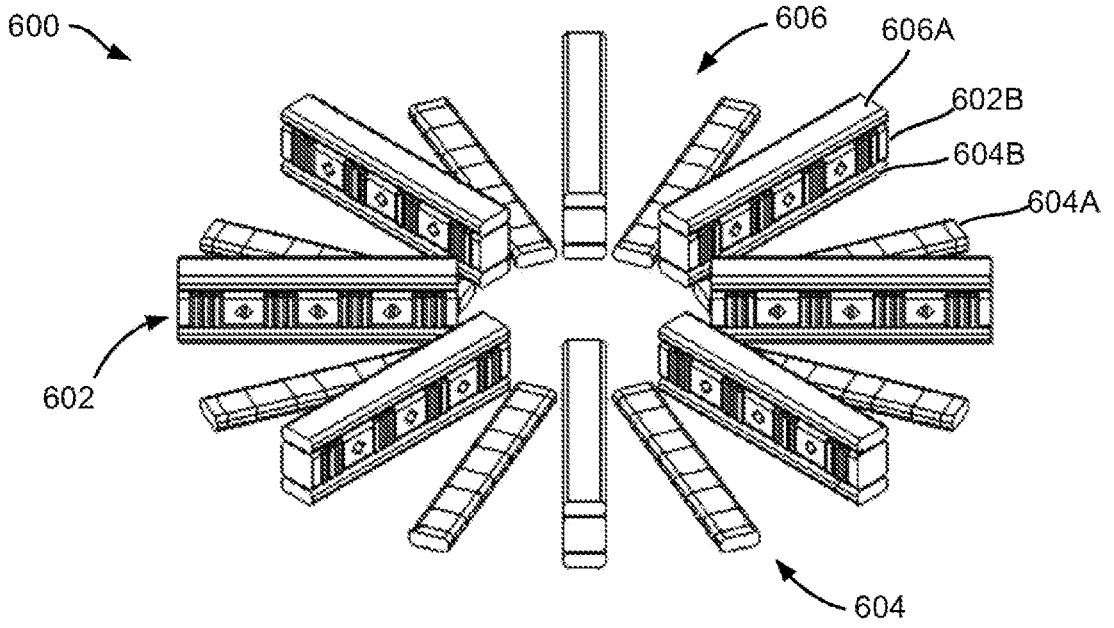

In some embodiments, the front layer 604 and the rear layer 606 may be in the form of discs and the magnetic array 602 are in the form of arms of a middle disc sandwiched between the front and rear discs 604 and 606, as shown in FIGS. 55A and 55B. The detail of the switchable magnetic device 600 may be found in Applicant's U.S. Provisional Patent Application Ser. No. 63/618,632 filed on Nov. 25, 2020, the content of which is incorporated herein by reference in its entirety. In these embodiments, the switchable magnetic device 600 may be switched to ON and OFF by triggering the rotational movement between the middle disc and the combination of the front and rear discs 604 and 606. In these embodiments, the actuation assembly 612 is a rotational actuation mechanism.

Figure 56:
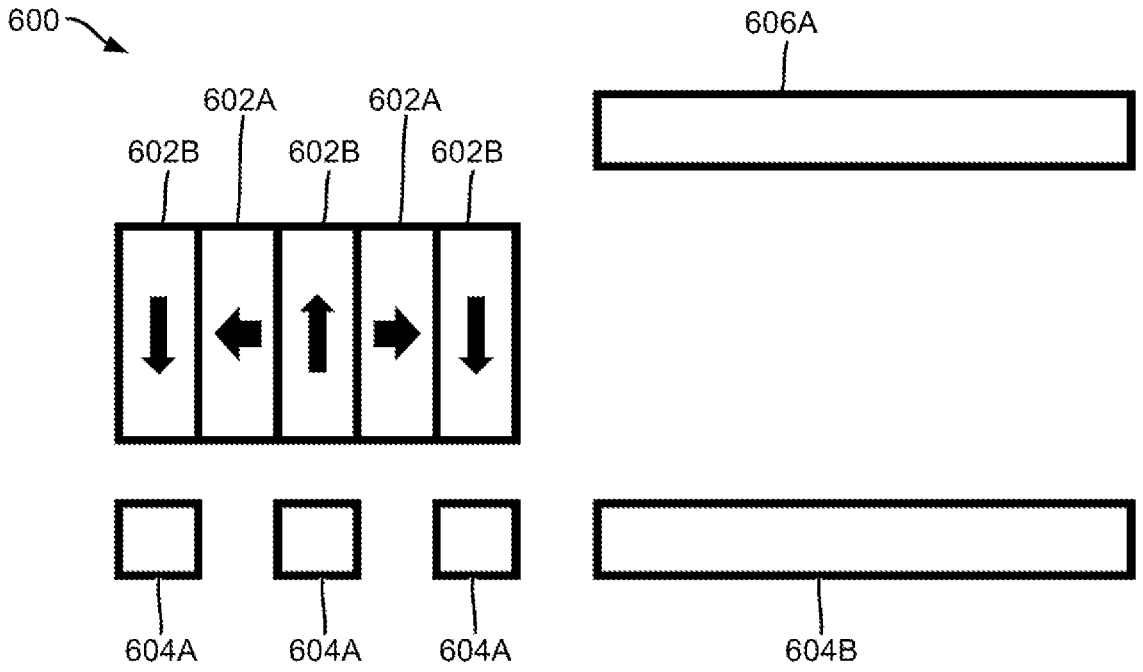
FIG. 56 is a side view of a switchable magnetic device according to some embodiments of this disclosure, wherein the switchable magnetic device comprises a Halbach array sandwiched between a front layer and a rear layer.

FIG. 56 is a schematic side view of a magnetic device 600 in some embodiments. As shown, the magnetic device 600 in these embodiments is similar to that shown in FIGS. 47A and 47B except that the permanent magnet array 602 is a Halbach array. In particular, the permanent magnets 602A (denoted "primary magnets" hereinafter) are sandwiched between a plurality of secondary magnets 602B. The polarities of the secondary magnets 602B are arranged alternating along the forward-rearward direction. In other words, the polarity of each secondary magnet 602B is along the forward-rearward direction and the polarities of adjacent secondary magnets 602B are opposite to each other.

In some embodiments, the pressure applicator 540 may comprise an adjustment structure for controlling and adjusting the strength of the magnetic flux of the pressure applicator 540 reaching a work-piece. Controlling the strength of the magnetic flux that reaches the work-piece may control the amount of holding force the pressure applicator 540 imposes, and may also control the amount of pressure the pressure applicator 540 applies to the work-piece or an intermediate surface by transferring the pressure through structures such as a wall, slider, roller, ball, and/or the like. Those skilled in the art will appreciate that the structures and methods of adjusting the strength of the magnetic flux may also be used in other devices such as the magnetic particle inspection non-destructive testing (MPI-NDT) devices and degaussing (demagnetization) devices.

For example, in some embodiments wherein the rollers 552 or 628 comprise above-described magnetic devices, the number of rollers 552 or 628 may be chosen to apply a desired magnetic holding force to roller pressure. More specifically, the pressure applicator 540 may comprise a plurality of roller holders each suitable for releasably coupling thereto a roller 552 or 628. A user may couple a selected number of rollers to selected roller holders for controlling and adjusting the magnetic flux and/or the magnetic force and the distribution thereof.

In some embodiments, the distance between the housing 624 (see FIG. 50A to 53) or the magnetic device 600 therein and the ferromagnetic or magnetic target surface that the magnetic device 600 and/or the magnetic system 700 is engaged thereto may be adjustable for controlling and adjusting the magnetic flux and/or the magnetic force applied to the ferromagnetic or magnetic target surface.

For example, the housing 624 or the magnetic device 600 may be coupled to the rollers 552 or 628 via a height-adjustment structure to allow a user to adjust the distance between the housing 624/the magnetic device 600 and the target surface using any suitable mechanical mechanisms (for example, via one or more gears), hydraulic mechanisms, electromechanical mechanisms (for example, via one or more motors), and/or the like, wherein increasing the distance between the housing 624/the magnetic device 600 and the target surface may reduce the strength of the magnetic flux and/or the magnetic force applied to the target surface, and reducing the distance therebetween may increase the strength of the magnetic flux and/or the magnetic force applied to the target surface.

As another example, the adjustment structure may comprise a plurality of rollers of various sizes such that one may select larger-size rollers to couple to the roller holders to increase the distance between the housing 624/the magnetic device 600 and the target surface for reducing the strength of the magnetic flux and/or the magnetic force applied to the target surface, or select smaller-size rollers to couple to the roller holders to reduce the distance between the housing 624/the magnetic device 600 and the target surface for increasing the strength of the magnetic flux and/or the magnetic force applied to the target surface.

The adjustment structure may be automatically adjustable. For example, in some embodiments, the housing 624/the magnetic device 600 may be coupled to one or more springs which may be biased (compressed or extended, depending on the implementation) under the magnetic force applied to the target surface. In other words, while the magnetic force applied to the target surface tends to decrease the distance between the housing 624/the magnetic device 600 and the target surface, the springs, when biased, tend to increase the distance therebetween, until an equilibrium is reached between the magnetic force and the spring force.

In some embodiments, the housing 624/the magnetic device 600 may be coupled to one or more compressible structures such as one or more compressible wheels between the housing 624/the magnetic device 600 and the target surface for automatically adjusting the magnetic force applied to the target surface.

In some embodiments, an active mechanism may be used to receive feedback from the magnetic device 600 or a magnetic flux/magnetic force senor and adjust the distance using a controller and motor combination.

In some embodiments, one or more ferromagnetic adjustment layers may be removably coupled to the front side (that is, the target side) of the magnetic device 600 for controlling and adjusting the magnetic flux and/or the magnetic force applied to the target surface. Similar to the plate 154 shown in FIG. 28, each of the one or more ferromagnetic layers may have a size sufficient for covering or coupling to a plurality of ferromagnetic flux guides 102B for "short-circuiting" these ferromagnetic flux guides 102B.

In these embodiments, the magnetic flux and/or the magnetic force applied to the target surface is the strongest when no ferromagnetic adjustment layers are coupled to the front side of the magnetic device 600.

The reduction of the magnetic flux and/or the magnetic force depends on the thickness of the one or more ferromagnetic adjustment layers. For example, a user may couple a thin adjustment layer to the front side of the magnetic device 600 to slightly reduce the magnetic flux and/or the magnetic force applied to the target surface. The user may couple a thick adjustment layer or a plurality of thin adjustment layers to the front side of the magnetic device 600 to greatly reduce the magnetic flux and/or the magnetic force applied to the target surface. In some embodiments, the adjustment layers may be part of the magnetic device 600 and may be moved in and out of the front side of the magnetic device 600 for adjustment. In some other embodiments, the adjustment layers may be attachable to and removable from the magnetic device 600 by the user (for example, inserting one or more adjustment layers to one or more holding slots on the front side of the magnetic device 600 or removing the one or more adjustment layers therefrom).

Figure 57:
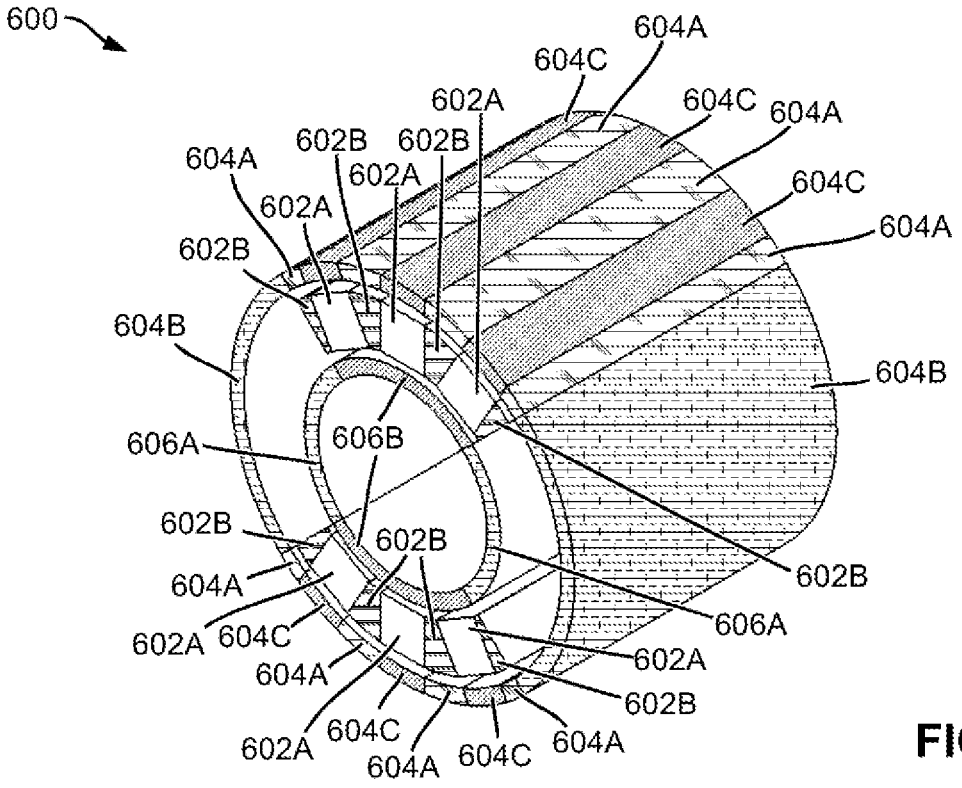
FIG. 57 is a perspective view of a switchable magnetic device according to some embodiments of this disclosure, wherein the switchable magnetic device is in a cylindrical shape.

In some embodiments as shown in FIG. 57, the magnetic device 600 may be in a cylindrical shape and the front layer 604, the layer of the permanent magnet array 602 and the rear layer 606 are concentric layers for applying switchable magnetic force to a ferromagnetic or magnetic object (not shown) inside the innermost layer (which may be the front layer 604 or the rear layer 606 depending on the design) and/or a ferromagnetic or magnetic object (not shown) outside the outermost layer (which may be the front layer 604 or the rear layer 606 depending on the design). For example, in one embodiment, the magnetic device 600 shown in FIG. 57 may act as a switchable magnetic roller for applying a magnetic force to a ferromagnetic target surface.

In some embodiments, the magnetic device 600 may be an unswitchable magnetic device comprise a magnetic component that is always configured in the ON state and does not have the ability to switch the magnetic force ON and OFF. For example, the magnetic device 600 in one embodiment may comprise the permanent magnet array 602 (which comprises a plurality of permanent magnets 602A sandwiched between a plurality of ferromagnetic flux-guides 602B in one embodiment or comprises one or more permanent magnet 602A with no ferromagnetic flux-guides 602B in another embodiment), but does not comprise the ferromagnetic zones 604A, 604B, and 606A. Accordingly, the magnetic device 600 may not comprise the actuation assembly 612 for reducing the weight and volume thereof.

In various embodiments, the actuation assembly 612 may be driven by any suitable mechanisms such as a motor, pneumatic means, or other external automated mechanisms. The automated mechanisms may be controlled via a computing device such as a general-purpose computer or a smartphone running a suitable app. Those skilled in the art will appreciate that the automated mechanisms may be also controlled by other suitable electrical devices.

Although in above embodiments, the magnetic device 600 comprises one or more permanent magnets. In some embodiments, at least one of the magnets may be other suitable type of magnet such as an electromagnet.

In some embodiments, safety locking pins or spring systems may be used to lock the magnetic array 602 in the ON and/or OFF position for avoiding accidental switching between the ON/OFF states.

In other embodiments, the switchable magnetic apparatuses 100 may be used in other devices such as electronic devices, sensors, and the like.

Those skilled in the art will appreciate that, in various embodiments, the magnets described above such as the magnets 102A and 104A may each be a single component or the combination of a plurality of magnetic elements. When a magnet 102A/104A is formed by a plurality of magnetic elements, the polarities of the plurality of magnetic elements are preferably aligned.

In some embodiments, the magnetic apparatuses 100 disclosed herein may not be switchable and may be always configured in the ON state.

The magnets described above (including the magnets 102A, 104A, and in some embodiments 104B) are preferably permanent magnets. In some embodiments, at least some of these magnets may be electromagnetic components.

Multiple aspects of magnetic performance of the magnetic apparatuses 100 disclosed herein may be summarized in ON force, OFF force, ON position stability, ON/OFF force ratio, activation force, magnetic field depth, and ON force/activation force ratio. ON force is the holding force of the magnetic device when ON which in most cases may be maximized. OFF force is the holding force of the magnetic device when OFF which in most cases may be minimized. ON/OFF force ratio is the ratio between the ON and OFF force which in most cases may be maximized. Activation force is the amount of force that must be overcome to switch the device between the ON and OFF positions which in most cases may be minimized. Magnetic field depth is the distance at which the device can apply a force to a work-piece which may be designed according to use cases which may require vastly different field depths. ON force/activation force ratio is the ratio between the ON force and activation torque which in most cases may be maximized.

Identifying magnetic performance variables are important as they provide a way to compare component geometries to determine which is preferable for a specific use case. This kind of optimization is important in the construction of a useful version of the magnetic apparatuses 100 disclosed herein. Since use cases may vary significantly, to capture the use case's preferred performance and simplify it to a single value, the concept of a performance factor has been established. The performance factor value may be calculated from different mathematical combinations of the magnetic performance variables. In some use cases, certain performance variables are left out of the calculation of the performance factor as they have specific constraints or are unimportant. For example, a use case may specify a work-piece thickness of 0.25 inch, prefer to have an OFF force just strong enough to hold itself up on a vertical ferromagnetic wall, and require a locking mechanism for the ON position. Here, the target field depth is taken as the work-piece thickness, the OFF force target is set, and the ON position stability is unimportant as there will be a locking mechanism. The performance factor may then be calculated using the remaining performance variable by multiplying the ON force, the ON/OFF force ratio, the ON force/activation force ratio, and dividing by the activation force. The device dimensions that meet the specified constraints while maximizing the performance factor results in an optimized device. If the use case finds the activation force is the most important performance variable, the performance factor may instead be divided by the activation force squared. There are a multitude of performance factor calculations that may be made based on the best way to capture the use case's desired performance.

Through the analysis of multiple use cases, a common performance factor calculation has been multiplying the ON force by the ON/OFF force ratio, the ON force/activation force ratio, and dividing by the activation force, and OFF force. The ON position stability and magnetic field depth have tended to be left out due to being unimportant as a locking mechanism is included and being determined by a known work-piece thickness, respectively. Having used this performance factor at different scales, an equation involving relative component dimensions was found to analytically calculate the optimized dimensions across scales. The equation was identified to work on a circular device with rectangular front-layer magnets 102A, circular rear-layer magnets 104A, a ferromagnetic layer 152, and six (6) flux guides 102B. The total magnet volume was calculated from an optimized device with an outer diameter of 1.75 inches, inner diameter of 0.75 inches, and height of 0.75 inches. The equation is:

$$m1l * m1w * m1h * 6 + \frac{m2h * pi * m2d^2}{4} * 6 = \text{Magnet Volume}$$

where m1*l* is the front-layer magnet 102A length (dimension that determines the distance between flux guides 102B), m1*w* is the front-layer magnet 102A width (radial dimension), m1*h* is the front-layer magnet height, m2*h* is the rear-layer magnet 104A height, and m2*d* is the rear-layer magnet 104A diameter. The total magnet volume was then approximated for a device with an outer diameter of one (1) inch, inner diameter of 0.3 inches, and a height of 0.4 inches. An equation was made based on the above magnet volume calculation with an added scale factor to each dimension, as shown below:

$$(m1l * x) * (m1w * x) * (m1h * x) * 6 + \frac{(m2h * x) * pi * (m2d * x)^2}{4} * 6 = \text{New Magnet Volume}$$

where x is the scale factor. Inputting the old component dimensions and the new magnet volume allowed the calculation of the scale factor x. Each old component dimension was then multiplied by the calculated scale factor to give a scaled value for m1*l*, m1*w*, m1*h*, m2*h*, and m2*d*. When increasing and decreasing the scaled values and comparing performance factors, it was found that the scaled values produced the maximized performance factor. This process saves a significant amount of time to achieve an optimized device by removing the need for exhaustive dimensional testing.

In the processes of optimizing a set of component geometries for a variety of use cases, patterns have arisen between specific dimensions and their effects on the performance variables. Dimensions that have been found to have a relatively constant effect on performance variables include the front-layer magnet 102A width, length, and height, the flux guide 102B height, the rear-layer magnet 104A width, length, and height (or diameter and height in the case of a circular magnet), and the ferromagnetic layer 152 thickness.

An exemplary case is provided of a circular device with rectangular front-layer magnets 102A, circular rear-layer magnets 104A, and a ferromagnetic layer 152. Results are provided when testing magnetic performance by increasing and decreasing a single component dimension from its optimized value while keeping all other dimensions the same. By increasing the front-layer magnets 102A height, there is an increase in ON force, OFF force, activation force, and ON force/activation force ratio. The ON position stability and ON/OFF force ratio values are reduced. There is a negligible effect on field depth.

By increasing the front-layer magnets 102A length (dimension that determines the distance between flux guides 102B), there is an increase in ON force, OFF force, activation force, ON position stability, and field depth while there is a decrease in ON/OFF force ratio. The ON force/activation force ratio increased both when increasing and decreasing this width from the optimized starting point.

By increasing the front-layer magnets 102A width (radial dimension), there is an increase in ON force, OFF force, ON position stability, activation force, and ON force/activation force ratio. There is a decrease in ON/OFF force ratio.

By increasing the rear-layer magnets 104A diameter, there is an increase in ON force and activation force. There is a decrease in OFF force and ON position stability. The ON/OFF force ratio is reduced, and the ON force/activation force ratio is increased when increasing and decreasing the diameter from the starting point. There is a negligible effect on field depth.

By increasing the rear-layer magnets 104A height, there is an increase in ON force, activation force, and field depth. There is a decrease in OFF force and ON force/activation force ratio. The ON/OFF force ratio decreases when increasing and decreasing the height from the starting point. There is negligible effect to ON position stability.

By increasing the ferromagnetic layer 152 thickness, there is an increase in ON force, ON/OFF force ratio, and activation force. There is a decrease in OFF force, ON position stability, and ON force/activation force ratio. There is a negligible effect on field depth.

The example of the device that was optimized using the analytical equation has comparative values of 57 lbs ON force, 1.2 lbs OFF force, and an ON/OFF force ratio of 9.5 using 0.33 inch^3 of magnet volume. To achieve the same ON force with a standard magnet one may not be able to comfortably remove it. If one achieve the OFF force, the holding force is limited to 1.2 lbs. A standard magnet with the same 0.33 inch^3 magnet volume produces approximately 45 lbs holding force.

Although embodiments have been described above with reference to the accompanying drawings, those of skill in the art will appreciate that variations and modifications may be made without departing from the scope thereof as defined by the appended claims.

What is claimed is:

1. A magnetic apparatus for generating a directional magnetic field towards a target direction on a first side thereof, the magnetic apparatus comprising:

a first layer along a first surface perpendicular to the target direction, the first layer defines thereon a plurality of alternating South and North first-layer poles in a pattern; and a second layer on a second side of the first layer, the second side opposite to the first side, the second layer comprising one or more second-layer magnets interleaved with one or more spacers;

wherein the polarity of each of the one or more second-layer magnets are parallel to the target direction, each of the one or more second-layer magnets overlaps one of the plurality of first-layer poles along the target direction; and wherein, in a first state, a pole of each of the one or more second-layer magnets adjacent the corresponding first-layer pole is same as the corresponding first-layer pole.

2. The magnetic apparatus of claim 1, wherein the first layer comprises one or more first-layer magnets forming the plurality of first-layer poles;

wherein each adjacent pair of the one or more first-layer magnets are adjacent a respective one of the one or more second-layer magnets;

wherein an angle $\alpha$ between each first-layer magnet and the adjacent second-layer magnet is within a range of $0°<\alpha<180°$, $30°<\alpha<180°$, $60°<\alpha<180°$, $0°<\alpha<90°$, $30°<\alpha<90°$, $60°<\alpha<90°$, $30°<\alpha<150°$, or $60°<\alpha<120°$; and wherein neighboring poles of each adjacent pair of the one or more first-layer magnets are same poles.

3. The magnetic apparatus of claim 1, wherein the first layer comprises one or more first-layer magnets forming the plurality of first-layer poles; and wherein the one or more first-layer magnets are in an end-to-end arrangement with alternating polarities such that for each adjacent pair of the first-layer magnets, a pair of the ends thereof have same poles and are at a distance smaller than that of the other pair of the ends thereof.

4. The magnetic apparatus of claim 3, wherein the first layer further comprises one or more ferromagnetic blocks interleaved with the one or more first-layer magnets.

5. The magnetic apparatus of claim 3, wherein the first-layer magnets are partially buried in the second layer.

6. The magnetic apparatus of claim 1, wherein the spacers are non-ferromagnetic blocks or gaps.

7. The magnetic apparatus of claim 1, wherein, in a second state, the pole of each of the one or more second-layer magnets adjacent the corresponding first-layer pole is opposite to the corresponding first-layer pole.

8. The magnetic apparatus of claim 7, wherein the first and second layers are movable with respect to each other for switching between the first and second states, or wherein the second layer or each of the one or more second-layer magnets thereof is rotatable about an axis parallel to the first layer for switching between the first and second states, or wherein each of the one or more first-layer magnets is rotatable about an axis parallel to the target direction for switching between the first and second states.

9. The magnetic apparatus of claim 1, wherein the first surface is a plane or a curved surface.

10. The magnetic apparatus of any one of claim 1, wherein the first surface is a plane; and wherein the first-layer poles are arranged in a linear array, or a matrix form, or a circular pattern.

11. The magnetic apparatus of claim 1, wherein the first surface is at least a portion of a ring surface, a cylindrical surface, and/or a spherical surface.

12. The magnetic apparatus of claim 11, wherein the target direction is a radially inward direction or a radially outward direction.

13. The magnetic apparatus of claim 11, wherein the first and second sides are respectively an outer side and an inner side of the first layer, or the first and second sides are respectively the inner side and the outer side of the first layer.

14. The magnetic apparatus of claim 1, wherein the magnetic apparatus comprises a plurality of the first layers and the second layers interleaved with each other.

15. The magnetic apparatus of claim 1 further comprising at least one of:

a first ferromagnetic layer coupled to the second side of a layer furthest to the first layer; and a second ferromagnetic layer coupled to at least one of the first side of the first layer and the second side of the second layer.

16. The magnetic apparatus of claim 15, wherein the ferromagnetic layer is integrated with the first-layer ferromagnetic blocks.

17. The magnetic apparatus of claim 1 further comprising:

a third layer on the second side of the second layer for generating another directional magnetic field on the second side thereof, the third layer defines thereon a plurality of alternating South and North third-layer poles in a pattern, the third-layer poles in a same or reversed manner of the first-layer poles.

18. The magnetic apparatus of claim 17, wherein the first and third layers are at an obtuse angle with respect to the second layer.

19. The magnetic apparatus of claim 18, wherein the angle of the first and third layers is adjustable.

20. A magnetic apparatus for generating a directional magnetic field towards a target direction on a first side thereof, the magnetic apparatus comprising:

a first layer along a first surface perpendicular to the target direction, the first layer comprising one or more first-layer magnets interleaved with one or more first-layer ferromagnetic blocks; and a second layer on a second side opposite to the first side, the second layer comprising one or more second-layer magnets interleaved with one or more spacers;

wherein a total number of the one or more first-layer magnets and the one or more second-layer magnets is greater than or equal to three, and a total number of the one or more first-layer magnets and the one or more first-layer ferromagnetic blocks is greater than or equal to three;

wherein the one or more first-layer magnets are in an end-to-end arrangement on the first plane with alternating polarities along the first plane such that for each adjacent pair of the first-layer magnets, a pair of the ends thereof have a same pole and are at a distance smaller than that of the other pair of the ends thereof;

wherein the one or more second-layer magnets are in a side-by-side arrangement with the polarities thereof parallel to the target direction, each of the one or more second-layer magnets overlaps one of a set of first ferromagnetic blocks of the one or more first-layer ferromagnetic blocks along the target direction, and each of the one or more spacers overlaps one of the one or more first-layer magnets; and wherein, in a first state, for each of the set of first ferromagnetic blocks, a pole of the adjacent second-layer magnet adjacent thereto is same as pole or poles of the adjacent first-layer magnet(s) adjacent thereto.

21. The magnetic apparatus of claim 20, wherein, in a second state, for each of the set of first ferromagnetic blocks, the pole of the adjacent second-layer magnet adjacent thereto is opposite to the pole or poles of the adjacent first-layer magnet(s) adjacent thereto.

22. The magnetic apparatus of claim 20 further comprising:

a third layer on the second side of the second layer for generating another directional magnetic field towards the second side thereof, the third layer comprising one or more third-layer magnets interleaved with one or more third-layer ferromagnetic blocks, the polarities of the third-layer magnets in a same or reversed manner of those of the first-layer magnets.

* * * * *